US009350125B2

(12) United States Patent
Jones et al.

(10) Patent No.: US 9,350,125 B2
(45) Date of Patent: May 24, 2016

(54) REVERSIBLE USB CONNECTOR WITH COMPLIANT MEMBER TO SPREAD STRESS AND INCREASE CONTACT NORMAL FORCE

(71) Applicant: APPLE INC., Cupertino, CA (US)

(72) Inventors: Warren Z. Jones, San Jose, CA (US); Eric T. SooHoo, Sunnyvale, CA (US); Albert J. Golko, Saratoga, CA (US); Stephen Brian Lynch, Portola Valley, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 14/183,254

(22) Filed: Feb. 18, 2014

(65) Prior Publication Data

US 2014/0235095 A1 Aug. 21, 2014

Related U.S. Application Data

(60) Provisional application No. 61/765,602, filed on Feb. 15, 2013.

(51) Int. Cl.
*H01R 13/58* (2006.01)
*H01R 24/60* (2011.01)
(Continued)

(52) U.S. Cl.
CPC ..... *H01R 24/60* (2013.01); *H01R 13/055* (2013.01); *H01R 24/28* (2013.01); *H01R 2107/00* (2013.01)

(58) Field of Classification Search
CPC ..... H01R 24/28; H01R 24/60; H01R 27/00; H01R 29/00; H01R 33/90; H01R 13/055; H01R 13/562; H01R 13/58; H01R 13/582; H01R 13/5825; H01R 13/60
USPC ..... 439/131, 172, 173, 174, 217, 218, 439/607.44, 660, 449
See application file for complete search history.

(56) References Cited

U.S. PATENT DOCUMENTS 2,380,994 A 8/1945 Pummill
2,564,029 A 8/1951 Petersen
(Continued)

FOREIGN PATENT DOCUMENTS

CN 1397804 2/2003
CN 1830122 A 9/2006
(Continued)

OTHER PUBLICATIONS

Office Action for Korean Patent Application No. 10-2014-7017708, mailed Jul. 1, 2015, 2 pages.
(Continued)

*Primary Examiner* — Amy Cohen Johnson
*Assistant Examiner* — Milagros Jeancharles
(74) *Attorney, Agent, or Firm* — Kilpatrick Townsend & Stockton LLP

(57) ABSTRACT

Embodiments can provide reversible or dual orientation USB plug connectors for mating with standard USB receptacle connectors, e.g., a standard Type A USB receptacle connector. Accordingly, the present invention may be compatible with any current or future electronic device that includes a standard USB receptacle connector. USB plug connectors according to the present invention can have a 180 degree symmetrical, double orientation design, which enables the plug connector to be inserted into a corresponding receptacle connector in either of two intuitive orientations. Thus, embodiments of the present invention may reduce the potential for USB connector damage and user frustration during the incorrect insertion of a USB plug connector into a corresponding USB receptacle connector of an electronic device. Reversible USB plug connectors according to the present invention may include a compliant member or structural support for distributing stress and increasing contact normal force at the tongue of the reversible USB plug connector.

20 Claims, 30 Drawing Sheets

(51) Int. Cl.

| | |
|---|---|
| *H01R 13/05* | (2006.01) |
| *H01R 24/28* | (2011.01) |
| *H01R 107/00* | (2006.01) |

(56) References Cited

U.S. PATENT DOCUMENTS 2,564,550 A 8/1951 Tichenor
2,792,557 A 5/1957 Dowick
2,892,990 A 6/1959 Werndl
3,760,335 A 9/1973 Roberts
3,793,614 A 2/1974 Tachick et al.
3,795,037 A 3/1974 Luttmer
4,361,375 A 11/1982 Bailey et al.
4,461,529 A * 7/1984 Fariss ..... 439/604
4,558,912 A 12/1985 Coller et al.
4,621,882 A 11/1986 Krumme
4,711,506 A 12/1987 Tanaka
5,040,994 A 8/1991 Nakamoto et al.
5,256,074 A 10/1993 Tan et al.
5,295,843 A 3/1994 Davis et al.
5,380,179 A 1/1995 Nishimura et al.
5,380,225 A 1/1995 Inaoka
5,387,110 A 2/1995 Kantner et al.
5,413,442 A 5/1995 Grey
5,442,243 A 8/1995 Bailey
5,511,985 A 4/1996 Noschese et al.
5,518,421 A 5/1996 Davis
5,554,042 A 9/1996 Denninger
5,594,284 A 1/1997 Hill et al.
5,785,557 A 7/1998 Davis
5,959,848 A 9/1999 Groves et al.
5,967,723 A 10/1999 Duran
5,967,833 A 10/1999 Cachina
6,074,225 A 6/2000 Wu et al.
6,086,421 A 7/2000 Wu et al.
6,106,338 A 8/2000 Wu et al.
6,113,427 A 9/2000 Wu
6,176,723 B1 1/2001 Sakata et al.
6,179,627 B1 1/2001 Daly et al.
6,231,396 B1 5/2001 Huang
6,322,394 B1 11/2001 Katoh et al.
6,364,699 B1 4/2002 Hwang et al.
6,410,857 B1 6/2002 Gonya
6,482,028 B2 11/2002 Kumamoto et al.
6,482,045 B2 11/2002 Arai
6,488,520 B1 12/2002 Hayes et al.
6,530,793 B2 3/2003 Eichhorn et al.
6,692,311 B1 2/2004 Kamei et al.
6,716,058 B2 4/2004 Youn
6,776,665 B2 8/2004 Huang
6,786,763 B2 9/2004 Wu
6,846,202 B1 1/2005 Schmidt et al.
6,869,320 B2 3/2005 Haas et al.
6,902,432 B2 6/2005 Morikawa et al.
6,948,965 B2 9/2005 Kumamoto et al.
6,948,983 B1 9/2005 Peng
6,948,984 B2 9/2005 Chen et al.
6,962,510 B1 11/2005 Chen et al.
6,964,582 B2 11/2005 Zhuang et al.
6,981,887 B1 1/2006 Mese et al.
6,994,575 B1 2/2006 Clark et al.
7,021,971 B2 4/2006 Chou et al.
7,040,919 B2 5/2006 Yao
7,074,052 B1 7/2006 Ni et al.
7,094,086 B2 8/2006 Teicher
7,094,089 B2 8/2006 Andre et al.
7,160,125 B1 1/2007 Teicher
7,175,444 B2 2/2007 Lang et al.
7,192,313 B2 3/2007 Sai
7,198,522 B1 4/2007 Ho et al.
7,249,978 B1 7/2007 Ni
7,293,122 B1 11/2007 Schubert et al.
7,361,059 B2 4/2008 Harkabi et al.
7,363,947 B2 4/2008 Teicher
7,364,445 B1 4/2008 Ni et al.
7,387,539 B2 6/2008 Trenne
7,396,257 B2 7/2008 Takahashi
7,407,416 B1 8/2008 Rogers et al.
7,435,107 B2 10/2008 Masumoto et al.
7,440,286 B2 10/2008 Hiew et al.
7,442,091 B2 10/2008 Salolmon et al.
7,458,825 B2 12/2008 Atsmon et al.
7,497,724 B1 3/2009 Fong et al.
7,500,861 B2 3/2009 Harkabi et al.
7,537,471 B2 5/2009 Teicher
7,549,896 B2 6/2009 Zhang et al.
7,553,172 B2 6/2009 Chiu et al.
7,559,805 B1 7/2009 Yi et al.
7,572,153 B2 8/2009 Trenne
7,591,657 B2 9/2009 Teicher
7,594,827 B2 9/2009 Takamoto et al.
7,651,379 B1 1/2010 Wu
7,695,318 B1 4/2010 Wang et al.
7,716,400 B2 5/2010 Raines
7,717,717 B1 5/2010 Lai
7,722,409 B2 5/2010 Takamoto et al.
7,727,027 B2 6/2010 Chiang et al.
7,740,498 B1 6/2010 Orsley
7,758,374 B2 7/2010 Yu et al.
7,798,853 B2 9/2010 Shi et al.
7,811,131 B2 10/2010 Wang et al.
7,841,894 B2 11/2010 Gong et al.
7,865,629 B1 1/2011 Tantos et al.
7,872,873 B2 1/2011 Hiew et al.
7,892,014 B2 2/2011 Amidon et al.
7,892,033 B2 2/2011 Huang et al.
7,918,685 B1 4/2011 Kruckenberg
8,007,309 B2 8/2011 Fan
8,062,073 B1 11/2011 Szczesny et al.
8,109,795 B2 * 2/2012 Lin et al. ..... 439/660
8,162,696 B2 4/2012 Elbaz et al.
8,246,388 B2 8/2012 Chen et al.
8,277,258 B1 10/2012 Huang et al.
8,282,417 B2 10/2012 Xiao
8,287,299 B2 10/2012 Ray et al.
8,342,863 B2 1/2013 Kondo et al.
8,461,465 B2 6/2013 Golko et al.
8,478,913 B2 7/2013 Terlizzi et al.
8,517,751 B1 8/2013 Golko et al.
8,517,766 B2 8/2013 Golko et al.
8,535,075 B1 9/2013 Golko et al.
8,545,269 B2 10/2013 Ore-Yang
8,545,275 B2 10/2013 Wang et al.
8,561,879 B2 10/2013 Jol et al.
8,573,995 B2 11/2013 Golko et al.
8,647,156 B2 2/2014 Golko et al.
8,686,600 B2 4/2014 Terlizzi et al.
8,688,876 B1 4/2014 Fritchman et al.
8,702,319 B2 4/2014 Wu
8,708,745 B2 4/2014 Golko et al.
8,740,649 B2 6/2014 Lan et al.
8,753,020 B2 6/2014 Wu
8,762,605 B2 6/2014 Terlizzi et al.
8,777,666 B2 7/2014 Golko et al.
8,840,321 B2 9/2014 Wu
8,882,524 B2 11/2014 Golko et al.
8,911,260 B2 12/2014 Golko et al.
8,931,962 B2 1/2015 Jol et al.
8,998,632 B2 4/2015 Golko et al.
9,142,926 B2 9/2015 Tsai
9,153,895 B2 10/2015 Kao et al.
9,160,115 B2 10/2015 Kao et al.
2001/0046809 A1 11/2001 Chiran et al.
2002/0081880 A1 6/2002 Eichhorn et al.
2003/0012677 A1 1/2003 Senini
2003/0016509 A1 1/2003 Tsukamoto
2003/0207606 A1 11/2003 Ho
2004/0229515 A1 11/2004 Kaneda et al.
2004/0259423 A1 12/2004 Elbaz et al.
2005/0032426 A1 2/2005 Tanaka
2005/0042930 A1 2/2005 Harkabi et al.
2005/0079738 A1 4/2005 Ahn
2005/0085136 A1 4/2005 Zhuang
2005/0124217 A1 6/2005 Zhuang et al.

(56) References Cited

U.S. PATENT DOCUMENTS

| | | | |
|---|---|---|---|
| 2005/0124218 | A1 | 6/2005 | Chen et al. |
| 2005/0124219 | A1 | 6/2005 | Chen et al. |
| 2005/0202727 | A1 | 9/2005 | Andre et al. |
| 2006/0019545 | A1 | 1/2006 | Moriyama et al. |
| 2006/0024997 | A1 | 2/2006 | Teicher |
| 2006/0040549 | A1 | 2/2006 | Yao |
| 2006/0148300 | A1 | 7/2006 | Huang et al. |
| 2006/0216991 | A1 | 9/2006 | Boutros |
| 2006/0250764 | A1 | 11/2006 | Howarth et al. |
| 2006/0289201 | A1 | 12/2006 | Kim et al. |
| 2007/0010115 | A1 | 1/2007 | Teicher |
| 2007/0010116 | A1 | 1/2007 | Teicher |
| 2007/0037452 | A1 | 2/2007 | Martin et al. |
| 2007/0049100 | A1 | 3/2007 | Tsai |
| 2007/0072442 | A1 | 3/2007 | DiFonzo |
| 2007/0082701 | A1 | 4/2007 | Seil et al. |
| 2007/0178771 | A1 | 8/2007 | Goetz et al. |
| 2007/0202725 | A1 | 8/2007 | Teicher |
| 2007/0243726 | A1 | 10/2007 | Trenne |
| 2008/0032562 | A1 | 2/2008 | McHugh et al. |
| 2008/0067248 | A1 | 3/2008 | Hiew et al. |
| 2008/0090465 | A1 | 4/2008 | Matsumoto et al. |
| 2008/0119076 | A1 | 5/2008 | Teicher |
| 2008/0119291 | A1 | 5/2008 | Takamoto et al. |
| 2008/0167828 | A1 | 7/2008 | Terlizzi et al. |
| 2008/0200069 | A1 | 8/2008 | Hankey et al. |
| 2008/0274633 | A1 | 11/2008 | Teicher |
| 2008/0309313 | A1 | 12/2008 | Farrar et al. |
| 2009/0004923 | A1 | 1/2009 | Tang et al. |
| 2009/0011621 | A1 | 1/2009 | Trenne |
| 2009/0108848 | A1 | 4/2009 | Lundquist |
| 2009/0117768 | A1 | 5/2009 | Liao |
| 2009/0149049 | A1 | 6/2009 | Harkabi et al. |
| 2009/0156027 | A1 | 6/2009 | Chen |
| 2009/0180243 | A1 | 7/2009 | Lynch et al. |
| 2009/0291576 | A1 | 11/2009 | Johansson et al. |
| 2010/0009575 | A1 | 1/2010 | Crooijmans et al. |
| 2010/0062656 | A1 | 3/2010 | Lynch et al. |
| 2010/0075604 | A1 | 3/2010 | Lydon et al. |
| 2010/0080563 | A1 | 4/2010 | DiFonzo et al. |
| 2010/0081337 | A1 | 4/2010 | Dorogusker et al. |
| 2010/0104126 | A1 | 4/2010 | Greene |
| 2010/0118932 | A1 | 5/2010 | Luo et al. |
| 2010/0171465 | A1 | 7/2010 | Seal et al. |
| 2010/0173533 | A1 | 7/2010 | Yang et al. |
| 2010/0221936 | A1 | 9/2010 | Zhao et al. |
| 2010/0248544 | A1 | 9/2010 | Xu et al. |
| 2010/0254602 | A1 | 10/2010 | Yoshino |
| 2010/0254662 | A1 | 10/2010 | He et al. |
| 2010/0262744 | A1 | 10/2010 | Deva et al. |
| 2010/0267261 | A1 | 10/2010 | Lin et al. |
| 2010/0267262 | A1 | 10/2010 | Lin et al. |
| 2011/0136381 | A1 | 6/2011 | Cho |
| 2011/0159719 | A1 | 6/2011 | Takahashi et al. |
| 2011/0201213 | A1 | 8/2011 | Dabov et al. |
| 2011/0250786 | A1 | 10/2011 | Reid |
| 2011/0263141 | A1 | 10/2011 | Ko |
| 2011/0294354 | A1 | 12/2011 | Chen et al. |
| 2011/0312200 | A1 | 12/2011 | Wang et al. |
| 2012/0028495 | A1 | 2/2012 | Su et al. |
| 2012/0149244 | A1 | 6/2012 | Zheng et al. |
| 2013/0075149 | A1 | 3/2013 | Golko et al. |
| 2013/0078869 | A1 | 3/2013 | Golko et al. |
| 2013/0095701 | A1 | 4/2013 | Golko et al. |
| 2013/0095702 | A1 | 4/2013 | Golko et al. |
| 2013/0115821 | A1 | 5/2013 | Golko et al. |
| 2013/0117470 | A1 | 5/2013 | Terlizzi et al. |
| 2013/0122754 | A1 | 5/2013 | Golko et al. |
| 2013/0149911 | A1 | 6/2013 | Golko et al. |
| 2013/0217253 | A1 | 8/2013 | Golko et al. |
| 2013/0244489 | A1 | 9/2013 | Terlizzi et al. |
| 2013/0244491 | A1 | 9/2013 | Sarwar et al. |
| 2013/0244492 | A1 | 9/2013 | Golko et al. |
| 2013/0337698 | A1 | 12/2013 | Little et al. |
| 2014/0004741 | A1 | 1/2014 | Jol et al. |
| 2014/0057496 | A1 | 2/2014 | Siahaan et al. |
| 2014/0068933 | A1 | 3/2014 | Brickner et al. |
| 2014/0069709 | A1 | 3/2014 | Schmidt et al. |
| 2014/0073170 | A1 | 3/2014 | Golko et al. |
| 2014/0073183 | A1 | 3/2014 | Golko et al. |
| 2014/0073193 | A1 | 3/2014 | SooHoo et al. |
| 2014/0141647 | A1 | 5/2014 | Do |
| 2014/0170907 | A1 | 6/2014 | Golko et al. |
| 2014/0206209 | A1 | 7/2014 | Kamei et al. |
| 2014/0294656 | A1 | 10/2014 | Brickner et al. |
| 2014/0329416 | A1 | 11/2014 | Golko et al. |
| 2014/0335729 | A1 | 11/2014 | Little et al. |

FOREIGN PATENT DOCUMENTS

| | | | |
|---|---|---|---|
| CN | 1878370 | A | 12/2006 |
| CN | 1905286 | A | 1/2007 |
| CN | 101116227 | A | 1/2008 |
| CN | 201256225 | Y | 6/2009 |
| CN | 201402871 | Y | 2/2010 |
| CN | 201509210 | U | 6/2010 |
| CN | 101782888 | A | 7/2010 |
| CN | 101783466 | A | 7/2010 |
| CN | 201533091 | U | 7/2010 |
| DE | 19609571 | A1 | 11/1995 |
| DE | 202004021354 | U1 | 9/2007 |
| EP | 0081372 | A2 | 6/1983 |
| EP | 1684391 | A2 | 7/2006 |
| EP | 1717910 | A2 | 11/2006 |
| EP | 2169774 | A1 | 3/2010 |
| EP | 2373131 | A1 | 10/2011 |
| JP | 2078171 | A | 3/1990 |
| JP | H06231821 | A | 8/1994 |
| JP | H06250103 | A | 9/1994 |
| JP | 8321360 | A | 12/1996 |
| JP | 2001223057 | A | 8/2001 |
| JP | 2003217728 | A | 7/2003 |
| JP | 2004079491 | A | 3/2004 |
| JP | 2004319371 | A | 11/2004 |
| JP | 2008041656 | A | 2/2008 |
| JP | 2008508694 | A | 3/2008 |
| JP | 2008210674 | A | 9/2008 |
| JP | 2009117128 | A | 5/2009 |
| JP | 2010067459 | A | 3/2010 |
| KR | 1020110061283 | | 6/2011 |
| TW | 176423 | | 1/1992 |
| TW | 451527 | B | 8/2001 |
| TW | M318831 | U | 9/2007 |
| TW | M327102 | U | 2/2008 |
| TW | M350153 | U | 2/2009 |
| TW | M376988 | U | 3/2010 |
| TW | 201021329 | A | 6/2010 |
| WO | 0208872 | A1 | 1/2002 |
| WO | 2004097995 | A1 | 11/2004 |
| WO | 2005013436 | A1 | 2/2005 |
| WO | 2005124932 | A2 | 12/2005 |
| WO | 2006013553 | A2 | 2/2006 |
| WO | 2006074348 | A1 | 12/2006 |
| WO | 2007090069 | | 8/2007 |
| WO | 2008065659 | A2 | 6/2008 |
| WO | 2009069969 | A2 | 6/2009 |
| WO | 2009140992 | A1 | 11/2009 |
| WO | 2011043488 | A1 | 4/2011 |
| WO | 2012086145 | A1 | 6/2012 |

OTHER PUBLICATIONS

Office Action and Search Report for Taiwanese Application No. 101141466, mailed Jul. 28, 2015, 21 pages.

Office Action for Chinese Patent Application No. 201180034957.2, mailed Dec. 22, 2014, 22 pages.

Office Action for Japanese Patent Application No. 2013-512061, mailed Dec. 24, 2014, 4 pages.

Non-Final Office Action for U.S. Appl. No. 13/650,062, mailed Jan. 12, 2015, 19 pages.

Non-Final Office Action for U.S. Appl. No. 13/610,777, mailed Jan. 26, 2015, 7 pages.

First Office Action, Australian Patent Application No. 2012101657; Mailed Dec. 14, 2012, 4 pages.

(56) References Cited

OTHER PUBLICATIONS

Flipper Press Release (Jun. 25, 2012) and Data Sheet: http://www.flipperusb.com/images/flipperUSB-brochure.pdf.
Hewlett-Packard Company, "An Overview of Current Display Interfaces," Nov. 2007, p. 12, http://isvpatch.external.hp.com/HPPTF2/drvlib/docs/DisplayInterfacesOverview.pdf, 14 pages.
International Search Report and Written Opinion for International PCT Application No. PCT/US2012/054318, mailed on Oct. 25, 2012, 47 pages.
International Preliminary Report on Patentability for International PCT Application No. PCT/US2011/038452, mailed Dec. 13, 2012, 19 pages.
International Preliminary Report on Patentability for International PCT Application No. PCT/US2011/041127, mailed Jan. 3, 2013, 8 pages.
International Preliminary Report on Patentability for International PCT Application No. PCT/US2011/041286, mailed Jan. 10, 2013, 12 pages.
International Preliminary Report on Patentability for International PCT Application No. PCT/US2011/041290, mailed Jan. 10, 2013, 15 pages.
International Search Report and Written Opinion for International PCT Application No. PCT/CN2012/081257, mailed on Jun. 20, 2013, 11 pages.
International Search Report and Written Opinion for International PCT Application No. PCT/US2011/041127, mailed on Dec. 29, 2011, 17 pages.
International Search Report and Written Opinion for International PCT Application No. PCT/US2011/041286, mailed on Oct. 20, 2011, 18 pages.
International Search Report and Written Opinion for International PCT Application No. PCT/US2011/041290, mailed on Nov. 21, 2011, 21 pages.
International Search Report and Written Opinion for International PCT Application No. PCT/US2012/063944, mailed Apr. 18, 2013, 23 pages.
International Search Report for International PCT Application No. PCT/US2011/038452, mailed on Oct. 26, 2011, 27 pages.
Non-Final Office Action for U.S. Appl. No. 13/679,991, mailed Apr. 5, 2013, 19 pages.
Non-Final Office Action for U.S. Appl. No. 13/679,992, mailed Apr. 9, 2013, 18 pages.
Notice of Allowance for U.S. Appl. No. 13/679,992, mailed Jun. 11, 2013, 17 pages.
Notice of Allowance for U.S. Appl. No. 13/679,991, mailed Jul. 10, 2013, 22 pages.
Notice of Allowance for U.S. Appl. No. 13/679,996, mailed Apr. 12, 2013, 30 pages.
Notice of Allowance for U.S. Appl. No. 13/720,822, mailed Apr. 8, 2013, 30 pages.
Partial Search Report for International PCT Application No. PCT/US2012/063944 (mailed with Invitation to Pay Fees), mailed Feb. 20, 2013, 59 pages.
Partial Search Report for International PCT Application No. PCT/US2012/066881 (mailed with Invitation to Pay Fees), mailed Mar. 25, 2013, 8 pages.
Partial Search Report, EP App. No. 12191619.1, Mailed Feb. 20, 2013, 6 pages.
Search and Examination Report for United Kingdom Patent Application No. 1220045.7, mailed on Mar. 15, 2013, 7 pages.
Written Opinion for International PCT Application No. PCT/US2011/038452, mailed on Oct. 26, 2011, 17 pages.
Extended European Search Report, EP App. No. 12191619.1, Mailed Jul. 10, 2013, 13 pages.
Non-Final Office Action for U.S. Appl. No. 13/607,366, mailed Jul. 11, 2013, 23 pages.
Ex Parte Quayle Office Action for U.S. Appl. No. 13/761,001, mailed Jul. 17, 2013, 10 pages.
International Search Report and Written Opinion for International PCT Application No. PCT/US2013/038008, mailed Aug. 15, 2013, 12 pages.
Notice of Allowance for U.S. Appl. No. 13/761,001 , mailed Sep. 10, 2013, 9 pages.
International Search Report and Written Opinion for International PCT Application No. PCT/US2012/066881, mailed Sep. 9, 2013, 19 pages.
International Search Report and Written Opinion for International PCT Application No. PCT/US2013/037233, mailed on Oct. 1, 2013, 14 pages.
Notice of Allowance for U.S. Appl. No. 13/607,366, mailed Oct. 31, 2013, 14 pages.
Office Action and Search Report for Taiwanese Application No. 100118944, mailed Sep. 16, 2013, 24 pages.
Office Action for Australian Application No. 2012245184, mailed Nov. 6, 2013, 3 pages.
Non-Final Office Action for U.S. Appl. No. 13/607,566, mailed Dec. 6, 2013, 20 pages.
Office Action for Australian Application No. 2011257975, mailed Dec. 16, 2013, 6 pages.
Extended European Search Report, EP App. No. 13165892.4, mailed Dec. 20, 2013, 6 pages.
Office Action for Korean Patent Application No. 10-2012-0125751, mailed Jan. 22, 2014, 6 pages.
Office Action for Mexican Patent Application No. MX/a/2012/013857, mailed Feb. 6, 2014, 3 pages.
Office Action, Canadian Patent Application No. 2,794,906; Mailed Mar. 4, 2014, 2 pages.
Office Action for United Kingdom Patent Application No. 1220045.7, mailed on Mar. 7, 2014, 3 pages.
Notice of Allowance for U.S. Appl. No. 13/607,566, mailed Mar. 11, 2014, 8 pages.
Extended European Search Report, EP App. No. 14152776.2, mailed Mar. 11, 2014, 9 pages.
Office Action for United Kingdom Application No. 1400243.0, mailed Mar. 12, 2014, 4 pages.
European Search Report, EP App. No. 13195854.8, mailed Mar. 12, 2014, 7 pages.
Office Action for Russian Application No. 2012157740, mailed Mar. 21, 2014, 5 pages.
Partial Search Report for International PCT Application No. PCT/US2014/012535 (mailed with Invitation to Pay Fees), mailed Apr. 4, 2014, 7 pages.
Non-Final Office Action for U.S. Appl. No. 13/700,441, mailed Apr. 10, 2014, 36 pages.
Office Action for Australian Application No. 2012245184, mailed Apr. 28, 2014, 3 pages.
Office Action for Korean Patent Application No. 10-2012-7034333, mailed Apr. 29, 2014, 6 pages.
Office Action for Taiwanese Patent Application No. 100121725, mailed May 1, 2014, 8 pages.
Office Action, Canadian Patent Application No. 2,800,738, mailed May 8, 2014, 2 pages.
Non-Final Office Action for U.S. Appl. No. 13/703,893, mailed May 9, 2014, 10 pages.
Office Action for Malaysian Patent Application No. PI2012005119, mailed on May 15, 2014, 4 pages.
Non-Final Office Action for U.S. Appl. No. 13/704,236, mailed May 19, 2014, 10 pages.
International Preliminary Report on Patentability for International PCT Application No. PCT/US2012/063944, mailed May 22, 2014, 15 pages.
International Preliminary Report on Patentability for International PCT Application No. PCT/US2012/054318, mailed Jun. 12, 2014, 8 pages.
International Preliminary Report on Patentability for International PCT Application No. PCT/US2012/066881, mailed Jun. 12, 2014, 14 pages.
Office Action for Korean Patent Application No. 10-2013-7001302, mailed Jun. 13, 2014, 9 pages.
Non-Final Office Action for U.S. Appl. No. 13/704,234, mailed Jul. 11, 2014, 6 pages.

(56) References Cited

OTHER PUBLICATIONS

Office Action for Chinese Patent Application No. 201310711187.1, mailed Jul. 14, 2014, 5 pages.
Office Action for Australian Application No. 2013204685, mailed Jul. 17, 2014, 2 pages.
Office Action for Mexican Patent Application No. MX/a/2012/013857, mailed Jul. 23, 2014, 4 pages.
Office Action for Korean Patent Application No. 10-2014-0048365, mailed Aug. 11, 2014, 4 pages.
Office Action for Australian Patent Application No. 2013205161, mailed Aug. 18, 2014, 4 pages.
Final Office Action for U.S. Appl. No. 13/700,441, mailed Aug. 21, 2014, 9 pages.
Office Action for Chinese Patent Application No. 201180030576.7, mailed Sep. 2, 2014, with English translation, 23 pages.
Non-Final Office Action for U.S. Appl. No. 13/610,631, mailed Sep. 16, 2014, 28 pages.
Notice of Allowance for U.S. Appl. No. 13/703,893, mailed Sep. 16, 2014, 8 pages.
Notice of Allowance for U.S. Appl. No. 13/704,236, mailed Sep. 17, 2014, 9 pages.
Office Action for Taiwanese Patent Application No. 101145138, mailed Sep. 4, 2014, 23 pages.
Office Action for Chinese Patent Application No. 201310310784.3, mailed Sep. 16, 2014, 12 pages.
Office Action for Chinese Patent Application No. 201210442879.6, mailed Sep. 23, 2014, 21 pages.
Office Action for Chinese Patent Application No. 201180030580.3, mailed Sep. 29, 2014, 29 pages.
Notice of Allowance for U.S. Appl. No. 13/704,234, mailed Sep. 30, 2014, 10 pages.
Office Action for Chinese Patent Application No. 201310743192.0, mailed Oct. 15, 2014, 11 pages.
Notice of Allowance for Chinese Patent Application No. 201310711187.1, mailed Nov. 3, 2014, 4 pages.
International Search Report and Written Opinion for International PCT Application No. PCT/US2014/012535, mailed Nov. 6, 2014, 17 pages.
Notice of Allowance for U.S. Appl. No. 13/703,893, mailed Nov. 7, 2014, 2 pages.
Notice of Allowance for U.S. Appl. No. 13/704,236, mailed Nov. 7, 2014, 2 pages.
Notice of Allowance for U.S. Appl. No. 13/700,441, mailed Nov. 10, 2014, 5 pages.
Office Action for Korean Patent Application No. 10-2012-7034333, mailed Nov. 18, 2014, 4 pages.
Non-Final Office Action for U.S. Appl. No. 13/607,430, mailed Nov. 26, 2014, 20 pages.
Extended European Search Report, EP App. No. 13165270.3, Mailed Nov. 28, 2014, 12 pages.
Office Action, Canadian Patent Application No. 2,800,738, mailed Dec. 2, 2014, 3 pages.
Non-Final Office Action for U.S. Appl. No. 14/137,824, mailed Dec. 17, 2014, 6 pages.
Non-Final Office Action for U.S. Appl. No. 13/875,637, mailed Dec. 26, 2014, 11 pages.

* cited by examiner

REVERSIBLE USB CONNECTOR WITH COMPLIANT MEMBER TO SPREAD STRESS AND INCREASE CONTACT NORMAL FORCE

CROSS-REFERENCE TO RELATED APPLICATION

This application claims the benefit of commonly owned U.S. Provisional Patent Application No. 61/765,602 filed Feb. 15, 2013. Additionally, commonly owned U.S. Provisional Patent Application No. 61/765,602 filed Feb. 15, 2013 and U.S. Provisional Patent Application No. 61/756,413, filed Jan. 24, 2013 are hereby incorporated by reference herein in their entirety for all purposes.

FIELD

The described embodiments relate generally to input/output electrical connectors. More particularly, the present embodiments relate to data connectors

BACKGROUND OF THE INVENTION

Many electronic devices include data connectors, such as Universal Serial Bus (USB) connectors, that receive and provide power and data. These electrical connectors are typically female receptacle connectors and are designed to receive a male plug connector. The plug connector may be on the end of a cable and plug into an electronic device, thereby forming one or more conductive paths for signals and power.

USB connectors, like many other standard data connectors, require that male plug connectors be mated with corresponding female receptacle connectors in a single, specific orientation in order for the USB connection to function properly. Such connectors can be referred to as polarized connectors. Accordingly, USB receptacle connectors include an insertion opening with features that prevents USB plug connectors from being inserted into the USB receptacle connector in the wrong way. That is, it can only be inserted one way because it is a polarized connector. Many other commonly used data connectors, including mini USB connectors, FireWire connectors, as well as many other proprietary connectors are also polarized connectors.

It is sometimes difficult for users to determine when a polarized plug connector, such as a USB plug connector, is oriented in the correct orientation for insertion into a corresponding receptacle connector. Some USB plug and/or receptacle connectors may include markings to indicate their orientation such that users know how to properly insert a plug connector into corresponding receptacle connectors. However, these marking are not always utilized by users and/or can be confusing to some users. In some cases, these markings are not helpful because the markings cannot be easily viewed due to the location of the receptacle connector, lighting conditions, or other reasons. Even when visible, these markings may still be unhelpful because not all manufacturers apply these markings in a consistent fashion. Consequently, users may incorrectly insert a plug connector into a corresponding receptacle connector, which may potentially result in damage to the connectors and/or user frustration.

Accordingly, it is desirable to provide connectors, e.g., USB connectors, that do not suffer from all or some of these deficiencies.

BRIEF DESCRIPTION OF THE DRAWINGS

To better understand the nature and advantages of the present invention, reference should be made to the following description and the accompanying figures. It is to be understood, however, that each of the figures is provided for the purpose of illustration only and is not intended as a definition of the limits of the scope of the present invention. Also, as a general rule, and unless it is evident to the contrary from the description, where elements in different figures use identical reference numbers, the elements are generally either identical or at least similar in function or purpose.

FIGS. 19B and 19B-1 are cross sectional side and partially exploded, partial cross sectional perspective views, respectively, of the USB plug connector of FIGS. 19A and 19A-1 with a support structure according to one embodiment of the present invention;

DETAILED DESCRIPTION OF THE INVENTION

The present invention will now be described in detail with reference to certain embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known details have not been described in detail in order not to unnecessarily obscure the present invention.

Embodiments can provide reversible or dual orientation USB plug connectors for mating with standard USB receptacle connectors, e.g., a standard Type A USB receptacle connector. Accordingly, the present invention may be compatible with any current or future electronic device that includes a standard USB receptacle connector. USB plug connectors according to the present invention can have a 180 degree symmetrical, dual or double orientation design which enables the plug connector to be inserted into a corresponding receptacle connector in either of two intuitive orientations. To allow for the orientation agnostic feature of such a plug connector, the portion of the plug connector having contacts may not be polarized. Instead, in some embodiments, the portion of the plug connector having contacts may be movable such that its contacts can mate with corresponding contacts of the receptacle connector in either of two intuitive orientations. Thus, embodiments of the present invention may reduce the potential for USB connector damage and user frustration during the insertion of the USB plug connector into a corresponding USB receptacle connector of an electronic device.

Methods for manufacturing plug connectors according to the present invention are also described below in relation to a specific plug connector embodiment. However, these methods of manufacture may apply to other plug connector embodiments described herein.

Figure 1A:
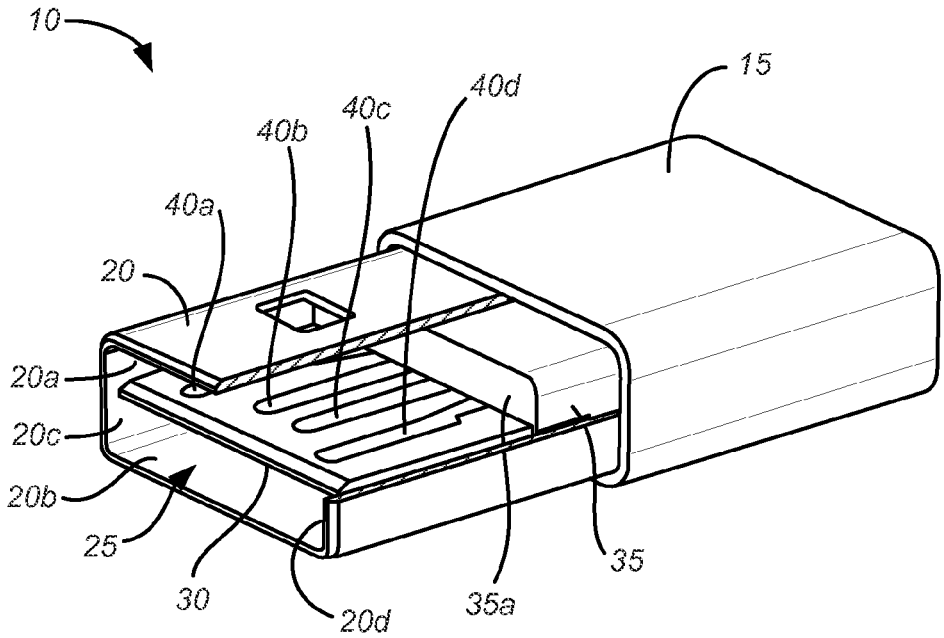
FIGS. 1A and 1B are partial cross sectional perspective and cross sectional views, respectively, of a USB plug connector according to one embodiment of the present invention.
Figure 1B:
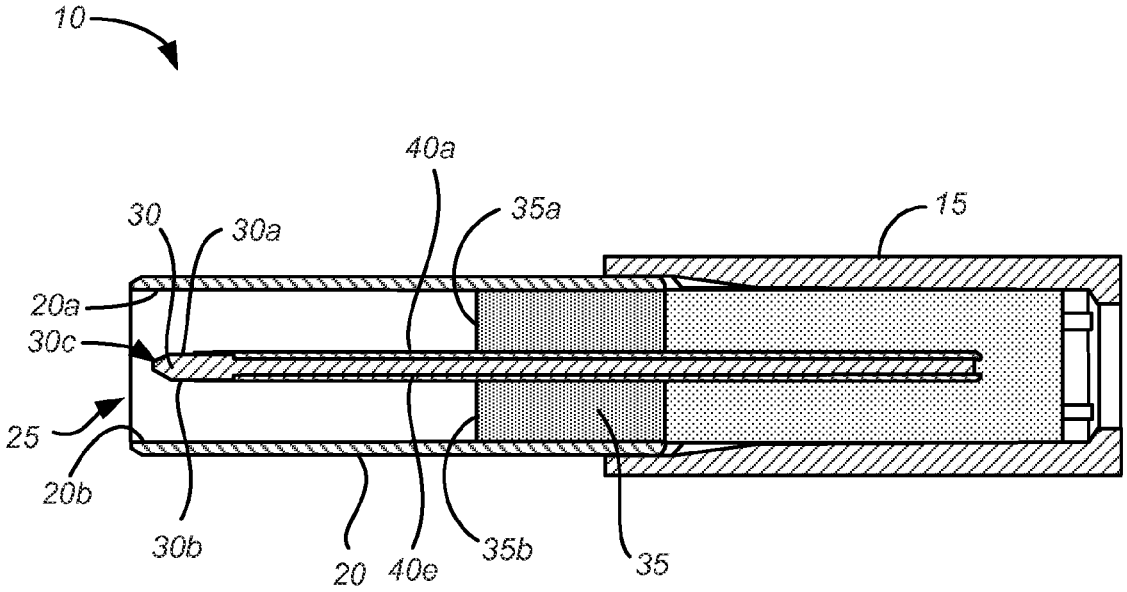

In order to better appreciate and understand the present invention, reference is first made to FIGS. 1A and 1B, which are partial cross sectional perspective and cross sectional views, respectively, of a USB plug connector 10 according to one embodiment of the present invention. Connector 10 includes a body 15 and a shell 20 extending longitudinally away from body 15 in a direction parallel to the length of connector 10. Shell 20 includes an opening 25 that communicates with a cavity defined by first, second, left and right inner surfaces 20*a*-20*d* of shell 20, a tongue 30, and first and second surfaces 35*a*, 35*b* of support structure 35. As shown in FIGS. 1A and 1B, tongue 30 may be centrally located between first and second inner surfaces 20*a*, 20*b* and extend parallel to the length of connector 10. Contacts 40*a*-40*d* are disposed on a first major surface 30*a* and four additional contacts (only contact 40*e* is shown in FIG. 1B) are disposed on second major surface 30*b*. As also shown in FIGS. 1A and 1B, tongue 30 may include a bullnose tip 30*c* for reasons that will be explained below.

As shown in FIGS. 1A and 1B, connector 10 can have a 180 degree symmetrical, double orientation design which enables the connector to be inserted into a corresponding receptacle connector in both a first orientation where surface 30*a* is facing up or a second orientation where surface 30*a* is rotated 180 degrees and facing down. To allow for the orientation agnostic feature of connector 10, tongue 30 is not polarized. That is, tongue 30 does not include a physical key that is configured to mate with a matching key in a corresponding receptacle connector designed to ensure that mating between the two connectors occurs only in a single orientation. Instead, if tongue 30 is divided into top and bottom halves along a horizontal plane that bisects the center of tongue 30 along its width, the physical shape of the upper half of tongue 30 is substantially the same as the physical shape of the lower half. Similarly, if tongue 30 is divided into left and right halves along a vertical plane that bisects the center of tab along its length, the physical shape of the left half of tongue 30 is substantially the same as the shape of the right half. Additionally, contacts 40*a*-40*d* and four additional contacts disposed on second major surface 30*b* can be positioned so that the contacts on first and second major surfaces 30*a*, 30*b* are arranged in a symmetric manner. Accordingly, the contacts disposed on first surface 30*a* (contacts 40*a*-40*d*) mate with contacts of the corresponding receptacle connector in one orientation and contacts disposed on second surface 30*b* mate with contacts of the corresponding receptacle connector in the other orientation.

Tongue 30 may be a printed circuit board (PCB) or may be made from one or more of a variety of dielectric materials including flexible, wear resistant materials such as liquid crystal polymers (LCP), polyoxymethylene (POM), Nylon and others. Structural support 35 may also be made from a variety of dielectric materials, including flexible polymers. The materials used to form tongue 30 and/or structural support 35 may be chosen such that tongue 30 deflects either toward first or second inner surfaces 20*a*, 20*b* of shell 20 when connector 10 is inserted into a corresponding receptacle connector. This deflection may occur as bullnose tip 30*c* comes into contact with internal features of a corresponding receptacle connector and leads tongue 30 to the appropriate region within a corresponding receptacle connector, allowing contacts disposed on either surface 30*a* or 30*b* of the plug connector 10 to mate with contacts on the corresponding receptacle connector.

As mentioned earlier, tongue 30 may be centrally located within opening 25 of shell 20. For example, tongue 30 may be positioned within opening 25 such that its distance from first and second inner surfaces 20*a*, 20*b* causes connector 10 to always deflect, with the assistance of bullnose tip 30*c*, toward the appropriate region within a corresponding receptacle connector regardless of whether plug connector 10 is in the first or second orientation, as described above. Portions of tongue 30 may deform and deflect in different manners in order to put its contact in position to mate with the contacts of the corresponding receptacle connector. The thickness of tongue 30 may be varied depending on the material of tongue 30 such that tongue 30 may elastically deform as necessary for mating events.

Body 15 is generally the portion of connector 10 that a user will hold onto when inserting or removing connector 10 from a corresponding receptacle connector. Body 15 can be made out of a variety of materials and in some embodiments is made from a dielectric material, such as a thermoplastic polymer formed in an injection molding process. While not shown in FIG. 1A or 1B, a cable and a portion of shell 20 may extend within and be enclosed by body 15. Also, electrical contact to the contacts of surfaces 30*a*, 30*b* can be made with individual wires in a cable within body 15. In one embodiment, a cable includes a plurality of individual insulated wires for connecting to contacts of surfaces 30*a*, 30*b* that are soldered to bonding pads on a PCB housed within body 15 or on tongue 30 when tongue 30 is a PCB. The bonding pads on the PCB may be electrically coupled to corresponding individual contacts of surfaces 30*a* and 30*b*. In some embodiments, contacts of one of surfaces 30*a* and 30*b* may be shorted through tongue 30 or a PCB to corresponding contacts on the other of surfaces 30*a* and 30*b* and then appropriately routed to the individual wires of a cable within body 15.

The contacts of tongue 30 can be made from copper, nickel, brass, a metal alloy or any other appropriate conductive material. In some embodiments, contacts can be printed on surfaces 30*a* and 30*b* using techniques similar to those used to print contacts on printed circuit boards. As with standard USB plug connectors, plug connector 10 may include contacts for power, ground and a pair of differential data signals (e.g., data transmit). For example, contact 40*a* may be a ground pin, contact 40*b* may be a Data+pin, contact 40*c* may be a Data−pin and contact 40*d* may be a power pin (VBUS). As mentioned earlier, the four additional contacts disposed on second major surface 30*b* can be positioned so that the contacts on first and second major surfaces 30*a*, 30*b* are arranged in a symmetric manner. Accordingly, pins may be designated for the contacts on the first and second major surfaces 30*a*, 30*b* such that the pinout may be the same for both surfaces 30*a*, 30*b*. For example, a contact 40*e* on surface 30*b* corresponding to (aligned with in the length and width directions of connector 10) contact 40*a*, may also be a power pin (VBUS), a contact on surface 30*b* corresponding to contact 40*b* may be a Data−pin, a contact on surface 30*b* corresponding to contact 40*c* may be a Data+pin and a contact on surface 30*b* corresponding to contact 40*d* may be a ground pin. In this manner, regardless of the orientation of plug connector 10, the same pinout may be mated with a corresponding receptacle connector during a mating event.

In some embodiments, a sensing circuit in the connector 10 can detect which of surfaces 30*a* and 30*b* of tongue 30 will mate with the contacts of the corresponding receptacle connector and switch internal connections to the contacts in connector 10 as appropriate. For example, a software switch can be used to switch the contacts of connector 10 for the pair of differential data signals depending on the insertion orientation while a hardware switch can be used to switch the ground and power contacts. In other embodiments, both switches can be implemented in software or both switches can be implemented in hardware. In another example, the orientation of the connector can instead be detected by circuitry of connector 10 based on signals received over the contacts. As one example, upon inserting connector 10 within a receptacle connector of a host device, connector 10 may send an Acknowledgment signal to the serial control chip over one of the contacts of connector 10 designated for the specific contact and waits for a Response signal from the host device. If a Response signal is received, the contacts are aligned properly and data and power can be transferred between the connectors. If no response is received, connector 10 flips the signals to correspond to the second possible orientation (i.e., flips the signals 180 degrees) and repeats the Acknowledgement/Response signal routine. As another example, the host device may send the Acknowledgement signal and connector 10 may send the Response signal.

It may be desirable to provide an effective manufacturing process for plug connectors discussed above as well variations thereof. Accordingly, embodiments of the present invention provide for methods of manufacture of reversible or dual orientation USB plug connectors. For example, inserting molding, assembling, and other methods may be used to manufacture plug connectors according to the present invention. Examples of these methods are illustrated in the following figures.

Figure 2A:
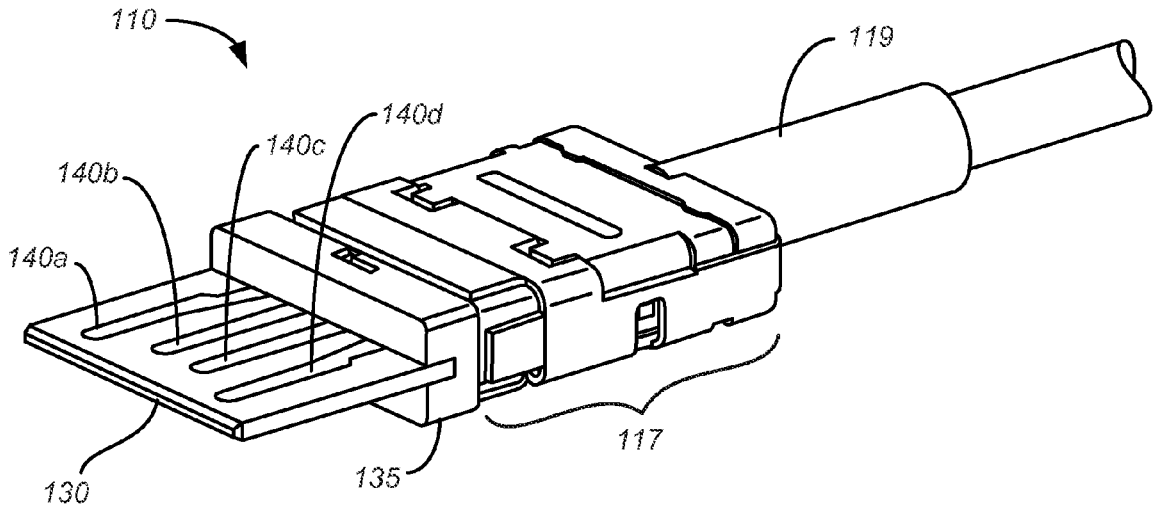
FIGS. 2A and 2B are simplified perspective and cross sectional views, respectively, of a USB plug connector in various stages of manufacture according to one embodiment of the present invention.
Figure 2B:
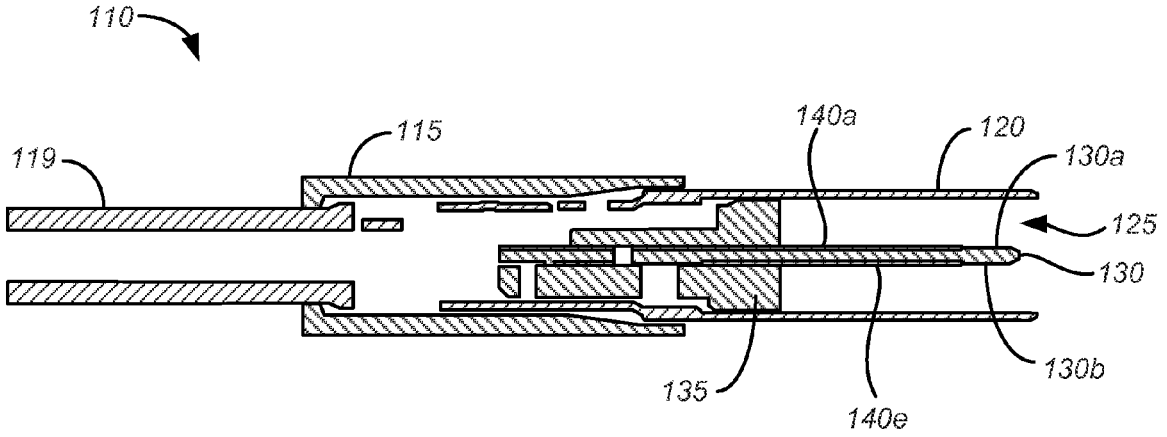

FIGS. 2A and 2B are simplified perspective and cross sectional views, respectively, of a USB plug connector 110 in various stages of manufacture according to one embodiment of the present invention. Plug connector 110 includes a base 115 (only shown in FIG. 2B) that may be attached over metallic shield 117 and cable 119. A shell 120 (only shown in FIG. 2B) may be assembled with base 115 and extend longitudinally away from body 15 in a direction parallel to the length of connector 110. Shell 120 includes an opening 125 that communicates with a cavity defined in part by tongue 130 and support structure 135 from which tongue 130 extends. As shown in FIGS. 2A and 2B, tongue 130 may be assembled with support structure 135 within shell 120 such that tongue 130 extends parallel to the length of connector 110. Contacts 140*a*-140*d* may be soldered on a first major surface 130*a* and four additional contacts (only contact 140*e* is shown in FIG. 2B) may be soldered on a second major surface 130*b*. Support structure 135 may also be overmolded in position to support and possibly provide increased deflection flexibility to tongue 130. In this embodiment, tongue 130 may be a PCB that deflects when connector 110 is mated with a corresponding plug connector.

In some embodiments, tongue 130 may be overmolded with a resilient polymer, e.g., LCP or POM, before or after it is assembled with support structure 135. In this embodiment, the contacts of plug connector 110 may be copper contacts that are thick enough to remain flush with the exterior surface of tongue 130 after tongue 130 has been overmolded with a resilient polymer.

The methods and structure described above in relation to FIGS. 2A and 2B may be varied in other embodiments. Examples of these variations are included in the following figures.

Figure 3A:
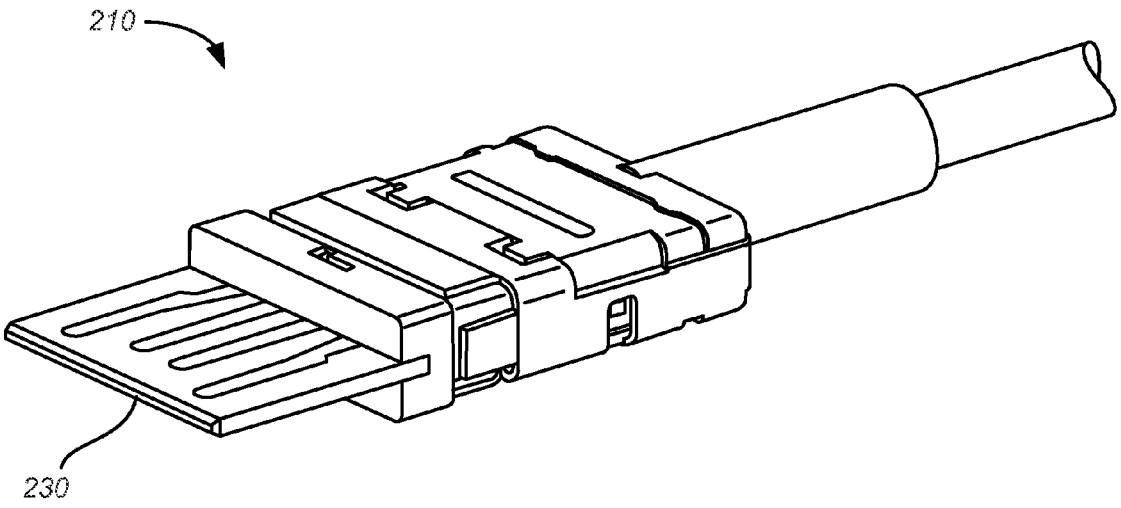
FIGS. 3A and 3B are simplified perspective and cross sectional views, respectively, of a USB plug connector in various stages of manufacture according to another embodiment of the present invention.
Figure 3B:
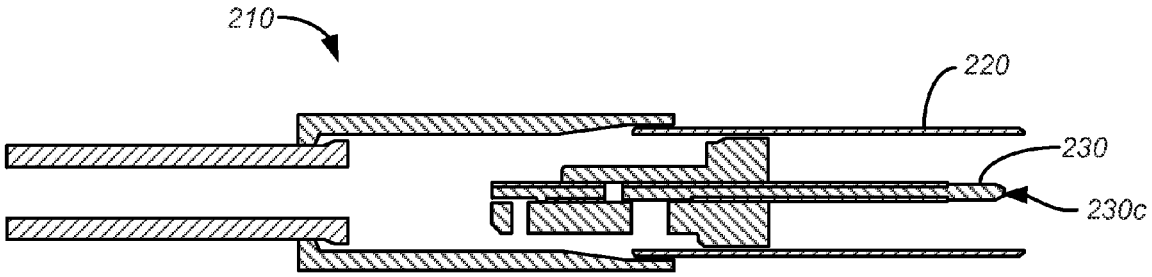

FIGS. 3A and 3B are simplified perspective and cross sectional views, respectively, of a USB plug connector 210 in various stages of manufacture according to another embodiment of the present invention. USB connector 210 is similar to USB connector 110 described above, except that an additional step of routing has been performed on tip 230*c* of tongue 230 such that tip 230 is bullnose shaped for reasons already discussed above.

Figure 4A:
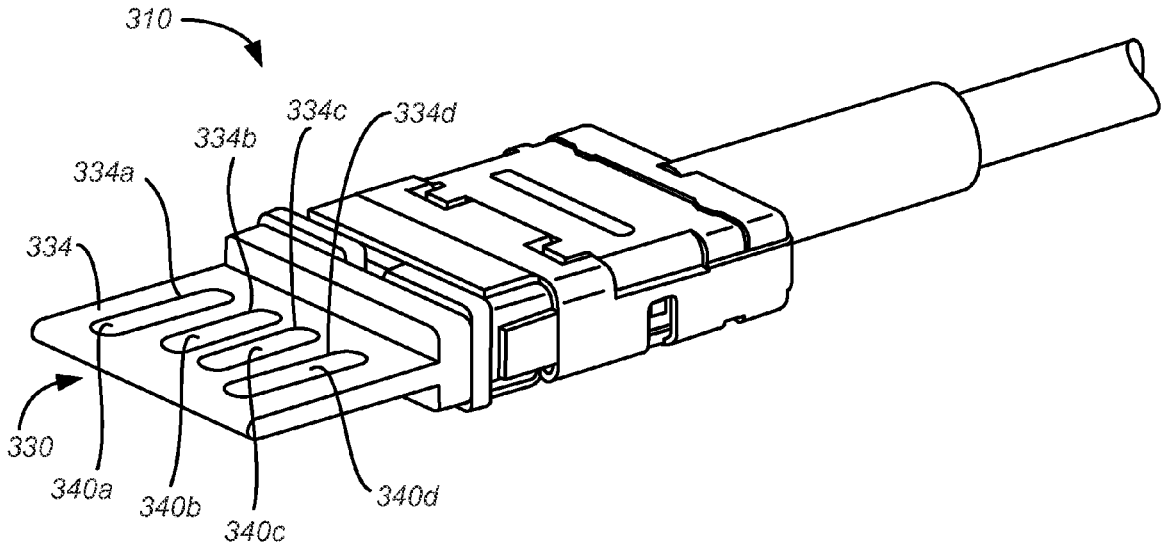
FIGS. 4A and 4B are simplified perspective and cross sectional views, respectively, of a USB plug connector in various stages of manufacture according to yet another embodiment of the present invention.
Figure 4B:
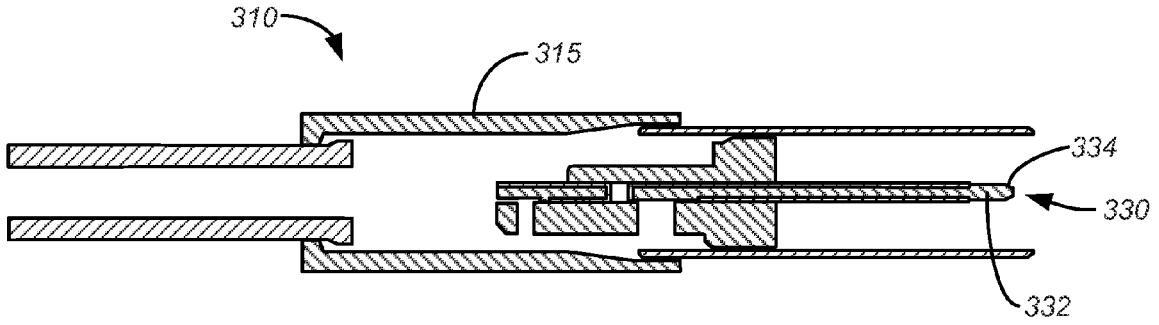

FIGS. 4A and 4B are simplified perspective and cross sectional views, respectively, of a USB plug connector 310 in various stages of manufacture according to yet another embodiment of the present invention. Connector 310 is similar to embodiments discussed above, e.g., plug connectors 110 and 210. However, although tongue 330 includes a PCB 332 like the other embodiments described above, tongue 330 also includes a sleeve 334 that may be assembled over PCB 332. As show in FIG. 4A, sleeve 334 may include openings 334*a*-334*d* and additional openings not shown such that all contacts of connector 310 (e.g., contacts 340*a*-340*d*) remain exposed and accessible by contacts of a corresponding USB receptacle connector.

Figure 5A:
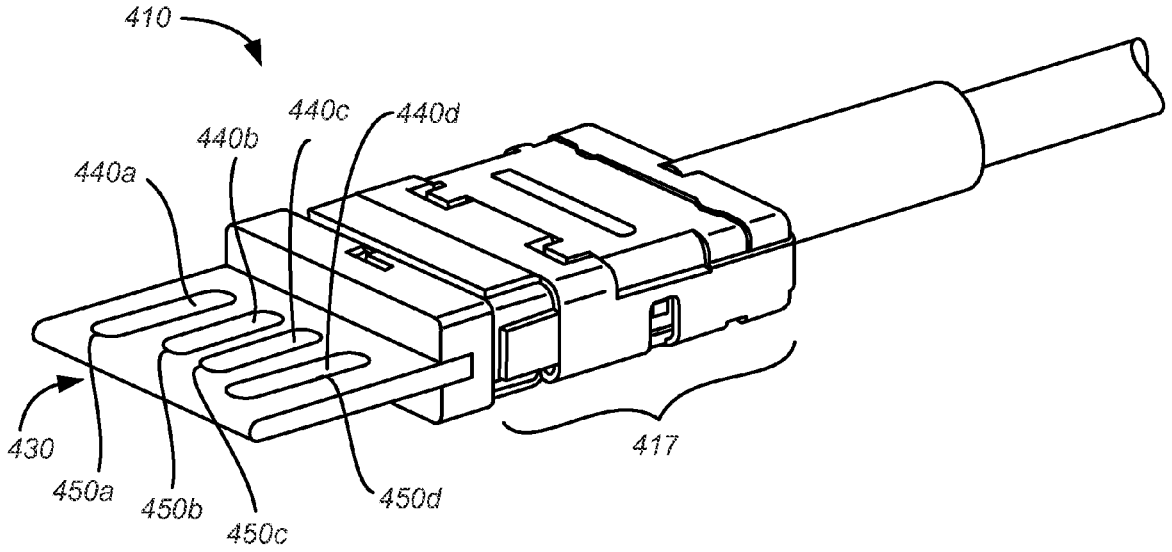
FIGS. 5A and 5B are simplified perspective and cross sectional views, respectively, of a USB plug connector in various stages of manufacture according to still another embodiment of the present invention.
Figure 5B:
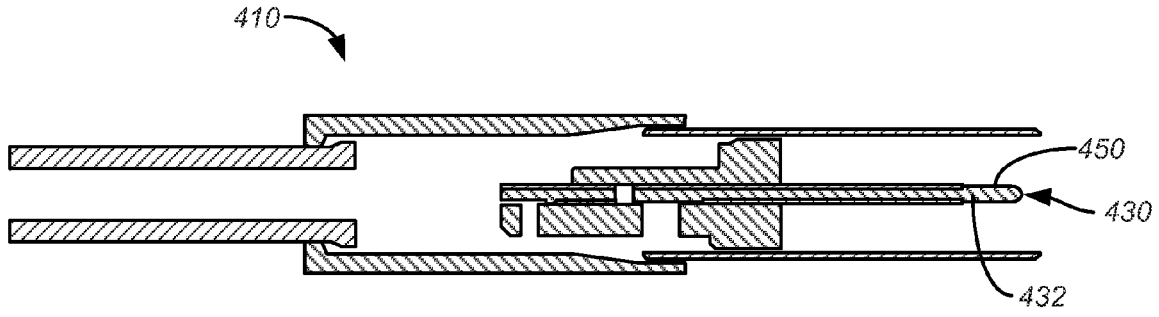

FIGS. 5A and 5B are simplified perspective and cross sectional views, respectively, of a USB plug connector 410 in various stages of manufacture according to still another embodiment of the present invention. Connector 410 is also similar to embodiments discussed above, e.g., plug connectors 110 and 210. However, although tongue 430 includes a PCB 432 like the other embodiments described above, tongue 430 also includes a sticker or label 450 that is adhered to PCB 432. As shown in FIG. 5A, label 450 may include openings 450*a*-450*d* and additional openings not shown such that all contacts of connector 410 (e.g., contacts 440*a*-440*d*) remain exposed and accessible by contacts of a corresponding USB receptacle connector. Label 450 may provide cosmetic benefits in addition to insulating the contacts of plug connector 410.

Figure 6A:
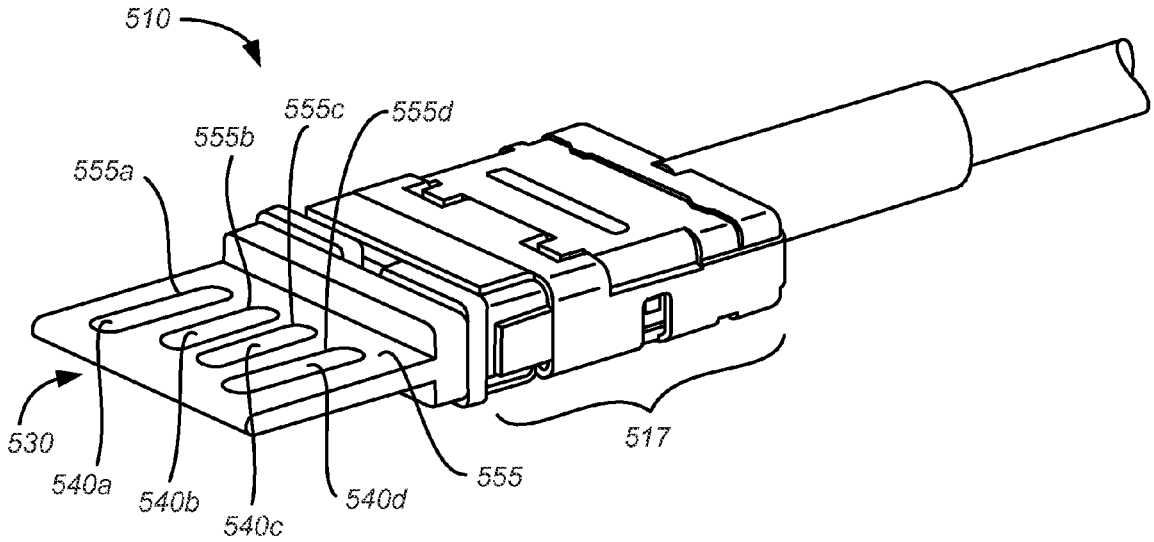
FIGS. 6A and 6B are simplified perspective and cross sectional views, respectively, of a USB plug connector in various stages of manufacture according to still another embodiment of the present invention.
Figure 6B:
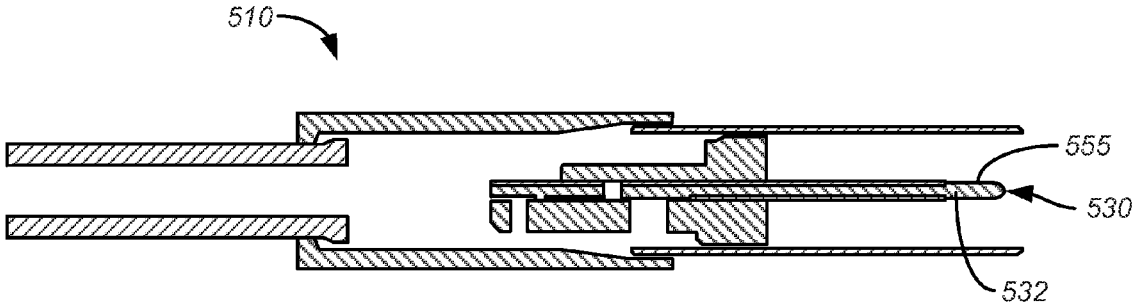

FIGS. 6A and 6B are simplified perspective and cross sectional views, respectively, of a USB plug connector 510 in various stages of manufacture according to still another embodiment of the present invention. Connector 510 is also similar to embodiments discussed above, e.g., plug connectors 110 and 210. However, although tongue 530 may include a PCB 532 like the other embodiments described above, PCB 532 may be inserted molded to form an overmold 555 surrounding PCB 532. As shown in FIG. 6A, overmold 555 may include openings 555*a*-555*d* and additional openings (not shown) corresponding to all the contacts of connector 510 (e.g., contacts 540*a*-540*d* as well as the contacts not shown in FIG. 6A). Accordingly, the contacts of connector 510 may remain exposed and accessible by contacts of a corresponding USB receptacle connector. Overmold 555 may provide a cosmetic benefit to tongue 530.

An example of an embodiment that may be similar to plug connector 510 is shown in the following figures.

Figure 16A:
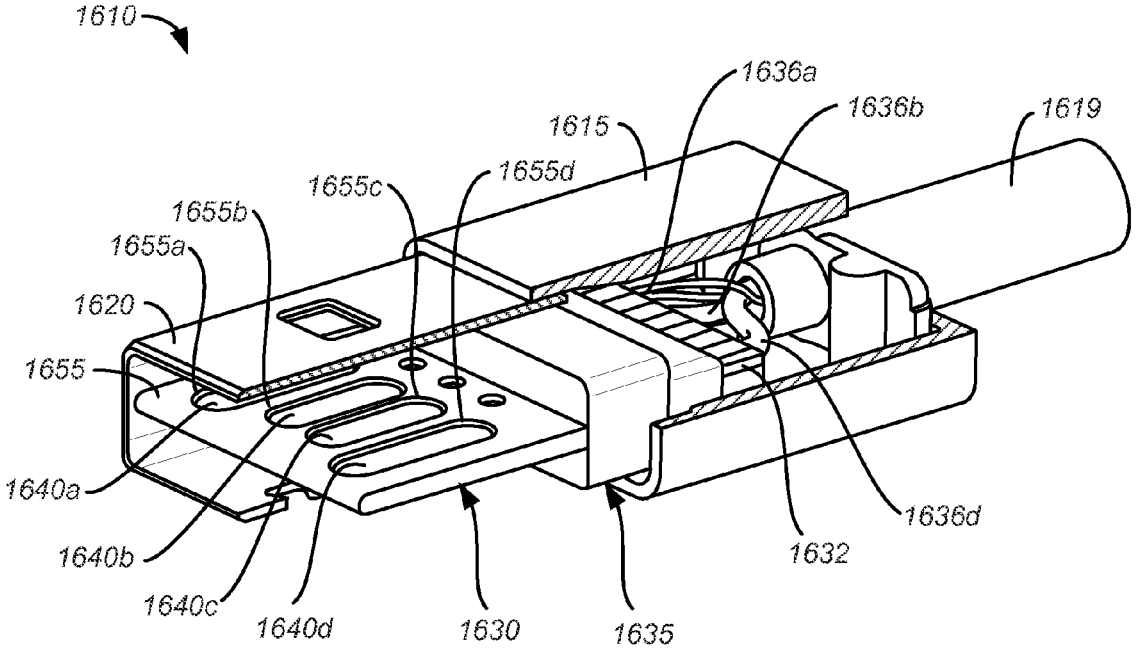
FIGS. 16A and 16B are partial cross sectional perspective and cross sectional side views, respectively, of a USB plug connector according to one embodiment of the present invention.
Figure 16B:
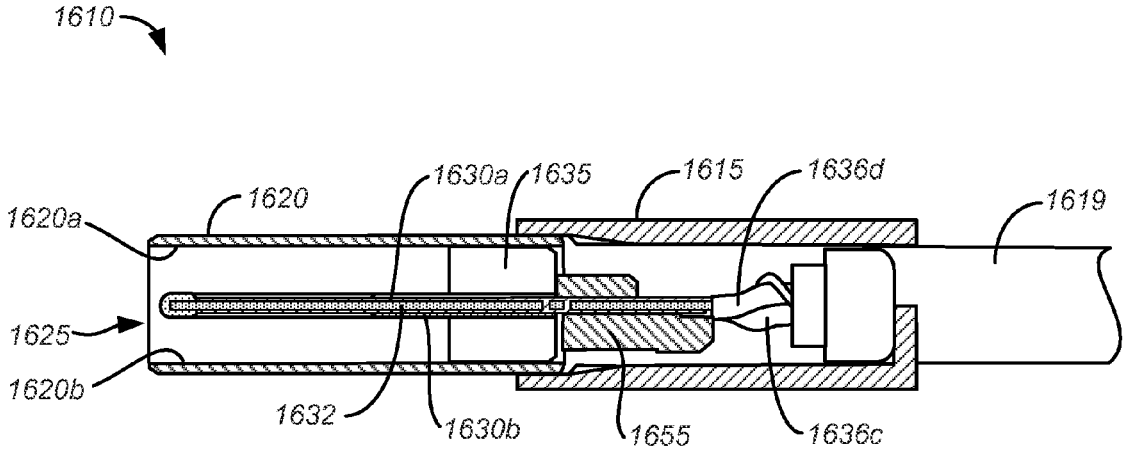

FIGS. 16A and 16B are partial cross sectional perspective and cross sectional side views, respectively, of a USB plug connector 1610 according to one embodiment of the present invention. Again, connector 1610 may be similar to embodiments discussed above, e.g., plug connector 510. However, further details are shown and discussed in relation to plug connector 1610. FIGS. 16A and 16B show that connector 1610 may include a body 1615 and a shell 1620 extending longitudinally away from body 1615 in a direction parallel to the length of connector 1610. Shell 1620 includes an opening 1625 that communicates with a cavity defined by inner surfaces, e.g., first and second inner surfaces 1620*a*, 1620*b* of shell 1620, a tongue 1630, and surfaces of support structure 1635.

As shown in FIGS. 16A and 16B, tongue 1630 may be centrally located between first and second inner surfaces 1620*a*, 1620*b* and extend in a direction parallel to length of connector 1610. Contacts 1640*a*-1640*d* are disposed on a first major surface 1630*a* and four additional contacts (not shown) are disposed on second major surface 1630*b*. Tongue 1630 may include a PCB 1632 that is inserted molded to form an overmold 1655 surrounding PCB 1632. As shown in FIG. 16A, overmold 1655 may include openings 1655*a*-1655*d* as well as additional openings (not shown) such that overmold 1655 includes openings corresponding to all the contacts of connector 1610 (e.g., contacts 1640*a*-1640*d* as well as the four additional contacts not shown). Accordingly, the contacts of connector 1610 may remain exposed and accessible by contacts of a corresponding USB receptacle connector.

In addition to the cosmetic benefits of overmolds discussed herein concerning other embodiments of the present invention, overmolds, e.g., overmolds 1655, may also provide rigidity and wear resistance to a PCB, e.g., PCB 1632. For example, overmold 1655 encloses PCB 1632 and may protect it from wear that occurs during insertion/extraction events, misuse and/or other events where tongue 1630 comes into contact with objects. Thus, overmold 1655 may help to extend the lifetime of connector 1610 as the dielectric materials typically used to make a PCB are not chosen based on their strong wear resistance characteristics. A PCB does not typically have strong rigidity characteristics either. Overmold 1655 may also increase the rigidity of PCB 1632 and tongue 1630 by providing an extra layer of material around tongue 1630.

As mentioned previously, some plug connectors of the present invention may include structural support elements made from materials chosen to allow plug connector tongues to deflect. Connector 1610 may also include a structural support element, e.g., a structural support 1635. Structural support 1635 may provide flexure to PCB 1632 to reduce stress and fatigue on PCB 1632 and allow tongue 1630, along with PCB 1632, to deflect toward and away from first or second inner surfaces 1620*a*, 1620*b* during insertion/extraction events. In order to provide this flexure, structural support 1635 may be made from an elastomer that deforms in response to stress, e.g., a mating event, but holds tongue 1630 centrally located between first and second inner surfaces 1620*a*, 1620*b* otherwise.

FIGS. 16A and 16B also illustrate individual wires, wires 1636*a*-1636*d*, that extend from the interior of cable 1619. Wires 1636*a*-1636*d* may directly terminate on PCB 1632, e.g., wires 1636*a*-1636*d* may be soldered to PCB 1632. Cable 1619 may include insulated wires corresponding to each unique contact of plug connector 1610 and may be connected to the contacts of plug connector 1610 via PCB 1632. For example, wire 1636*d* may be a grounding wire, wire 1636*c* may be a Data+wire, wire 1636*b* may be a Data−wire, and wires 1636*a* may be power wires.

Embodiments of the present invention also provide for effective methods of manufacturing plug connector 1610. Examples of these methods are illustrated in the following figures.

Figure 16C:
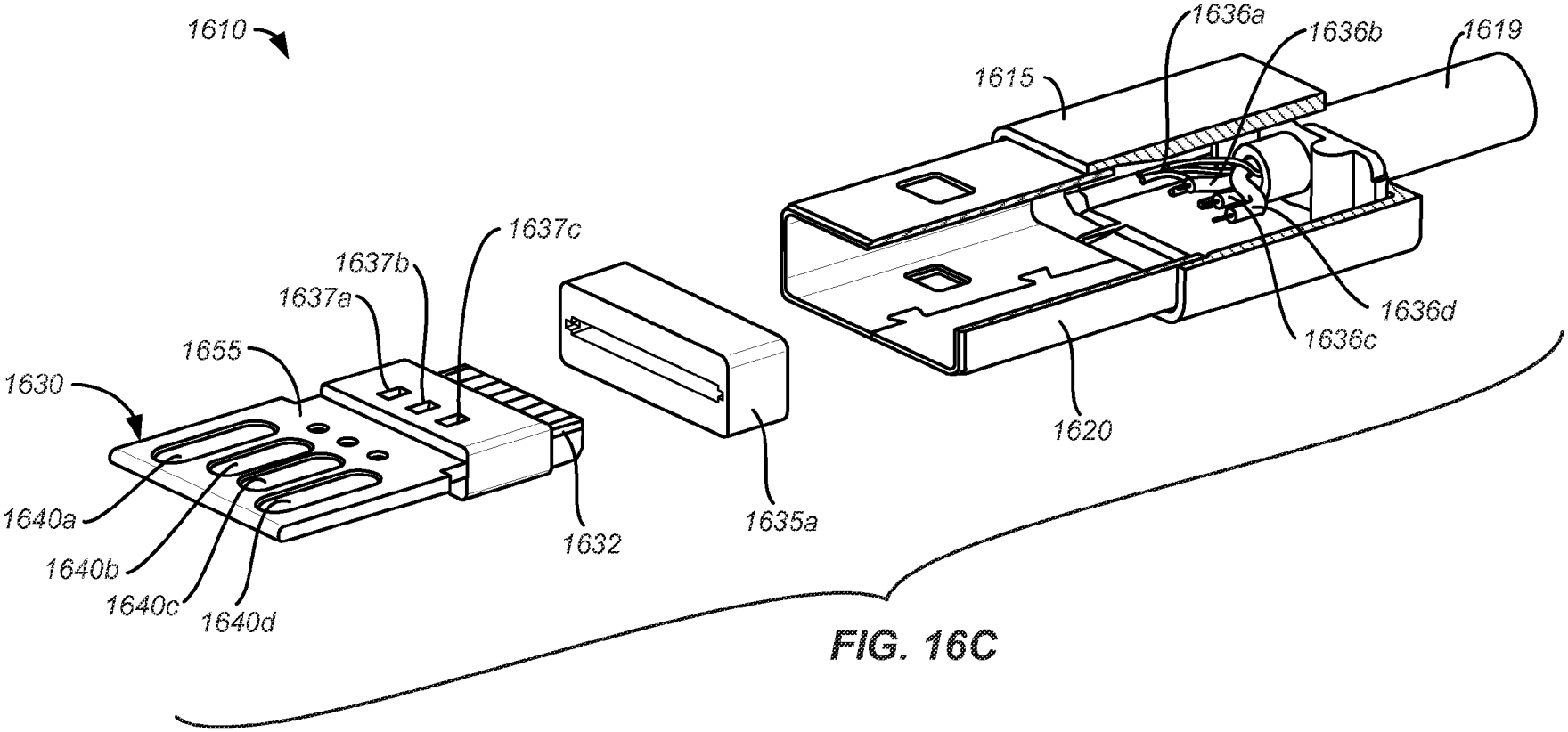
FIGS. 16C and 16D are partial cross sectional, exploded perspective views of embodiments of structural support for assembling with and overmolding on tongue of plug connector, respectively, according to manufacturing methods of the present invention.
Figure 16D:
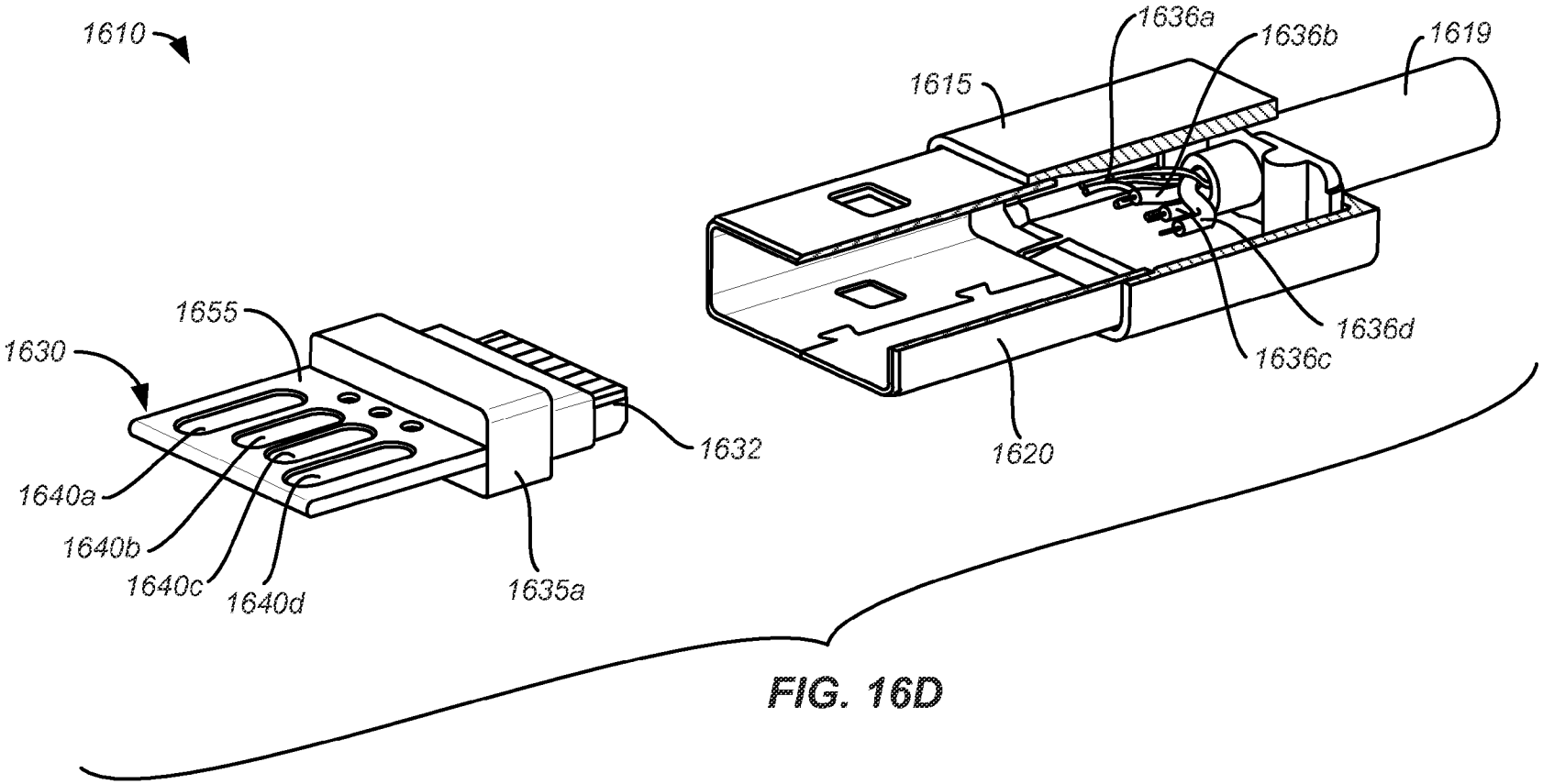

FIGS. 16C and 16D are partial cross sectional, exploded perspective views of embodiments of structural support 1635 for assembling with and overmolding on tongue 1630 of plug connector 1610, respectively, according to manufacturing methods of the present invention. As shown in FIG. 16C, tongue 1630 may include one or more interlock recesses, e.g., interlock recesses 1637*a*-1637*c*. And although not shown in FIG. 16C, support structure 1635*a* may include protruding interlock features corresponding to interlock recesses 1637*a*-1637*c*. These interlock features—protrusions and corresponding recesses 1637*a*-1637*c*—may be configured to align and/or interlock tongue 1630 and support structure 1635*a* when assembled together. A clearance fit, an interference fit or a snap-fit may hold tongue 1630 and support structure 1635*a* in their assembled positions. Other embodiments may use different interlock features, e.g., pins and holes, latch features or adhesives.

In another embodiment, a support structure may be overmolded over a portion of tongue 1630. For example, tongue 1630 may be overmolded with a resilient polymer, e.g., LCP or POM, to form a support structure 1635*b*, as shown in FIG. 16D. In order to increase the bonding strength between tongue 1630 and support structure 1635*b*, the same materials, compatible materials (i.e., materials of similar chemistry) or blends of compatible materials may be used to form both tongue 1630 and support structure 1635*b* such that a chemical bond may be created between the elements. Interlock features may also be used to strengthen the bond between tongue 1630 and support structure 1635*b*. For example, during the overmolding of support structure 1635*b*, molten plastic may flow into recesses 1637*a*-1637*c* and serve as an interlock between support structure 1635*b* and tongue 1630.

In other embodiments, a support structure may also be integrally formed with tongue 1630, similar to embodiments of plug connectors shown in other FIGS. of the present application.

The structures and methods shown in FIGS. 16A-16D and discussed in relation thereto may also be implemented in various ways in other embodiments of the present invention.

As mentioned above, the methods and structures described above in relation to FIGS. 2A and 2B may be varied in other embodiments. Additional examples of these variations are included in the following figures.

Figure 7A:
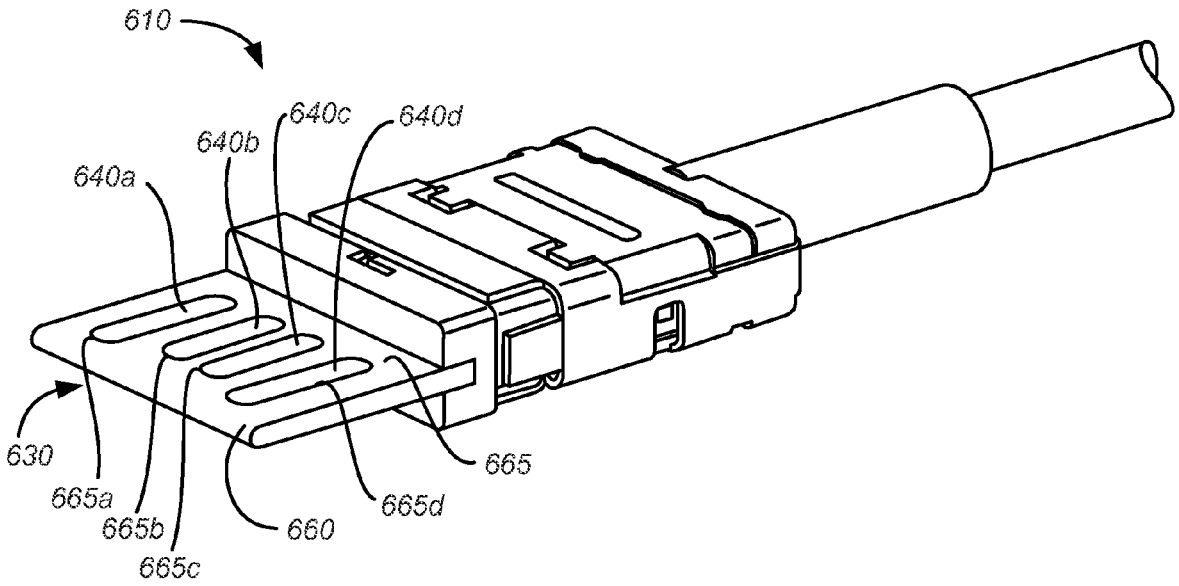
FIGS. 7A and 7B are simplified perspective and cross sectional views, respectively, of a USB plug connector in various stages of manufacture according to still another embodiment of the present invention.
Figure 7B:
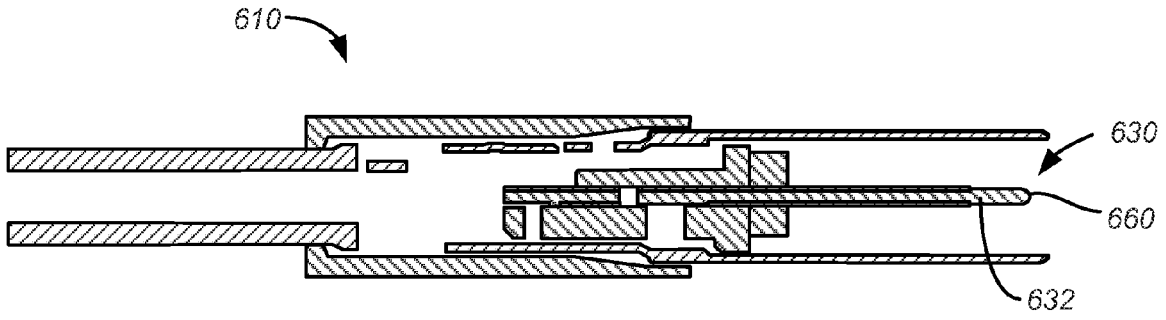

FIGS. 7A and 7B are simplified perspective and cross sectional views, respectively, of a USB plug connector 610 in various stages of manufacture according to still another embodiment of the present invention. Connector 610 is also similar to embodiments discussed above, e.g., plug connectors 110 and 210. However, although tongue 630 may include a PCB 632 like the other embodiments described above, tongue 630 also includes a frame 660 that may be assembled over PCB 632. In addition, a sticker or label 665 may be adhered to frame 660. As shown in FIG. 5A, label 665 may include openings 665*a*-665*d* and additional openings corresponding to all the contacts of connector 610 (e.g., contacts 640*a*-640*d* as well as the contacts not shown in FIG. 6A). Accordingly, the contacts of connector 610 may remain exposed and accessible by contacts of a corresponding USB receptacle connector. Label 665 may provide cosmetic benefits in addition to insulating the contacts of plug connector 510. Frame 660 may also include openings (not shown) corresponding to the openings of label 665.

Figure 8A:
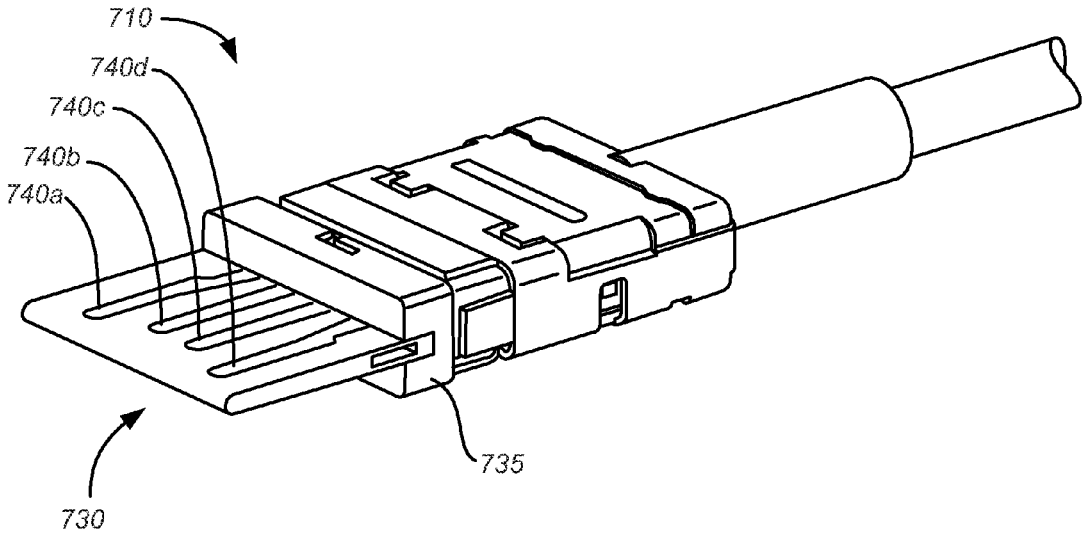
FIGS. 8A and 8B are simplified perspective and cross sectional views, respectively, of a USB plug connector in various stages of manufacture according to still another embodiment of the present invention.
Figure 8B:
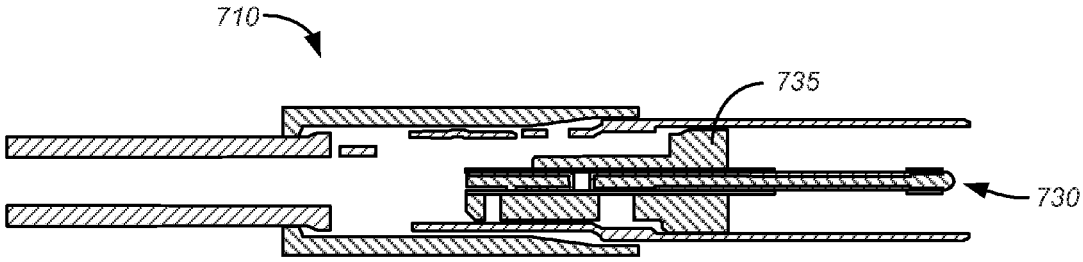

FIGS. 8A and 8B are simplified perspective and cross sectional views, respectively, of a USB plug connector 710 in various stages of manufacture according to still another embodiment of the present invention. Connector 710 is also similar to embodiments discussed above, e.g., plug connectors 110 and 210. However, in contrast with the connector discussed above, connector 710 does not include a PCB. Instead, tongue 730 can be produced via a single shot molding process. For example, contacts of connector 710 (e.g., 740*a*-740*d*) may be inserted molded to form a tongue 730 having exposed contacts as shown in FIG. 8A. Tongue 730 may then be assembled with structural support 735, or structural support 735 may be overmolded around a portion of tongue 730.

Figure 9A:
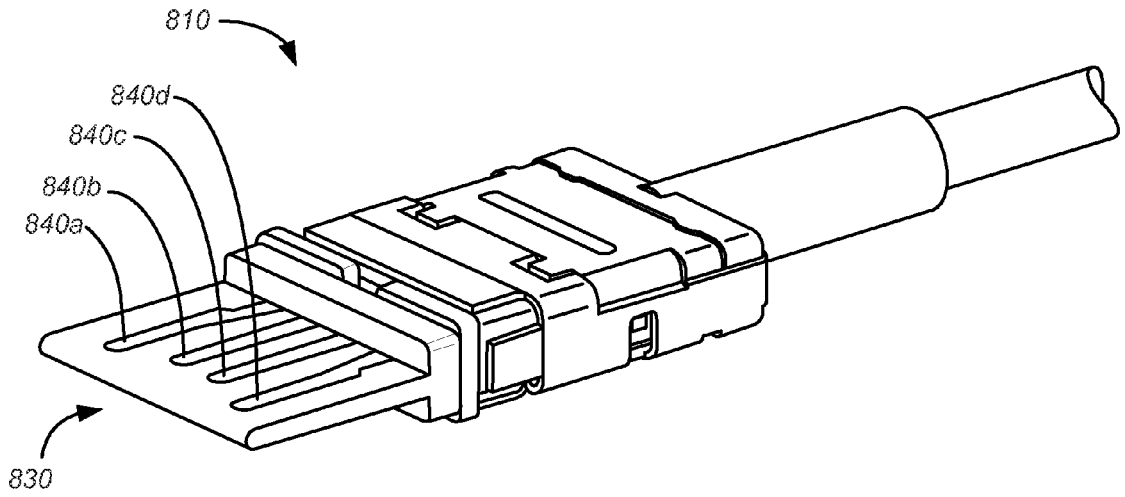
FIGS. 9A and 9B are simplified perspective and cross sectional views, respectively, of a USB plug connector in various stages of manufacture according to still another embodiment of the present invention.
Figure 9B:
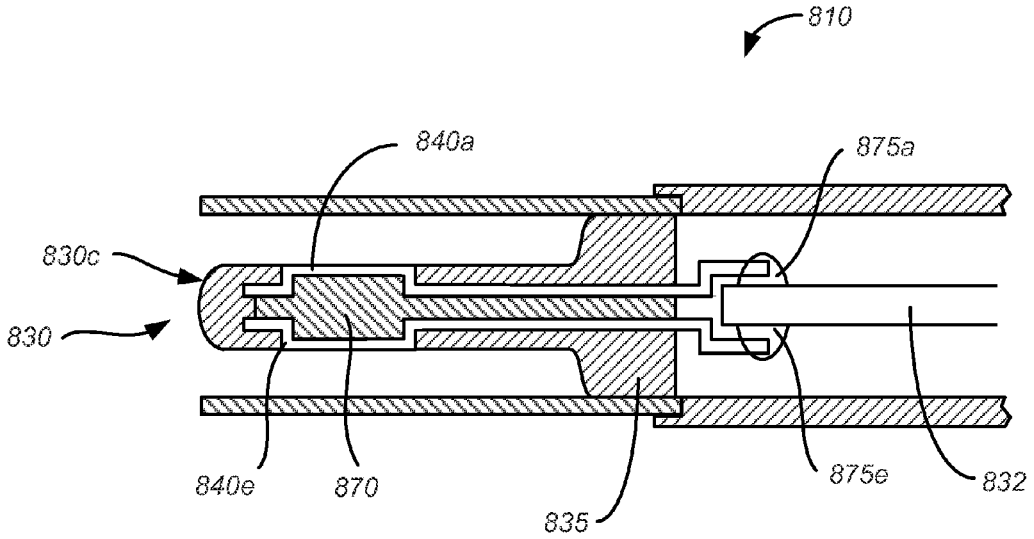

FIGS. 9A and 9B are simplified perspective and cross sectional views, respectively, of a USB plug connector 810 in various stages of manufacture according to still another embodiment of the present invention. Connector 810 is similar to embodiments discussed above, particularly connector 710. Connector 810 does not include a PCB but rather a tongue 830 can be formed via a two shot molding process, as opposed to the one shot molding process of connector 710. The first insert mold shot may be used to form a first portion 870 using a suitable dielectric material, e.g., LCP. As shown in FIG. 9B, first portion 870 may be located between the opposing sets of contacts of connector 810. The second insert mold shot may be used to form a second portion 875 using another dielectric material, e.g., LCP, POM or Nylon. Second portion 875 also forms a tip 830*c* of tongue 830. Subsequently, an overmolding process may use nylon or another suitable dielectric to form the remaining portion of tongue 830 as well as structural support 835. In this embodiment, the contacts of plug connector 810, e.g., contacts 840*a* and 840*e*, are soldered to PCB 832. Contacts of plug connector 810 may be shorted through PCB 832 or otherwise routed to insulated wires of cable connected to connector 810.

Figure 10A:
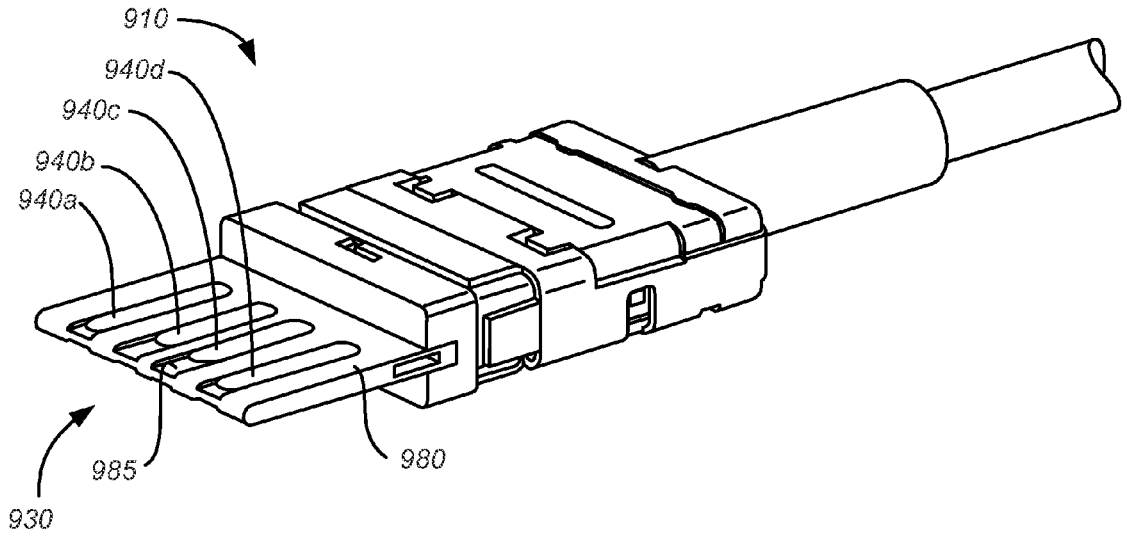
FIGS. 10A and 10B are simplified perspective and cross sectional views, respectively, of a USB plug connector in various stages of manufacture according to still another embodiment of the present invention.
Figure 10B:
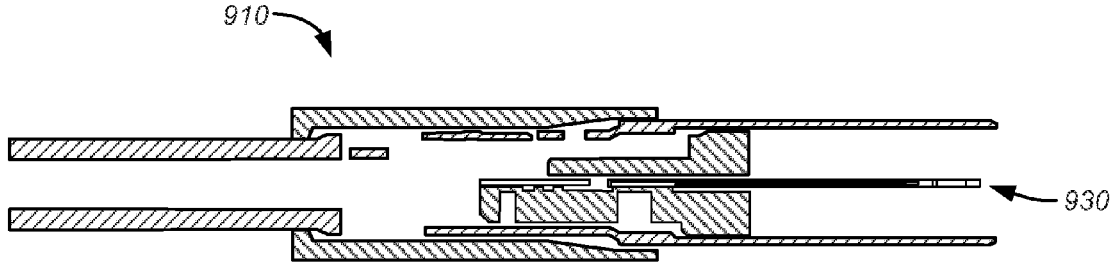

FIGS. 10A and 10B are simplified perspective and cross sectional views, respectively, of a USB plug connector 910 in various stages of manufacture according to still another embodiment of the present invention. Connector 910 is similar to embodiments discussed above, particularly connector 810. Connector 910 includes a frame 980 that includes a clamshell style opening. A flex circuit 985 may be assembled in the clamshell opening of frame 980 in order to form a tongue 930 that includes contacts (e.g., contacts 940*a*-940*d*).

The methods of manufacturing discussed above may also be suitable in whole or in part for additional embodiments of plug connectors of the present invention. Examples of these additional embodiments of plug connectors of the present invention are illustrated in the following figures.

Figure 11A:
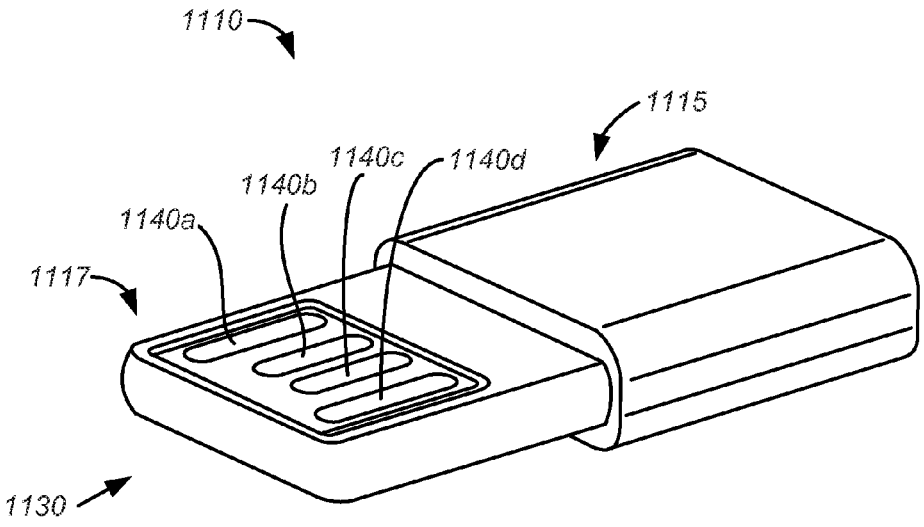
FIGS. 11A and 11B are simplified perspective and cross sectional views, respectively, of a USB plug connector according to one embodiment of the present invention.
Figure 11B:
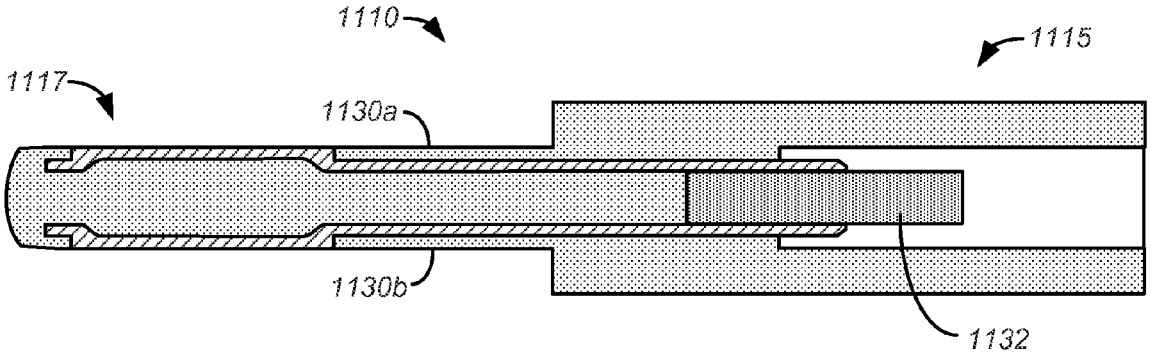

FIGS. 11A and 11B are simplified perspective and cross sectional views, respectively, of a USB plug connector 1100 according to one embodiment of the present invention. Plug connector 1110 includes a body 1115 and a tab 1117 extending longitudinally away from body 1115 in a direction parallel to the length of connector 1110. In contrast with connector 10 and similar variations, connector 1110 does not include a shell. Contacts 1140*a*-1140*d* are disposed on a first major surface 1130*a* and four additional contacts (only contact 1140*e* is shown in FIG. 11B) are disposed on a second major surface 1130*b*. As also shown in FIGS. 11A and 11B, tab 1117 may include a bullnose tip 1130*c* for at least the same reasons discussed above.

Connector 1100 can have a 180 degree symmetrical, double orientation design which enables the connector to be inserted into a corresponding receptacle connector in both a first orientation where surface 1130*a* is facing up and a second orientation where surface 1130*a* is rotated 180 degrees and facing down. Specifics of general double or dual orientation designs are discussed in greater detail above. Simply stated, the dual orientation design of connector 1100 allows contacts disposed on first surface 1130*a* (contacts 1140*a*-1140*d*) to mate with contacts of the corresponding receptacle connector in one orientation and contacts disposed on second surface 1130*b* to mate with contacts of the corresponding receptacle connector in the other orientation. Despite connector 1110 being a dual orientation connector, this embodiment of the present invention may only be received by receptacle connectors specially designed for receiving connector 1100.

Tab 1130 may be made from one or more of a variety of dielectric materials including wear resistant materials such as LCP, POM, Nylon and others. In contrast with connector 10, connector 1110 may not be designed to deflect upon insertion into a corresponding receptacle connector. Instead, connector 1100 may remain rigid during insertion and extraction events. Materials used for making tab 1130 may be chosen accordingly.

Body 1115 is generally the portion of connector 1110 that a user will hold onto when inserting or removing connector 1110 from a corresponding receptacle connector. Body 1115 can be made out of a variety of materials and in some embodiments is made from a dielectric material, such as a thermoplastic polymer formed in an injection molding process. Also, electrical contact to the contacts of surfaces 1130*a*, 1130*b* can be made with individual wires in a cable within body 1115. In one embodiment, a cable includes a plurality of individual insulated wires for connecting to contacts of surfaces 1130*a*, 1130*b* that are soldered to bonding pads on a PCB housed within body 1115. The bonding pads on the PCB may be electrically coupled to corresponding individual contacts of surfaces 1130*a* and 1130*b*. In some embodiments, contacts of one of surfaces 1130*a* and 1130*b* to be shorted through tab 1130 or a PCB to corresponding contacts on the other of surfaces 1130*a* and 1130*b* and then appropriately routed to the individual wires of a cable within body 1115.

The contacts of tab 1130 can be made from copper, nickel, brass, a metal alloy or any other appropriate conductive material. Plug connector 1110 may include standard USB contacts for power, ground and a pair of differential data signals (e.g., data transmit). For example, contact 1140*a* may be a ground pin, contact 1140*b* may be a Data+pin, contact 1140*c* may be a Data−pin, and contact 1140*d* may be a power pin (VBUS). As mentioned earlier, the four additional contacts disposed on second major surface 1130*b* can be positioned so that the contacts on first and second major surfaces 1130*a*, 1130*b* are arranged in a symmetric manner and have the same pinout. In this manner, either of two intuitive orientations may be used to mate the contacts of plug connector 1110 with contacts of a corresponding receptacle connector during a mating event.

A sensing circuit as described above may be included with connector 1110 and/or a corresponding receptacle connector.

An example of a particular embodiment of plug connector 1110 is shown in the following figures.

Figure 15A:
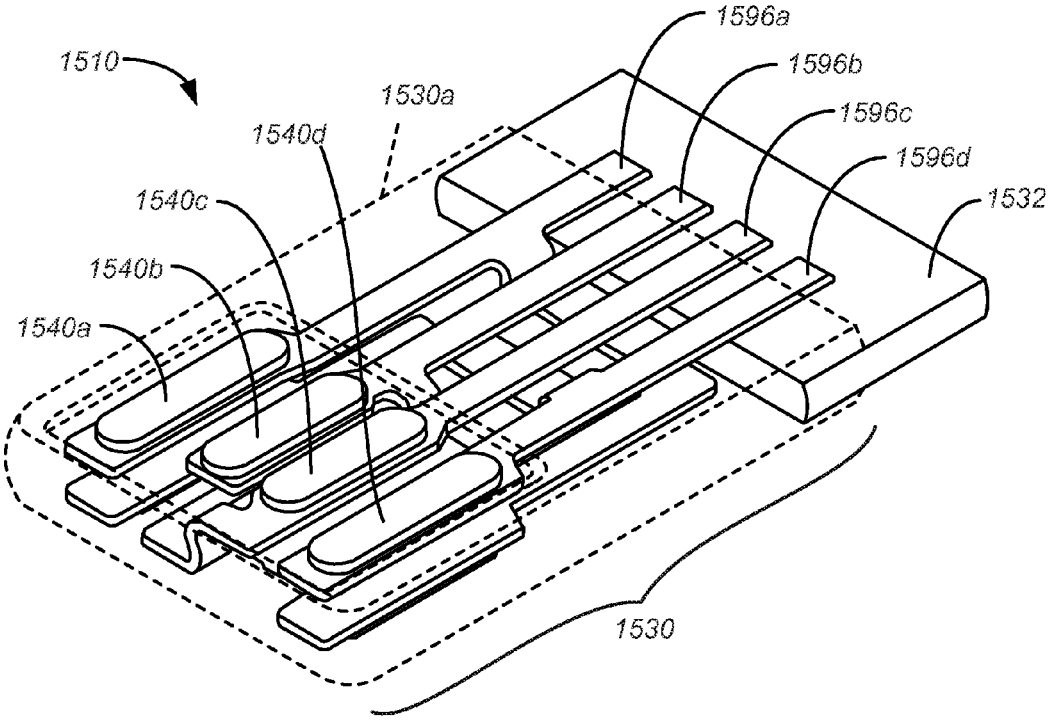
FIGS. 15A and 15B are partially transparent simplified perspective and partially transparent front views, respectively, of a USB plug connector according to one particular embodiment of the connector of FIGS. 11A-11B.
Figure 15B:
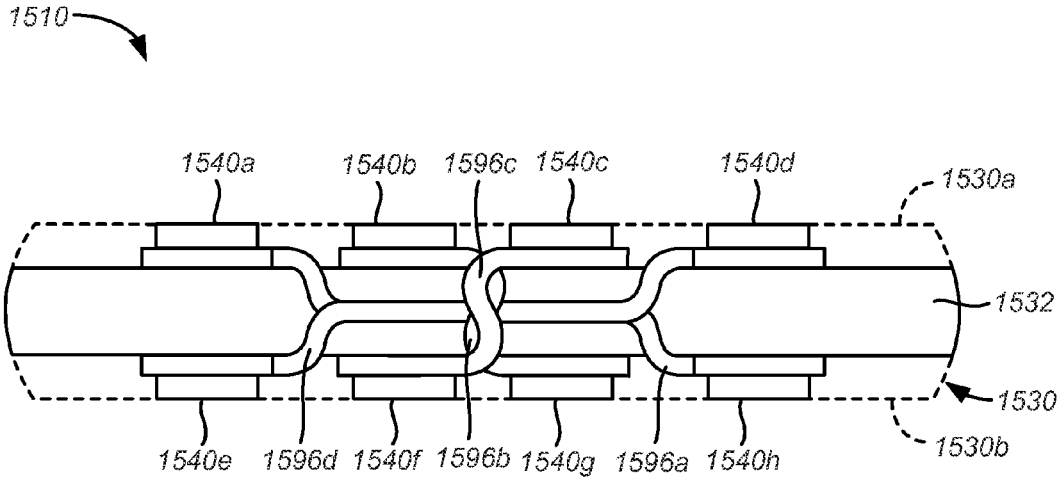
Figure 15C:
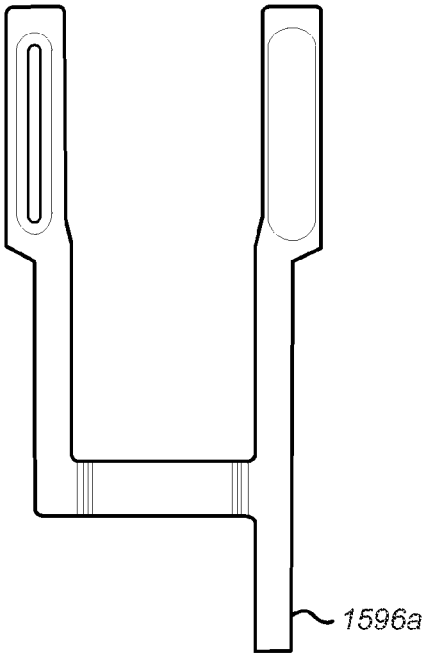
FIGS. 15C-15F are top views of contact frames, in their positions with respect to each other when embedded in a tab.
Figure 15D:
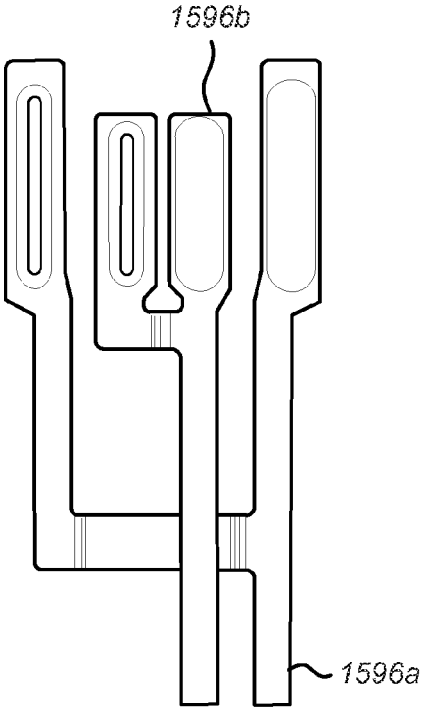
Figure 15E:
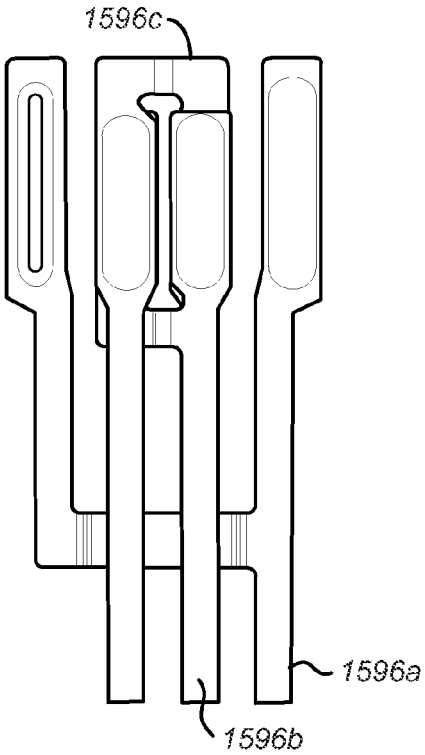
Figure 15F:
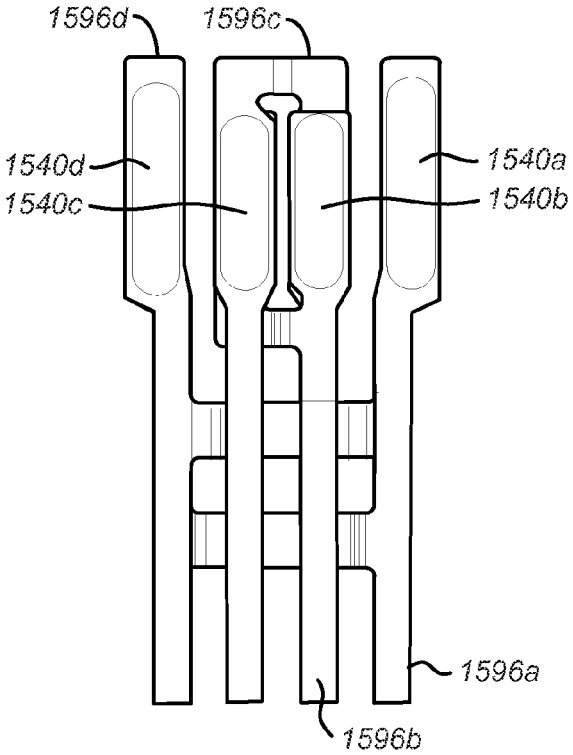

FIGS. 15A and 15B are partially transparent simplified perspective and partially transparent front views, respectively, of a USB plug connector 1510 according to one particular embodiment of connector 1110. Connector 1510 may provide the same pinout on both first and second major surfaces 1530*a*, 1530*b* of a tab 1530 using crossover contact frames 1596*a*-1596*d* that each include a contact for each of the major surfaces of tab 1530. For example, as shown in FIGS. 15A and 15B, tab 1530 extends in a longitudinal direction and includes contacts 1540*a*-1540*d* disposed on first major surface 1530*a* and contacts 1540*e*-1540*g* disposed on second major surface 1530*b*. Contacts 1540*a*-1540*g* may be exposed portions of contact frames 1596*a*-1596*d*. Crossover contact frames 1596*a*-1596*d* may serve to connect contacts 1540*a*-1540*d* to contacts 1540*h*-1540*e*, respectively, and contacts 1540*a*-1540*h* to PCB 1532, which may be assembled with tab 1530. The configuration of crossover contact frames 1596*a*-1596*d* is further illustrated in the following figures.

FIGS. 15C-15F are top views of contact frames 1596*a*; 1596*a* and 1596*b*; 1596*a*, 1596*b* and 1596*c*; and 1596*a*, 1596*b*, 1596*c* and 1596*d*; respectively, in their positions with respect to each other when embedded in tab 1530. As shown in FIG. 15C-F as well as FIGS. 15A and 15B, a crossover region exists between contacts 1540*a*-1540*d* and contacts 1540*e*-1540*h* where portions of contact frames 1596*a*-1596*d* overlap and cross. The overlapping and crossing of portions of contact frames 1596*a*-1596*d* in the crossover region may provide shielding to minimize electromagnetic interference (EMI) from degrading signals transferred through contacts 1540*a*-1540*h*.

As with connector 1100, connector 1510 can have a 180 degree symmetrical, double or dual orientation design. Similarly, connector 1510 may include a body having a cable attached thereto like body 1115 or any of the other body embodiments described herein. In one embodiment, a body (not shown in FIGS. 15A-15F) may be assembled with tab 1530, house PCB 1532 and have a cable (not shown in FIGS. 15A-15F) attached thereto. The cable may include a plurality of individual insulated wires for connecting to contacts 1540*e*-1540*h* via PCB 1532 that includes solder connections between crossover contact frames 1596*a*-1596*d* and its bonding pads.

The contacts of connector 1510 may include contacts for power, ground and a pair of differential data signals (e.g., data transmit). For example, crossover contact frames 1596*a*-1596*d* may provide lines for ground, Data+, Data− and power (VBUS), respectively. Accordingly, contacts 1540*a* and 1540*h* may be a ground pins, contacts 1540*b* and 1540*g* may be a Data+pins, contacts 1540*c* and 1540*f* may be a Data−pins, and contacts 1540*d* and 1540*e* may power pins (VBUS). In this manner, regardless of the orientation of plug connector 1510, the same pinout may be mated with a corresponding receptacle connector during a mating event.

An added benefit of this embodiment may be that sensing circuitry as discussed in relation to other embodiments contained herein may not be necessary for connector 1510 or a corresponding receptacle connector. This is possible because crossover contact frames 1596*a*-1596*d* may provide the same pinout on each of the first and second orientations and handle the routing of power and data received at contacts 1540*a*-1540*h* to PCB 1532. In some embodiments, contact frames 1596*a*-1596*d* may even directly route power and data to individual wires of a cable connected to connector 1510. Accordingly, features of connector 1510 may be useful for other embodiments described herein.

Contact frames 1596*a*-1596*d* can be made from copper, nickel, brass, a metal alloy or any other appropriate conductive material using a metal stamping operation or other machining operations. Alternatively, contact frames 1596*a*-1596*d* may be molded.

The contact arrangements shown in FIGS. 15A-15F and discussed in relation thereto may be implemented in various ways in other embodiments, e.g., those embodiments that do not include a PCB disposed between the contacts of the plug connector. Additional embodiments of contact arrangements that may be implemented with plug connector embodiments that may not include PCB anywhere within the plug connector are shown in the following figures.

Figure 17A:
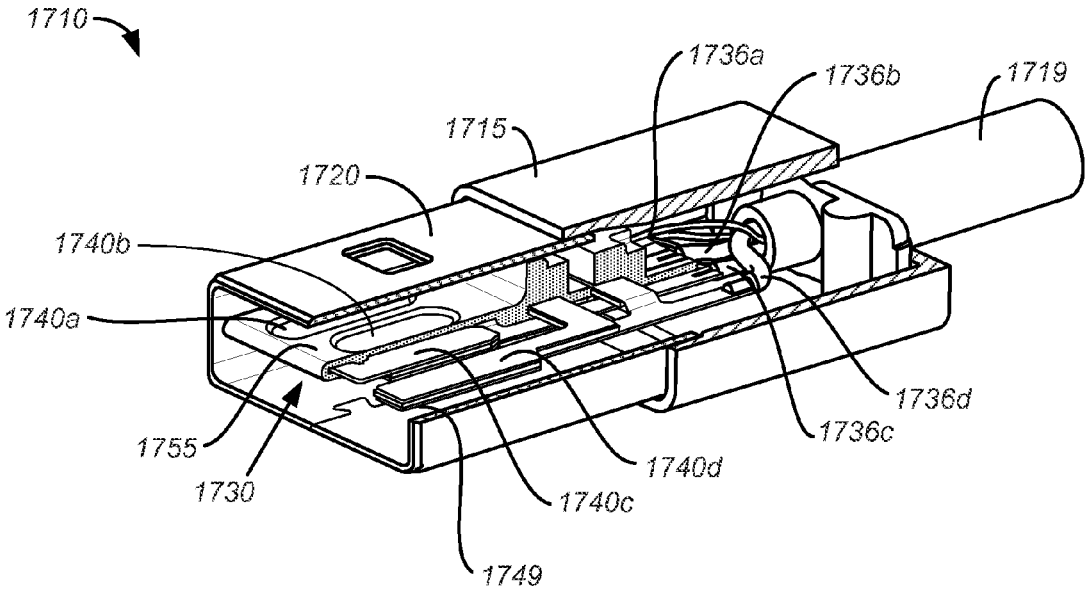
FIGS. 17A and 17B are partial cross sectional perspective and cross sectional side views, respectively, of a USB plug connector according to one embodiment of the present invention.
Figure 17B:
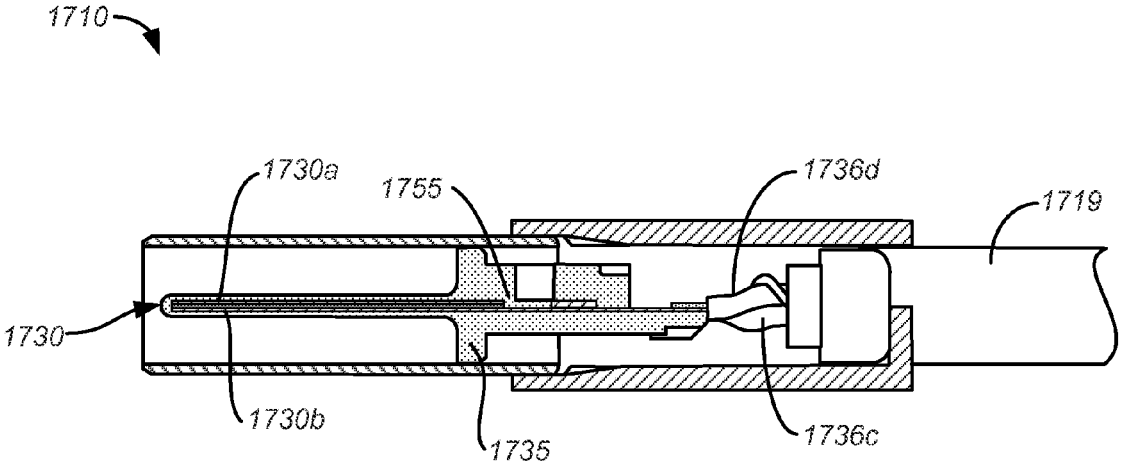

FIGS. 17A and 17B are partial cross sectional perspective and cross sectional side views, respectively, of a USB plug connector 1710 according to one embodiment of the present invention. Plug connector 1710 may be similar to embodiments discussed above, e.g., plug connector 1610. However, plug connector 1710 may not include a PCB. FIGS. 17A and 17B show that connector 1710 may include a body 1715 and a shell 1720 extending longitudinally away from body 1715 in a direction parallel to the length of connector 1710. Shell 1720 includes an opening 1725 that communicates with a cavity. Tongue 1730 may be centrally located within shell 1720 and extend in a direction parallel to the length of plug connector 1710. Contacts 1740*a*-1740*d* are exposed on a first major surface 1730*a* and contacts 1740*e*-1740*h* are exposed on a second major surface 1730*b*. Contacts 1740*a*-1740*h* may be exposed portions of contact frames 1798*a*-1798*d*.

Crossover contact frames 1798*a*-1798*d* may serve to connect contacts 1740*a*-1740*d* to contacts 1740*h*-1740*e*, respectively, and contacts 1740*a*-1740*h* to wires of cable 1719. FIGS. 17A and 17B illustrate insulated wires, wires 1736*a*-1736*d*, that extend from the interior of cable 1719. Wires 1736*a*-1736*d* may directly terminate on contact frames 1798*a*-1798*d*, e.g., wires 1736*a*-1736*d* may be soldered to contact frames 1798*a*-1798*d*. The Cable 1719 may include wires corresponding to each unique contact of plug connector 1710. For example, wire 1736*d* may be a grounding wire that connects to contact frame 1798*a* (contacts 1740*a* and 1740*h*), wire 1736*c* may be a Data+wire that connects to contact frame 1798*b* (contacts 1740*b* and 1740*g*), wire 1736*b* may be a Data−wire that connects to contact frame 1798*d* (contacts 1740*c* and 1740*f*), and wires 1736*a* may be power wires that connect to contact frame 1798*c* (contacts 1740*d* and 1740*e*). In this manner, regardless of the orientation of plug connector 1710, the same pinout may be mated with a corresponding receptacle connector during a mating event.

The configuration of crossover contact frames 1798*a*-1798*d* is further illustrated in the following figure.

Figure 17C:
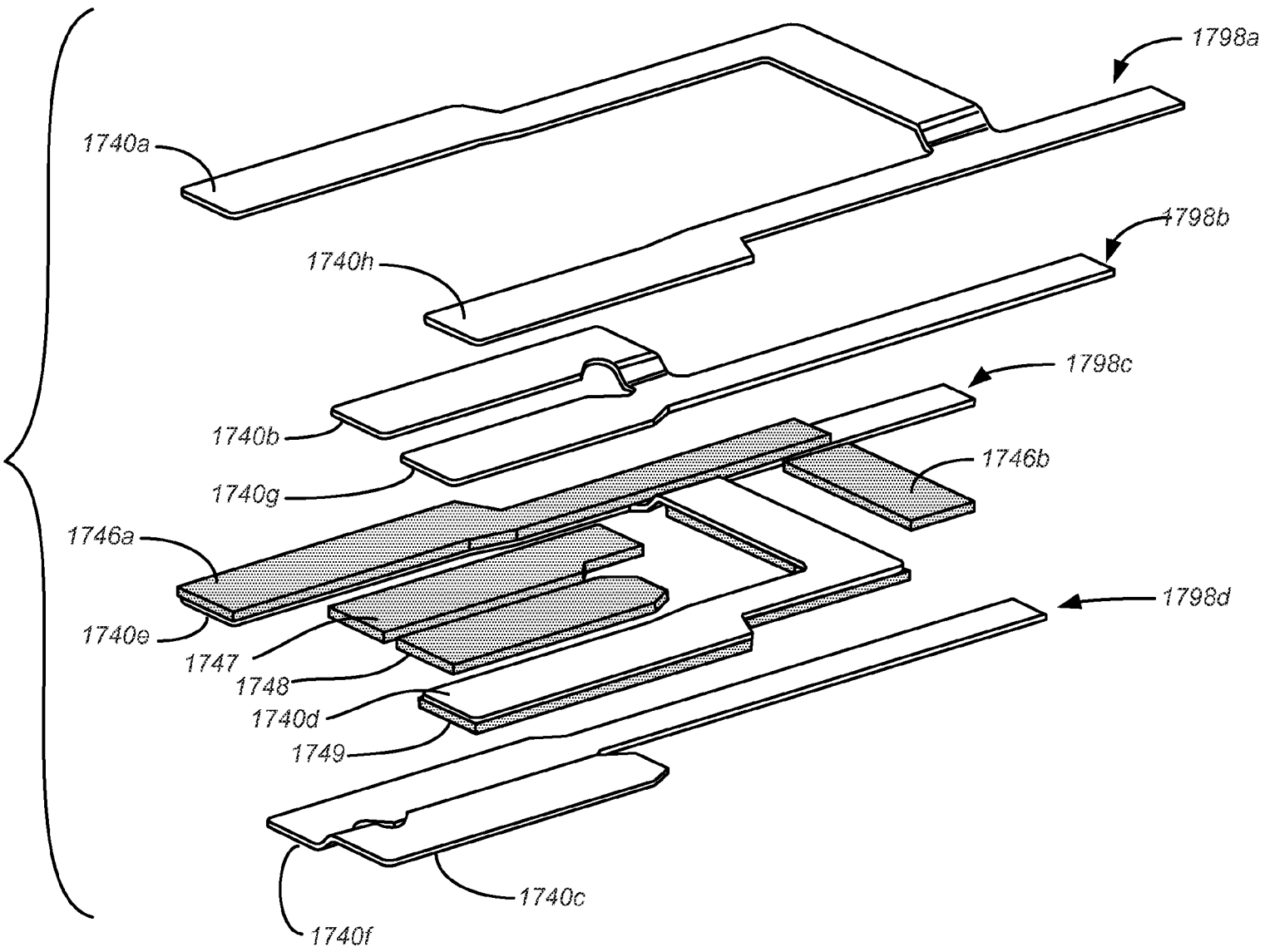
FIG. 17C is an exploded view of contact frames of the plug connector of FIGS. 17A and 17B.

FIG. 17C is an exploded view of contact frames 1798*a*-1798*d* of plug connector 1710. As can be understood from FIG. 17C, a crossover region exists between contacts 1740*a*-1740*d* and contacts 1740*e*-1740*h* where portions of contact frames 1798*a*-1798*d* overlap and cross. Insulative spacers may be placed in this crossover region. For example, strips of electrical insulation materials, e.g., elastomers or other polymers with good electrical insulation properties, may be placed and/or adhered to the surfaces of contact frames 1798*a*-1798*d* adjacent to other surfaces of contact frames 1798*a*-1798*d* in plug connector 1710, as shown in FIG. 17C. For example, spacers 1746*a* and 1746*b* may shield portions of contact frame 1798*c* from portions of contact frame 1798*a*. Spacers 1747 and 1748 may shield portions of contact frame 1798*b* from portions of contact frame 1798*d*. Spacer 1749 may shield portions of contact frame 1798*c* from portions of contact frame 1798*a*.

Depending the amount of EMI that is occurring between the contacts of plug connector 1710, more or less and/or thicker or thinner insulative spacers may be implemented. For example, if additional shielding is required more and/or thicker insulative spacers may be placed in the crossover region between contact frames 1798*a*-1798*d*. The overlapping and crossing of portions of contact frames 1798*a*-1798*d* in the crossover region in addition to the insulative spacers may provide shielding from EMI caused by signals passing through 1740*a*-1740*h*, which EMI may degrade the signals transferred through contacts 1740*a*-1740*h*.

Overmold 1755 may be formed around spacers 1746-1749 and contact frames 1798*a*-1798*d* to form tongue 1730. As discussion herein, tongue overmolds may provide cosmetic, rigidity and wear resistance benefits. Materials used for other tongue overmold embodiments discussed herein may also be used for overmold 1755.

The design of plug connector 1710, as with plug connector 1510, may be a 180 degree symmetrical, double or dual orientation design. An added benefit of contact frames 1798*a*-1798*d* may be that sensing circuitry as discussed in relation to other embodiments contained herein may not be necessary for connector 1710 or a corresponding receptacle connector for reasons similar to those mentioned concerning plug connector 1510.

As shown in FIG. 17B, plug connector 1710 may also include a structural support 1735 integrally formed with overmold 1755. Structural support 1735 may provide flexure to tongue 1730 to reduce stress and fatigue on tongue 1730 and allow tongue 1730 to deflect during insertion/extraction events. In other embodiments, structural support 1735 may be separately overmolded over overmold 1755 or separately formed and then assembled with tongue 1730 using a clearance fit, an interference fit or a snap-fit or the like.

Contact frames 1798*a*-1798*d* can be made from copper, nickel, brass, a metal alloy or any other appropriate conductive material using a metal stamping operation or other machining operations. Alternatively, contact frames 1798*a*-1798*d* may be molded.

An example of another plug connector embodiment that may not include PCB is shown in the following figures.

Figure 18A:
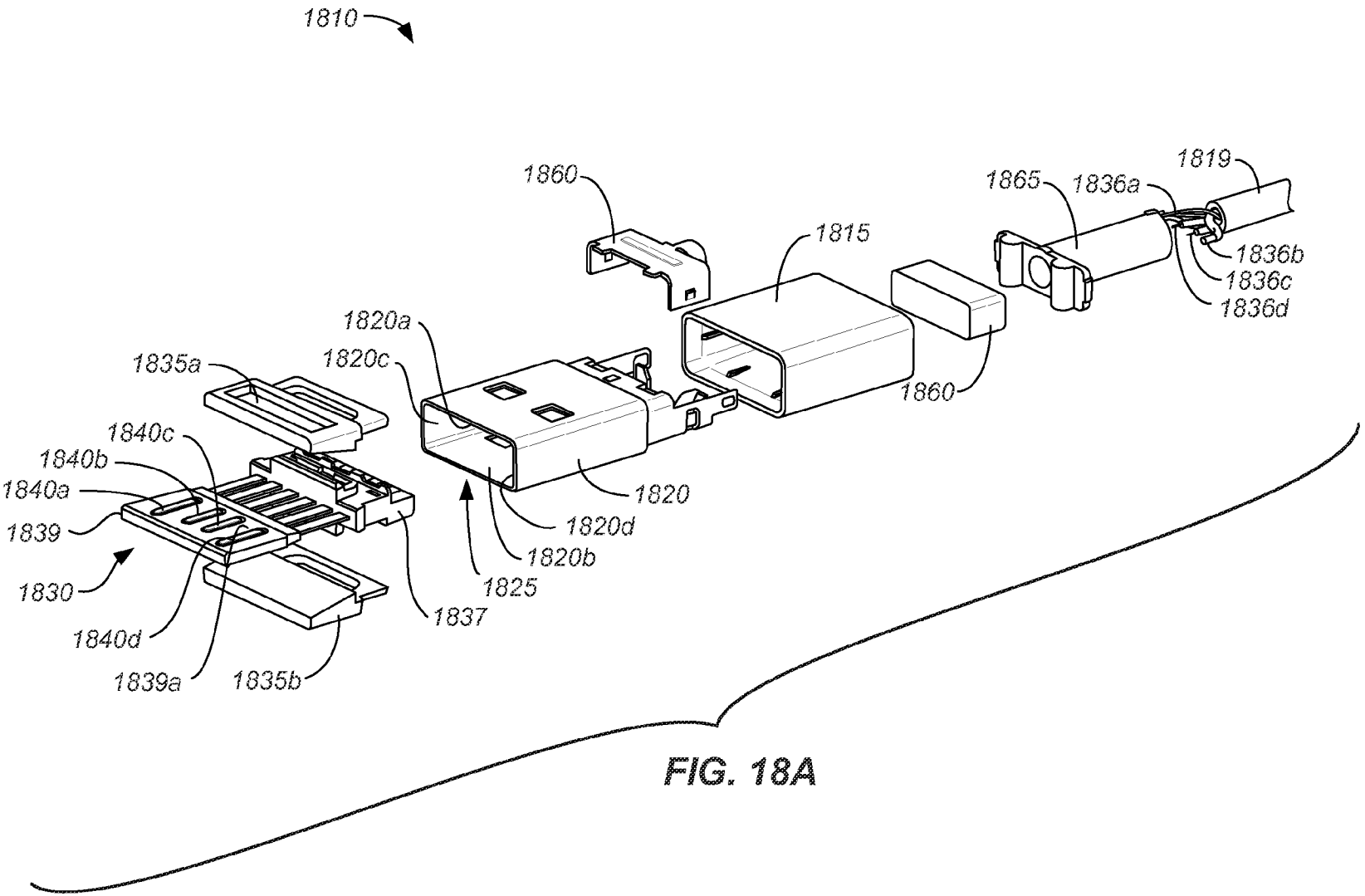
FIGS. 18A and 18B are exploded and cross sectional side views, respectively, of a USB plug connector according to an embodiment of the present invention.
Figure 18B:
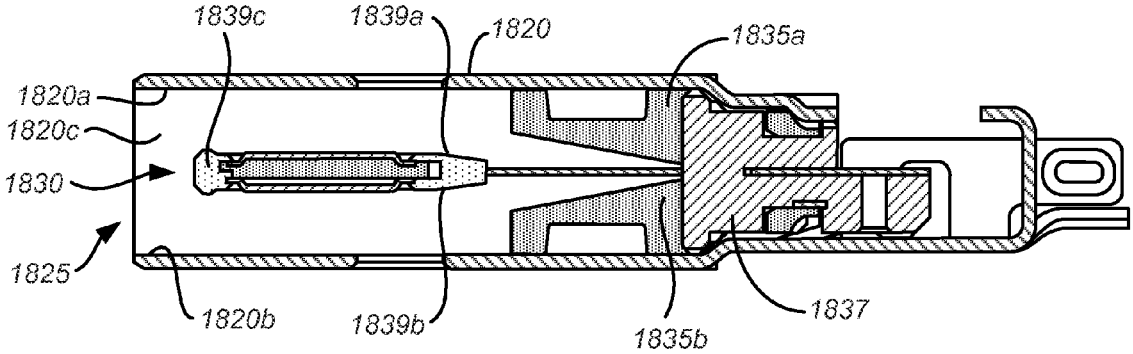
Figure 18C:
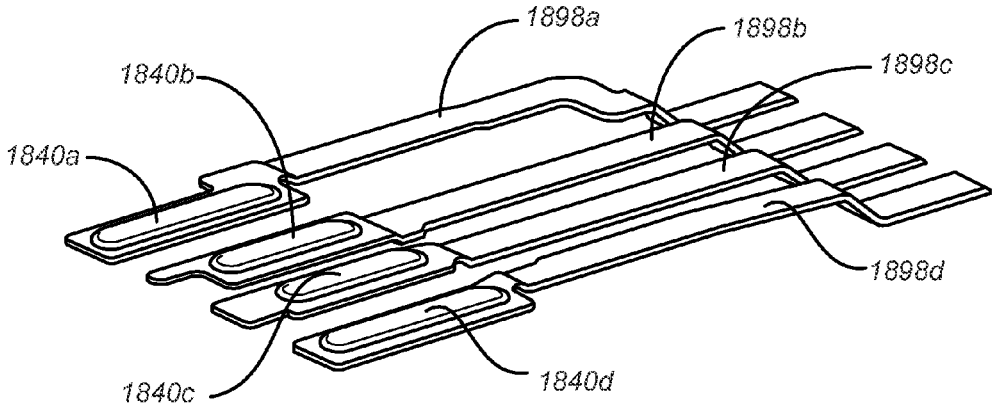
FIGS. 18C-18H illustrate contact frames of the connector of FIGS. 18A and 18B in various stages of assembly according to an embodiment of the present invention.
Figure 18D:
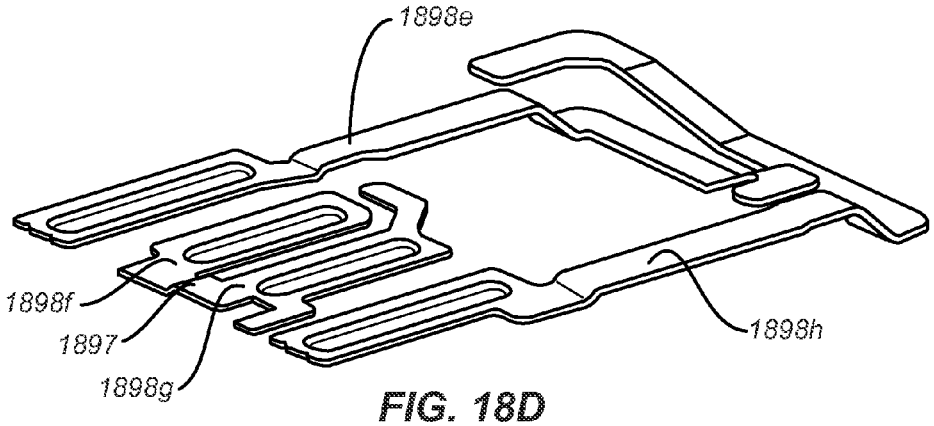

FIGS. 18A and 18B are exploded and cross sectional side views, respectively, of a USB plug connector 1810 according to an embodiment of the present invention. Plug connector 1810 may be similar to embodiments discussed above which does not include a PCB, e.g., plug connector 1710. As shown in FIGS. 18A and 18B, connector 1810 includes a body 1815 and a shell 1820 extending longitudinally away from body 1815 in a direction parallel to the length of connector 1810. Shell 1820 includes an opening 1825 that communicates with a cavity defined by first, second, left and right inner surfaces 1820*a*-1820*d* of shell 1820, a tongue 1830, and first and second support elements 1835*a*, 1835*b* assembled with a base 1837. Tongue 1830 may be centrally located between first and second inner surfaces 1820*a*, 1820*b* and extend parallel to the length of connector 1810. Tongue 1830 includes contacts 1840*a*-1840*d* exposed at a first major surface 1839*a* of a tip 1839 and four additional contacts (e.g., contacts 1840*e*-1840*h*, as shown in FIG. 18F) exposed on a second major surface 1839*b*. Contacts 1840*a*-1840*h* can be made from copper, nickel, brass, a metal alloy such as a copper-titanium alloy or any other appropriate conductive material. As shown in FIGS. 18A and 18B, tongue 1830 may also include a bullnose tip 1839*c* for reasons that will be explained below.

Connector 1810 can have a 180-degree symmetrical, double orientation design that enables the connector to be inserted into a corresponding receptacle connector in either a first orientation where surface 1839*a* is facing up or a second orientation where surface 1839*a* is rotated 180 degrees and facing down. To allow for the orientation agnostic feature of connector 1810, tongue 1830 is not polarized. That is, tongue 1830 does not include a physical key that is configured to mate with a matching key in a corresponding receptacle connector designed to ensure that mating between the two connectors only occurs in a single orientation. Instead, if tongue 1830 is divided into top and bottom halves along a horizontal plane that bisects the center of tongue 1830 along its width, the physical shape of the upper half of tongue 1830 is substantially the same as the physical shape of the lower half. Similarly, if tongue 1830 is divided into left and right halves along a vertical plane that bisects the center of tab along its length, the physical shape of the left half of tongue 1830 is substantially the same as the shape of the right half. Additionally, contacts 1840*a*-1840*d* and contacts 1840*e*-1840*g* can be positioned so that they are arranged in a symmetric manner. Accordingly, contacts 1840*a*-1840*d* can mate with contacts of the corresponding receptacle connector in one orientation and contacts 1840*e*-1840*h* (shown in FIG. 18F) can mate with contacts of the corresponding receptacle connector in the other orientation.

Tongue 1830 may be coupled to base 1837, which can be made from a variety of dielectric materials, including flexible polymers and polyamides. The materials used to form tongue 1830 and/or base 1837 may be chosen such that tongue 1830 deflects either toward first or second inner surfaces 1820*a*, 1820*b* of shell 1820 when connector 1810 is inserted into a corresponding receptacle connector, e.g., a female USB connector. This deflection may occur as bullnose tip 1839*c* comes into contact with internal features of a corresponding receptacle connector, causing tongue 1830 to deflect toward an appropriate region within a corresponding receptacle connector and allowing contacts 1830*a*-1830*d* or 1830*e*-1830*h* of plug connector 1810 to mate with contacts on the corresponding receptacle connector.

As discussed above, tongue 1830 may be centrally located within opening 1825 of shell 1820. For example, tongue 1830 may be positioned within opening 1825 such that its distance from first and second inner surfaces 1820*a*, 1820*b* always causes connector 1810 to deflect toward the appropriate region within a corresponding receptacle connector regardless of whether plug connector 1810 is in the first or second orientation, as described above. Portions of tongue 1830 may deform and deflect in different manners in order to put its contacts in position to mate with the contacts of the corresponding receptacle connector. Depending on the materials of the individual components of tongue 1830, the size of tongue 1830 may be varied such that tongue 1830 elastically deforms as necessary during mating events.

Body 1815 is generally the portion of connector 1810 that a user will hold onto during mating events. Body 1815 can be made out of a variety of materials and in some embodiments is made from a dielectric material, such as a thermoplastic polymer formed in an injection molding process. A portion of a cable 1819 and shell 1820 may extend within and be enclosed by body 1815. To prevent cable 1819 from being damaged when flexed during normal use (e.g., mating events), a strain relief element 1865 (e.g., a structure made from elastomers) may be formed over or assembled with the portion of cable 1819 closest to body 1815, as shown in FIG. 18A.

In one embodiment, cable 1819 includes a plurality of individual insulated wires 1836*a*-1836*d* for connecting to contacts 1840*a*-1840*h*. The electrical connection between insulated wires 1836*a*-1836*d* and contacts 1840*a*-1840*h* can be formed by soldering wires 1836*a*-1836*d* to ends of contact frames 1898*a*-1898*d* (as shown in FIGS. 18C, 18D and 18H). As further discussed below, contacts 1840*a*-1840*h* may be exposed portions of contact frames 1898*a*-1898*h*. Accordingly, contact frames 1898*a*-1898*h* can route electrical signals between wires 1836*a*-1836*d* and contacts 1840*a*-1840*h*. A polymer innermold 1855 may be formed around the connection between wires 1836*a*-1836*d* and the ends of contact frames 1898*a*-1898*d*. A metallic shield cap 1860 may be assembled over innermold 1855 and with shell 1820 to increase electromagnetic interference and electromagnetic compatibility performance ("EMI/EMC performance") of connector 1810. The configuration of contact frames 1898*a*-1898*h* is further illustrated in the following figures.

FIGS. 18C-18H illustrate contact frames 1898*a*-1898*h* in various stages of assembly according to an embodiment of the present invention. FIG. 18C show a first set of contact frames 1898*a*-1898*d* shaped to extend through base 1837 and form a portion of tongue 1830 with raised protuberances that function as contacts 1840*a*-1840*d*. FIG. 18D shows a second set of contact frames 1898*e*-1898*h* having raised protuberances that function as contacts 1840*e*-1840*h*. Contact frames 1898*e*-1898*h* may be shaped to be coupled with the first set of contact frames 1898*a*-1898*d* such that contacts 1840*a*-1840*d* are electrically connected to contacts 1840*h*-1840*e*, respectively. Contact frames 1898*a*-1898*e* and 1898*h* may also extend into base 1837, while contact frames 1898*f* and 1898*g* do not extend into base 1837. As shown in FIG. 18D, contact frames 1898*f* and 1898*g* may be connected via an arm 1897. The shape of contact frames 1898*f*, 1898*g* and arm 1987 can minimize or reduce electrical stub and thereby minimize insertion loss, allowing for improved signal integrity for contacts 1840*b*, 1840*d*, 1840*g* and 1840*f*, which may be differential data contacts, as discussed below.

Figure 18E:
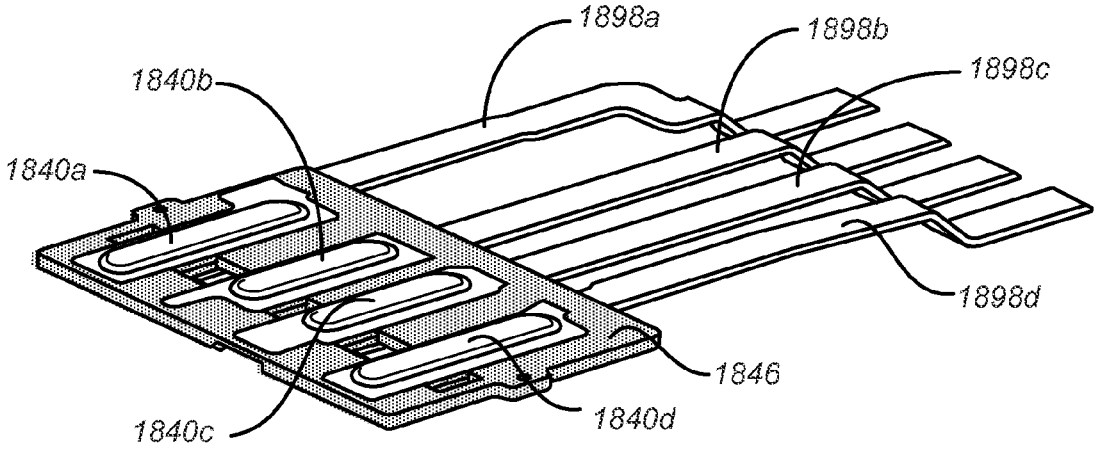
Figure 18F:
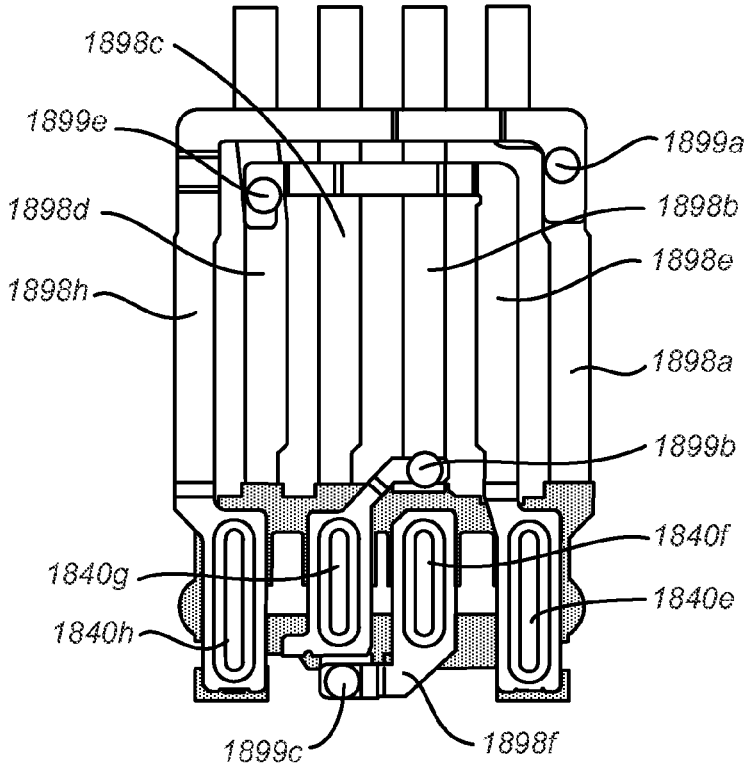
Figure 18G:
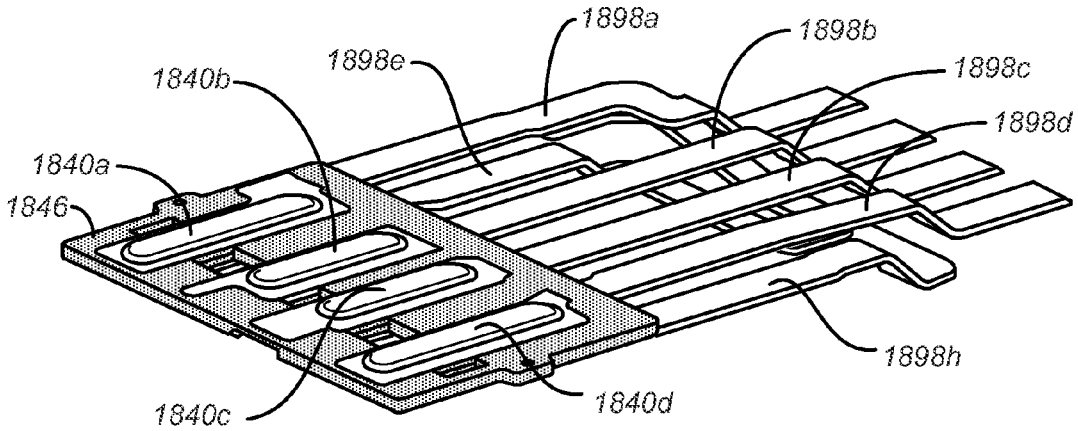
Figure 18H:
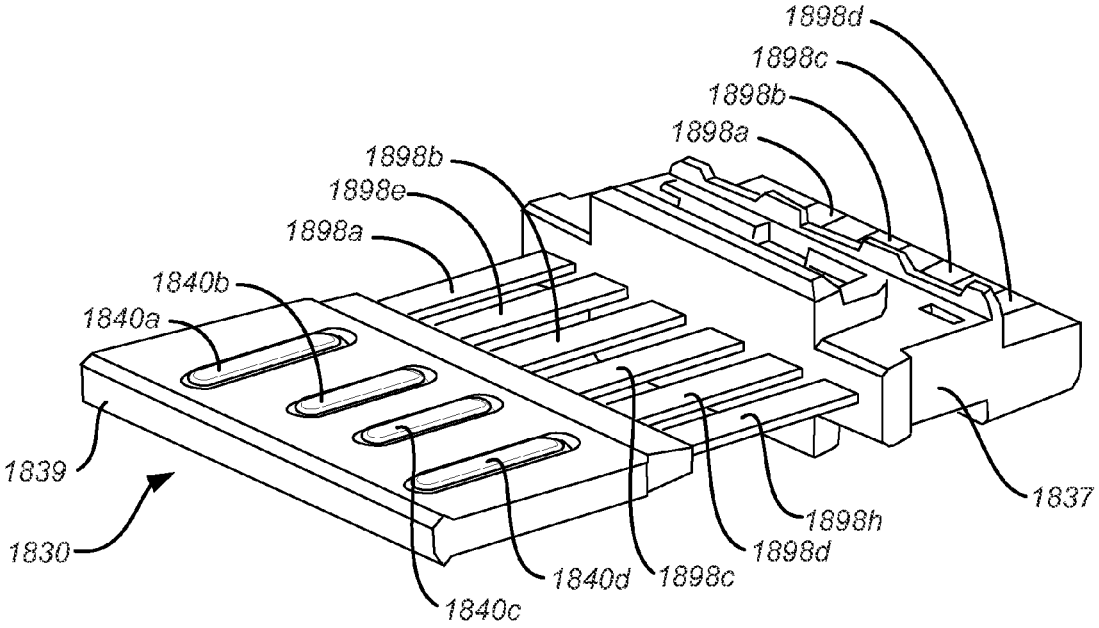

As shown in FIG. 18E, a insulative spacer 1846 may be insert molded over and between portions of contacts 1898*a*-1898*d* to electrically shield and isolate contacts 1840*a*-1840*h*, even when assembled as shown in FIG. 18F. As such, portions of contact frames 1898*a*-1898*d* can overlap and cross contact frames 1898*e*-1898*h* while maintaining acceptable levels of EMI/EMC performance. Spacer 1846 can be made from dielectric materials, e.g., elastomers or other polymers with good electrical insulation properties. A larger or smaller, thicker or thinner and/or otherwise shaped insulative spacer 1846 may be implemented depending on the amount of EMI that is occurring between the contacts and/or contact frames of plug connector 1810. For example, if additional shielding is required, insulative spacer 1846 may be thickened where any one of contact frames 1898*a*-1898*d* overlap any one of contact frames 1898*e*-1898*h*, thereby shielding EMI that could potentially degrade the signals passing to or from contacts 1840*a*-1840*h* via contact frames 1898*a*-1898*h*.

In order to achieve the 180-degree symmetrical, double or dual orientation design of connector 1810, contact frames 1898*e*-1898*h* may be electrically connected to contact frames 1836*a*-1836*d* such that the same pinout or arrangement of contact types (e.g., data, power, ground) is provided at first and second surfaces 1839*a*, 1839*b*. Accordingly, as shown in FIG. 18F, contacts 1840*a*-1840*d* are electrically connected with contacts 1840*h*-1840*e*, respectively, via the coupling (e.g., welding or otherwise electrically connecting) to the first and second set of contact frames. More specifically, a weld 1899*a* (e.g., a laser weld) may electrically couple contact frame 1898*a* to contact frame 1898*h*, thereby coupling contacts 1840*a* and 1840*h*; a weld 1899*b* may electrically couple contact frame 1898*b* to contact frame 1898*g*, thereby electrically coupling contacts 1840*b* and 1840*g*; a weld 1899*c* may electrically couple contact frame 1898*c* to contact frame 1898*f*, thereby electrically coupling contacts 1840*c* and 1840*f*; and a weld 1899*e* may electrically couple contact frame 1898*e* to contact frame 1898*d*, thereby electrically coupling contacts 1840*d* and 1840*e*.

As with standard USB plug connectors, plug connector 1810 may include contacts for power, ground and a pair of differential data signals (e.g., data transmit). Cable 1819 may include wires corresponding to each of these unique contacts. As discussed above, wires 1836*a*-1836*d* may directly terminate on contact frames 1836*a*-1836*d* in order to couple with contacts 1840*a*-1840*h*. For example, wire 1836*d* may be a grounding wire that connects to contacts 1840*d* and 1840*e* via contact frames 1898*d* and 1898*e*, wire 1836*c* may be a Data+ wire that connects to contacts 1840*c* and 1840*f* via contact frames 1898*c* and 1898*f*, wire 1836*b* may be a Data−wire that connects contacts 1840*b* and 1840*g* via contact frames 1898*b* and 1898*g*, and wires 1836*a* may be power wires that connect to contacts 1840*a* and 1840*h* via contact frames 1898*a* and 1898*h*. In this manner, regardless of the orientation of plug connector 1810, the same pinout may be mated with a corresponding receptacle connector during a mating event.

The design of plug connector 1810, as with plug connector 1510, may be a 180-degree symmetrical, double or dual orientation design. An added benefit of using contact frames, e.g., frames 1898*a*-1898*h* may be that sensing circuitry as discussed in relation to other embodiments contained herein may not be necessary for connector 1810 or a corresponding receptacle connector for reasons similar to those mentioned concerning plug connector 1510.

As mentioned earlier, plug connector 1810 may also include a base 1837 and first and second support elements 1835*a*, 1835*b* assembled with a base 1837. The combination of support elements 1835*a*, 1835*b* and base 1837 may support tongue 1830 as it flexes during insertion/extraction events in order to reduce stress and fatigue experienced by, e.g., contact frames 1898*a*-1898*h* of tongue 1830. Base 1837 may be overmolded over contact frames 1898*a*-1898*e* and 1898*h* or separately formed and then assembled with the rest of tongue 1830 using a clearance fit, an interference fit, a snap-fit or the like. In another embodiment, support elements 1835*a*, 1835*b* may be overmolded separately or integrally with base 1837. Support elements 1835*a*, 1835*b* may be made from a resilient polymer, e.g., LCP or POM. Overmolding may also be used to form tip 1839 over spacer 1846 and around the contacts of contact frames 1898*a*-1898*h*, as shown in FIG. 18H. Tip 1839 may provide cosmetic, rigidity and wear resistance benefits. Materials used for other tongue overmold embodiments discussed herein may also be used for tip 1839. Alternatively, tip 1839 may be assembled on contact frames 1898*a*-1898*h*.

Contact frames 1898*a*-1898*h* can be made from copper, nickel, brass, a metal alloy such as a copper-titanium alloy or any other appropriate conductive material using a metal stamping operation or other machining operations. Alternatively, contact frames 1898*a*-1898*h* may be molded. Contacts 1840*a*-1840*h* may be made from the same material as contact frames 1898*a*-1898*h*. In addition, contacts 1840*a*-1840*h* may be plated with nickel and/or gold.

The structures and methods shown in FIGS. 18A-18H and discussed in relation thereto may also be implemented in various ways in other embodiments of the present invention.

It will be appreciated that connector 1810 is illustrative and that variations and modifications are possible. The shapes and number of contact frames of connector 1810 can be varied in ways not specifically described here. Further, while contact frames are described above as being coupled, i.e., via welding, at particular locations, it is to be understood that these weld points can vary for contact frames having different shapes and configurations. Further, the contact frames of connector 1810 may be replaced with a tongue-shaped element made from a metallic material or a polymer and not configured to carry signals. In this embodiment, a flex circuit having contacts may simply be wrapped around the tongue-shaped element to provide a dual orientation connector such as a USB connector. Embodiments of the present invention can be realized in a variety of apparatus including cable assemblies, docking stations and flash drives. Support elements or members 1835*a*, 1835*b*, which collectively may be referred to as a support structure, of connector 1810 can be varied in ways not specifically described above. The following figures illustrate examples of variations of this support structure, which may be implemented in various embodiments described herein.

Figure 19A:
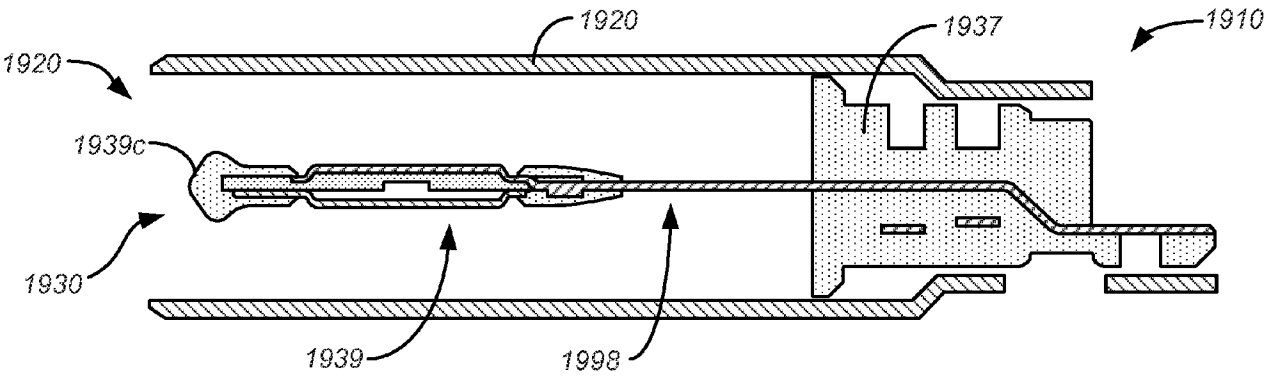
FIGS. 19A and 19A-1 are cross sectional side and partially exploded, partially cross sectional perspective views, respectively, of a USB plug connector with its support structure removed according to one embodiment of the present invention.
Figures 1, 19A:
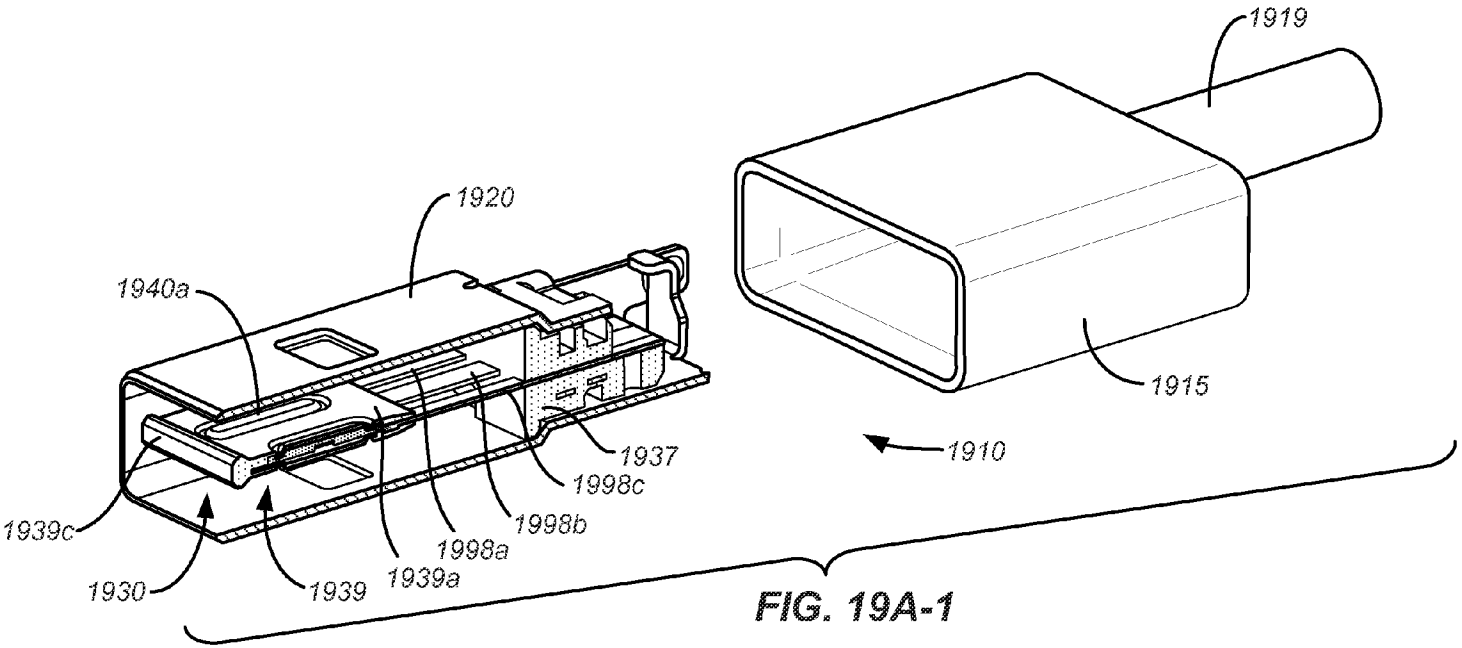
Figure 19B:
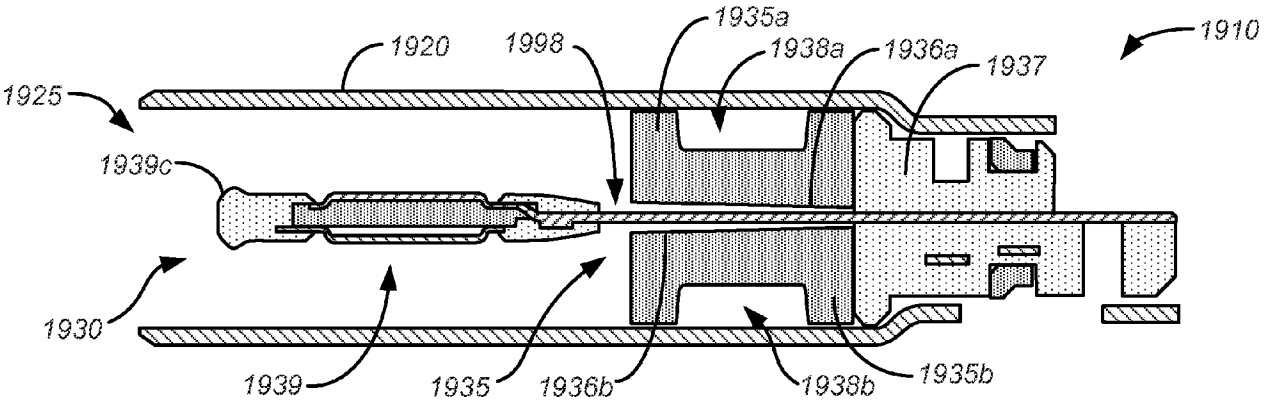
Figures 1, 19B:
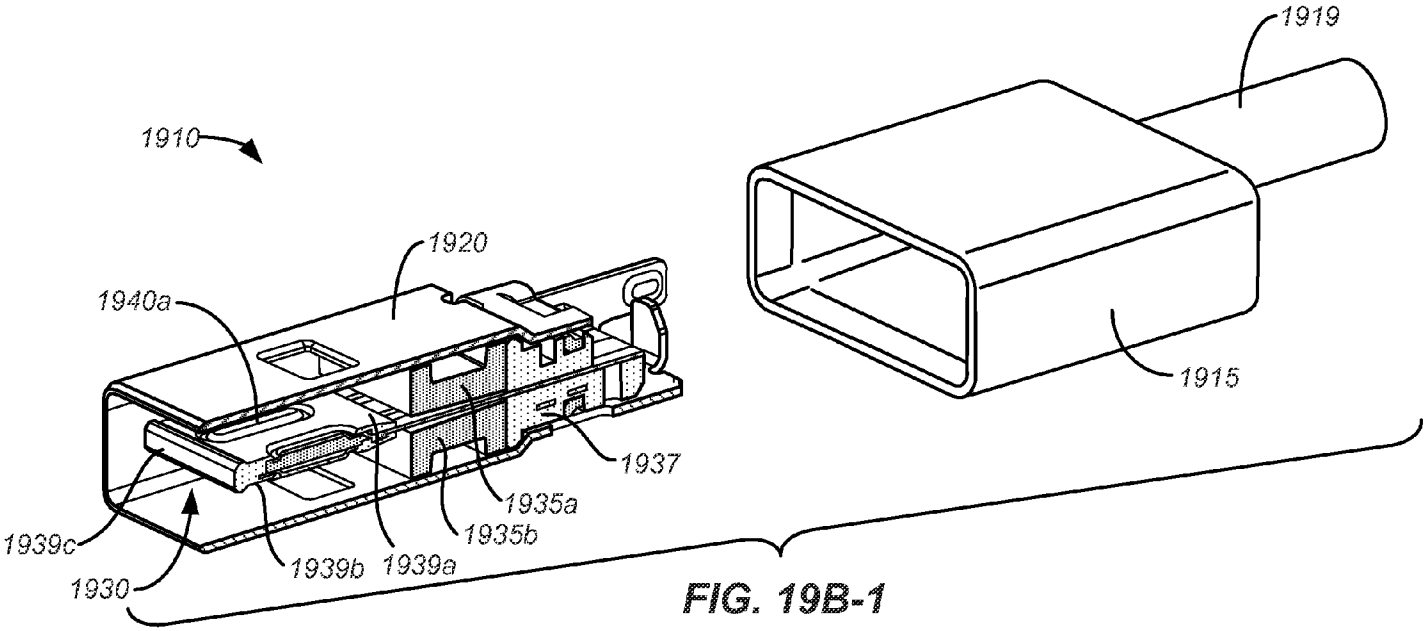

In order to discuss the utility of a support structure, such as support members 1835*a*, 1835*b*, reference is first made to a reversible connector with its support structure removed: FIGS. 19A and 19A-1 are cross sectional side and partially exploded, partially cross sectional perspective views, respectively, of a USB plug connector 1910 with its support structure removed according to one embodiment of the present invention. Plug connector 1910 may be similar to embodiments discussed above, e.g., plug connector 1810. Again, for the purpose of discussion, the support structure (as shown in FIGS. 19B and 19B-1) of plug connector 1910 is not shown in FIGS. 19A and 19A-1. As with connector 1810, plug connector 1910 includes a body 1915 and a shell 1920 extending longitudinally away from body 1915 in a direction parallel to the length of connector 1910. Shell 1920 includes an opening 1925 that communicates with a cavity defined by inner surfaces (e.g., surfaces 1820*a*-1820*d* as shown in FIG. 18A) of shell 1920 and a base 1937.

Tongue 1930 may be centrally located between inner surfaces of shell 1920 and extend parallel to the length of connector 1910. Tongue 1930 can include contacts (only contact 1940*a* is shown in FIG. 19A-1, but see, e.g., contacts 1840*a*-1840*d* in FIG. 18A) exposed at a first major surface 1939*a* of a contact region 1939 and additional contacts (e.g., contacts 1840*e*-1840*h*, as shown in FIG. 18F) exposed on a second major surface of contact region 1939. The contacts of connector 1910 may be exposed portions of contact frames 1998 (only contact frames 1998*a*-1998*c* are shown in FIG. 19A-1, but see, e.g., contact frames 1898*a*-1898*h* in FIG. 18F), at least some of which are spaced apart along a width of the tongue, as shown in FIG. 19A-1. Tongue 1930 may also include a bullnose tip 1939*c* (e.g., tip 1839*c*, as shown in FIG. 18B). A cable 1919 can be coupled to base 1915 and include a plurality of individual insulated wires (e.g., wires 1836*a*-1836*d*, as shown in FIG. 18A) for coupling with contacts of connector 1910.

Like connector 1810 above, connector 1910 can also have a 180-degree symmetrical, double orientation design that enables the connector to be inserted into a corresponding receptacle connector in either a first orientation where surface 1939*a* is facing up or a second orientation where surface 1939*a* is rotated 180 degrees and facing down. For example, tongue 1930 may be positioned within opening 1925 such that tongue 1930 deflects toward the an inner surface of shell 1920 and is positioned in an appropriate region within a corresponding receptacle connector, regardless of whether plug connector 1910 is in the first or second orientation. Bending portions of tongue 1930 (e.g., portions of contact frames 1998) may bend or deform and deflect in different manners in order to put the contacts of connector 1910 in position to mate with the contacts of the corresponding receptacle connector.

The discussion of elements and variations thereof concerning connector 1810 may apply to corresponding elements of connector 1910. Additional elements and variations thereof discussed with reference to connector 1810 above may also be implemented in connector 1910.

The absence of a support structure in connector 1910 may result in a number of issues. As mentioned concerning other embodiments, a support structure (support members 1835*a*, 1835*b*), as well as a base (e.g., base 1837), can support a tongue as it flexes during insertion/extraction events in order to reduce stress experienced at any given point of the tongue. FIG. 19A can be used to identify where stress might be concentrated in the absence of a support structure. For example, the point at which tongue 1930 protrudes through base 1937 and into the cavity of shell 1920 may be the pivot point for tongue 1930. As such, the majority of the stress experienced by tongue 1930 during a mating event may be concentrated at and/or around that pivot point, which would be the bending portion of tongue 1930. Even if the stress experienced at this bending portion of tongue 1930 is less than the yield stress of the material at this bending portion of tongue 1930, permanent deformation may occur over time if connector 1910 is left in the mated position for a period (e.g., if connector 1910 is left in receptacle for months, weeks or possibly even days).

To resolve these potential issues, the length of the bending portion of tongue 1930 could be increased such that the angle of deflection of tongue 1930 is decreased, resulting in less stress occurring at the bending portion. However, this could also decrease the contact normal force or contact mating force provided by tongue 1930 to press its contacts against the contacts of a corresponding receptacle connector during a mating event such that data and/or power can be transferred therebetween. That is, the stress occurring at the bending portion of tongue 1930 may correlate to the contact normal force provided by tongue 1930. Alternatively, if the size of the bending portion of tongue 1930 could be increased such that the stress could be distributed over a larger portion of tongue 1930, damage to and/or permanent deformation of tongue 1930 could potentially be avoided. For example, a structural support could be used to spread or distribute stress (e.g., uniformly spread stress) over a larger bending portion of a tongue, while maintaining or even increasing contact normal force by spreading stress instead of decreasing the overall stress.

FIGS. 19B and 19B-1 are cross sectional side and partially exploded, partial cross sectional perspective views, respectively, of the USB plug connector of FIGS. 19A and 19A-1 with a support structure according to one embodiment of the present invention. Structural support 1935 can include first and second support members 1935*a*, 1935*b* that are overmolded adjacent to, integrally formed with base 1937 (e.g., using a single or a multiple shot process) or separately formed and then assembled with base 1937 or other elements of connector 1910 (e.g., shell 1920) using a clearance fit, an interference fit, a snap-fit or the like. First and second support members 1935*a*, 1935*b* of structural support 1935 may be made from a compliant material such as a thermoplastic elastomer (e.g., silicone santoprene) or other materials suitable for distributing stress while maintaining or providing sufficient contact normal force.

As shown in FIGS. 19B and 19B-1, first and second support members 1935*a*, 1935*b* can be positioned on opposite sides of tongue 1930 with first support member 1935*a* including a surface 1936*a* that faces a surface of tongue 1930 and second support member 1935*b* including a surface 1936*b* that faces another surface of tongue 1930. FIGS. 19B and 19B-1 also show that the distance between surfaces 1936*a*, 1936*b* varies along the portion of the length of tongue 1930 that is positioned between these surfaces 1936*a*, 1936*b*. For example, the distance between surfaces 1936*a*, 1936*b* may increase in the direction that tongue 1930 extends from base 1937. Thus, the opening formed by the first and second support members 1935*a*, 1935*b* may be tapered. As such, when tongue 1930 deflects during a mating event, the stress experienced by tongue 1930 may be distributed across the bending portion of tongue 1930 (e.g., the portion of tongue 1930 that is deflected towards and makes contact with surface 1936*a* or surface 1936*b*). In some embodiments, this may cause tongue 1930 to experience a low, constant stress across the bending portion of tongue 1930 during mating events, as opposed to experiencing a high stress at the pivot point, as discussed with reference to FIGS. 19A and 19A-1.

First and second support members 1935*a*, 1935*b* may also include a recess (e.g., recesses 1938*a*, 1938*b*) at surfaces opposite surfaces 1936*a*, 1936*b*, respectively, such that the height of first and second support members 1935*a*, 1935*b* also varies along the portion of the length of tongue 1930 that is positioned between surfaces 1936*a*, 1936*b*. These recesses may be shaped and sized based on the height of first and second support members 1935*a*, 1935*b* in order to distribute stress and provide contact normal force for tongue 1930.

Alternatively or additionally, the durometer of structural support 1935 may vary along a portion of the length of tongue 1930. For example, the durometer of portions of first and second support elements 1935*a*, 1935*b* nearest to base 1937 may be higher than other portions of first and second support elements 1935*a*, 1935*b* that are closer to opening 1925. In some embodiments, the durometer of first and second support elements 1935*a*, 1935*b* may not vary in the same manner along the length of tongue 1930. The durometer of first and second support elements 1935*a*, 1935*b* may be adjusted based on the shape of first and second support elements 1935*a*, 1935*b*, the material properties of the bending portions of tongue 1930, the dimensions of tongue 1930 such that tongue 1930 is prevented from breaking due to stress while allowing the contacts of tongue 1930 to properly couple with the contacts of a corresponding receptacle connector during mating events.

FIGS. 19C-19F are cross sectional side views of the USB plug connector of FIGS. 19A and 19A-1 with a support structure according to embodiments of the present invention. The support structures shown in FIGS. 19C-19F may be similar to support structure 1935 in that they include support members having a surface that faces a surface of tongue 1930 and the distance between those surfaces may vary along a portion of the length of tongue 1930 (e.g., the bending portion). However, there may be differences between support structure 1935 and the support structures of FIGS. 19C-19F.

Figure 19C:
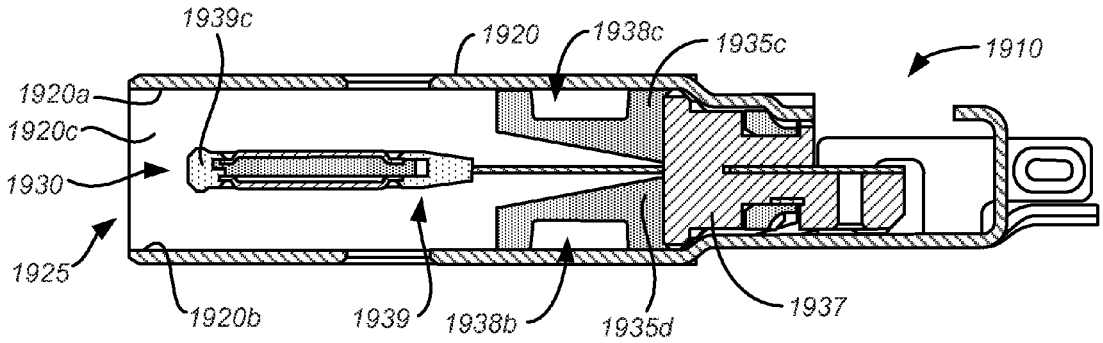
FIGS. 19C-19F are cross sectional side views of the USB plug connector of FIGS. 19A and 19A-1 with a support structure according to embodiments of the present invention.

For example, FIG. 19C illustrates a support structure, including support members 1935*c* and 1935*d*, which include opposing surfaces that face tongue 1930. As compared with FIGS. 19B and 19B1, the distance between these opposing surfaces vary to a greater extent along a portion of the length of tongue 1930, resulting in a larger tapered opening. As shown in FIG. 19C, support members 1935*c* and 1935*d* can also include recesses 1938*c*, 1938*d* shaped and sized as shown in FIG. 19C. These recesses 1935*a*, 1935*b* may be otherwise sized and shaped in order to reduce stress concentrations at tongue 1930 while providing sufficient contact normal force.

Figure 19D:
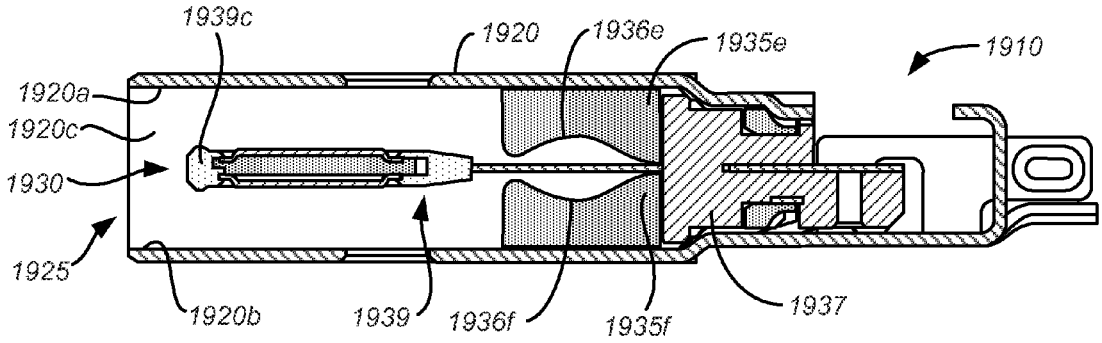

FIG. 19D illustrates a support structure, including support members 1935*e* and 1935*f* having opposing surfaces 1936*e* and 1936*f* that face tongue 1930 and have a curvature. Surfaces 1936*e*, 1936*f* can be described as having hills and a valley. In some embodiments, surfaces 1936*e*, 1936*f* can include a series of hills and valleys of various shapes and sizes. As with other embodiments described above, opposing surfaces 1936*e*, 1936*f* may be sized and shaped in order reduce stress concentrations at tongue 1930 while providing sufficient contact normal force for the contacts of tongue 1930.

Figure 19E:
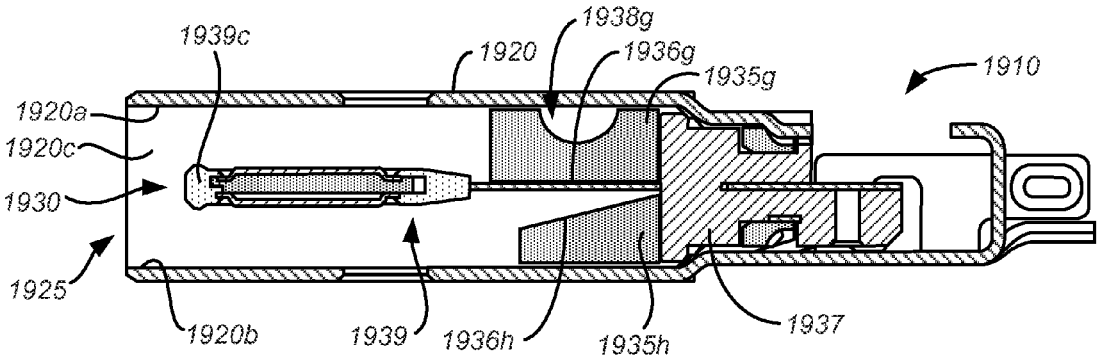

FIG. 19E illustrates another support structure for use in an embodiment of connector 1910. In contrast with the support structures above, support members 1935*g*, 1935*h* are not symmetric about a length direction of the tongue. For example, support member 1935*g* extends farther from base 1937 than support member 1935*h*. In addition, support member 1935*g* includes a surface 1936*g* facing tongue 1930 and orientated in a plane parallel to the plane in which an opposing surface of tongue 1930 is oriented, whereas support member 1935*h* includes a surface 1936*h* facing tongue 1930 that is oriented in a plane that intersects the plane of the opposing surface of tongue 1930. In addition, as shown in FIG. 19E, support member 1935*h* does not include a recess while support member 1935*g* does include a recess 1938*g*. As with other embodiments described above, opposing surfaces 1936*g*, 1936*h* may be sized and shaped in order to reduce stress concentrations at tongue 1930 while providing sufficient contact normal force for the contacts of tongue 1930.

Figure 19F:
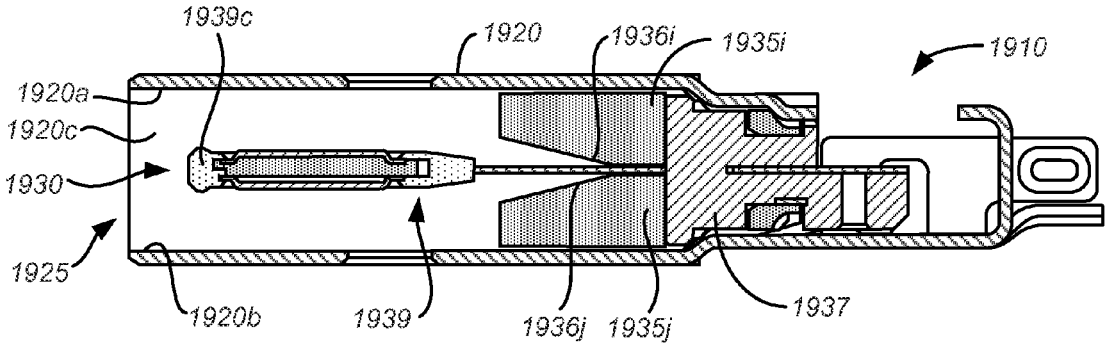

FIG. 19F illustrates a support structure that includes a mix of the features of the support structures shown in FIGS. 19C-19E. For example, the support structure shown in FIG. 19F includes support members 1935*i*, 1935*j* that are symmetric about a length direction of tongue 1930. Support members 1935*i* and 1935*j* include opposing surfaces 1936*i* and 1936*j*, respectively, which face tongue 1930. A distance between these opposing surfaces varies along a portion of the length of tongue 1930 and is constant along another portion of the length of tongue 1930. As with the other embodiments, support members 1935*i* and 1935*j* may be shaped and sized to distribute stress along the bending portion of tongue 1930 while providing sufficient contact normal force for the contacts of tongue 1930.

FIGS. 19G-19J are cross sectional side views of the USB plug connector of FIGS. 19A and 19A-1 with a support structure according to embodiments of the present invention. The support structures shown in FIGS. 19G-19J may be similar to support structure 1935, as shown in FIGS. 19B and 19B-1, in that they include support members having surfaces that face a surface of tongue 1930 and the distance between the surfaces of the support members may be constant along a portion of the length of tongue 1930 (e.g., the bending portion). However, there are differences between support structure 1935 and the support structures of FIGS. 19G-19J.

Figure 19G:
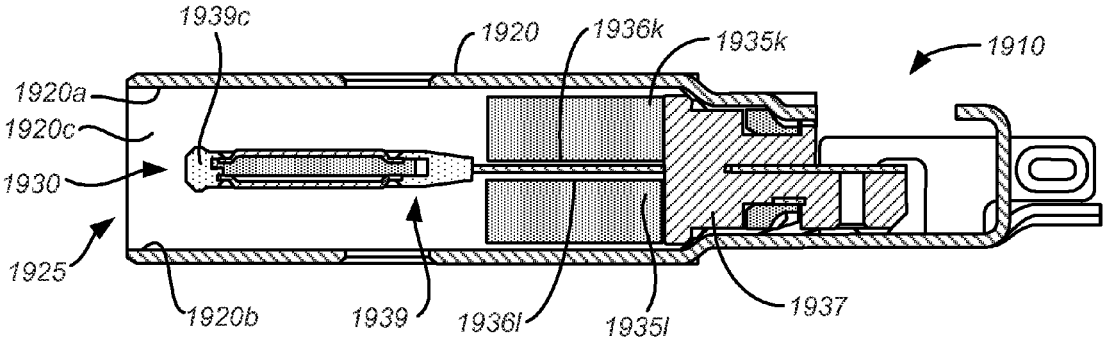
FIGS. 19G-19J are cross sectional side views of the USB plug connector of FIGS. 19A and 19A-1 with a support structure according to embodiments of the present invention.

FIG. 19G illustrates a support structure for use in an embodiment of connector 1910. The support structure shown in FIG. 19G includes support members 1935*k*, 1935*l* that are symmetric about a length direction of tongue 1930. Support member 1935*k* includes a surface 1936*k* facing tongue 1930 and is orientated in a plane parallel to the plane in which the opposing surface of tongue 1930 is oriented. Similarly, support member 1935*l* also includes a surface 1936*l* facing another opposing surface of tongue 1930 and is orientated in a plane parallel to the plane in which the other opposing surface of tongue 1930 is oriented. Varying the durometer of support members 1935*k*, 1935*l* or portions thereof and/or choosing an appropriate material for support members 1935*k*, 1935*l* (as shown in FIG. 19G) may distribute stress along the bending portion of tongue 1930 while providing sufficient contact normal force for the contacts of tongue 1930.

Figure 19H:
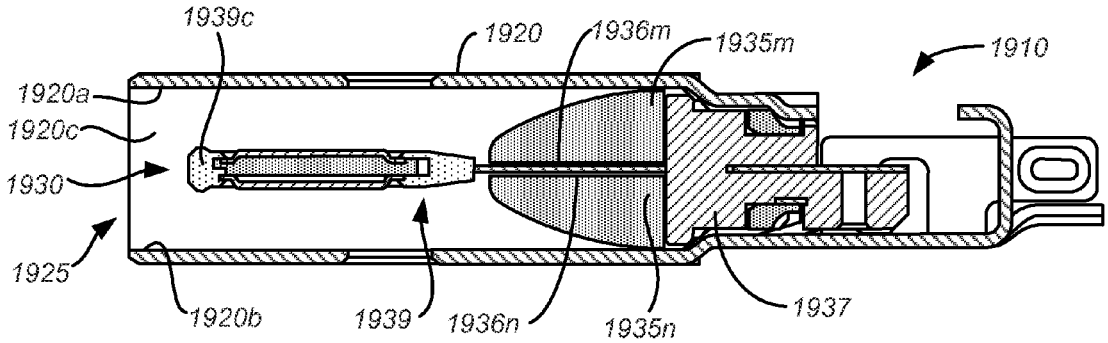
Figure 19I:
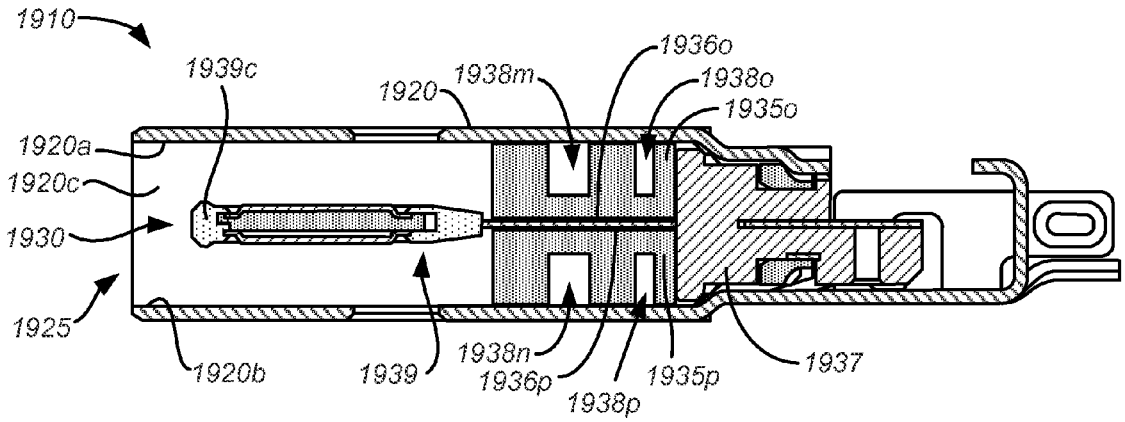

FIG. 19H illustrates another support structure for use in an embodiment of connector 1910. The support structure shown in FIG. 19H includes support members 1935*m*, 1935*n* that are similar to support members 1935*k*, 1935*l* (as shown in FIG. 19G) except that the height of support members 1935*m*, 1935*n* varies along a portion of the length of tongue 1930. More specifically, the surfaces opposite surfaces 1936*m*, 1936*n* are curved surfaces. As with other embodiments described herein, varying the durometer of support members 1935*m*, 1935*n* or portions thereof, choosing an appropriate material for support members 1935*m*, 1935*n* and/or shaping or sizing support members 1935*m*, 1935*n* may be used to allow stress to be distributed along the bending portion of tongue 1930 while providing sufficient contact normal force for the contacts of tongue 1930.

FIG. 191 illustrates yet another support structure for use in an embodiment of connector 1910. The support structure shown in FIG. 19I includes support members 1935*o*, 1935*p* that are similar to support members 1935*k*, 1935*l*, except that support members 1935*o*, 1935*p* include recesses at the surfaces opposite surfaces 1936*o*, 1936*p*. Support members 1935*o*, 1935*p* each include rectangular prism shaped recesses of varying sizes. These recesses, recesses 1938*m*-1938*p* may be sized and/or shaped such that support members 1935*o*, 1935*p* can distribute stress along the bending portion of tongue 1930 while providing sufficient contact normal force for the contacts of tongue 1930.

Figure 19J:
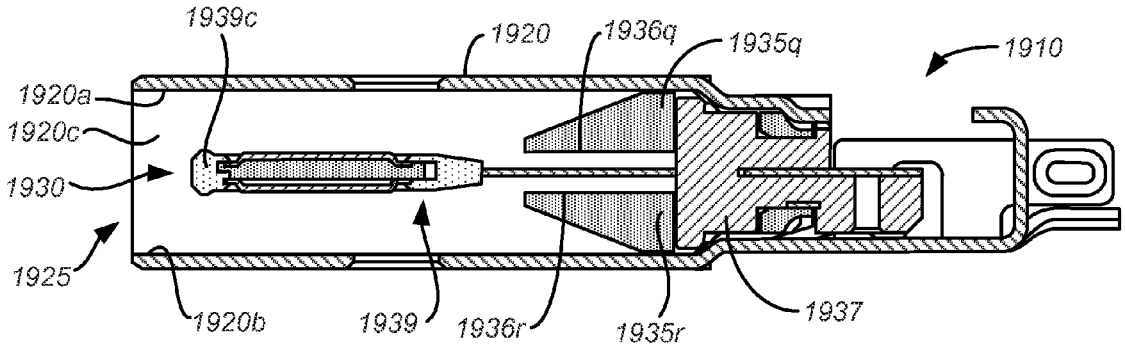

FIG. 19J illustrates yet another support structure for use in an embodiment of connector 1910. The support structure shown in FIG. 19J includes support members 1935*q*, 1935*r* that are similar to support members 1935*k*, 1935*l* (as shown in FIG. 19G) except that the height of support members 1935*q*, 1935*r* varies about a portion of the length of tongue 1930. More specifically, as shown in FIG. 19J, the surfaces opposite surfaces 1936*q*, 1936*r* include flat and angled portions. As with other embodiments described herein, varying the durometer of support members 1935*q*, 1935*r* or portions thereof, choosing an appropriate material for support members 1935*q*, 1935*r* and/or shaping or sizing support members 1935*q*, 1935*r* may be used to allow stress to be distributed along the bending portion of tongue 1930 while providing sufficient contact normal force for the contacts of tongue 1930.

Figure 19K:
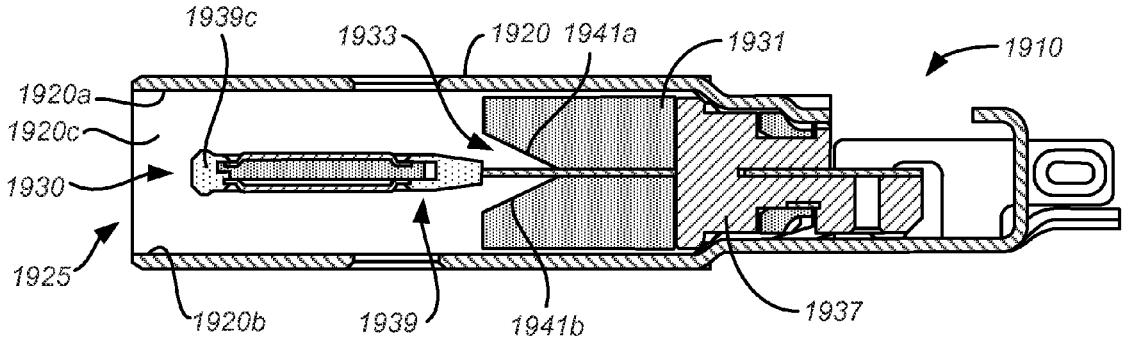
FIG. 19K is a cross sectional side vies of the USB plug connector of FIGS. 19A and 19A-1 with a one-piece support structure according to an embodiment of the present invention.

FIG. 19K is a cross sectional side view of the USB plug connector of FIGS. 19A and 19A-1 with a one-piece support structure according to an embodiment of the present invention. The support structures shown in FIG. 19K may be similar to support structure 1935, as shown in FIGS. 19C-19J, except that support structure 1931 may be integrally formed as one piece. In some embodiments, support structure 1931 may be similarly sized and similarly shaped as of the aforementioned support structure. As shown in FIG. 19K, support structure 1931 may include a slot. Tongue 1930 extends through base 1937 and support structure 1931 and between a surface 1941 of slot 1933 and towards opening 1925. During a mating event, tongue 1930 may either deflect towards and make contact with a first portion 1941*a* of slot 1933 or defect towards and make contact with a second portion 1941*b* of slot 1933. As such, slot 1933 may distribute stress across the bending portions of tongue 1930 (e.g., a portion of contact frames).

A person of skill in the art will recognize instances where the features of one of the above embodiments can be combined with the features of another of the above embodiments and where one of the above embodiments may be modified according to any of the other above embodiments. The structures and methods shown in FIGS. 19A-19K and discussed in relation thereto may also be implemented in various ways in other embodiments of the present invention.

It will be appreciated that connector 1910 is illustrative and that variations and modifications are possible. The shapes and number of contact frames of connector 1910 can be varied in ways not specifically described here. Further, while connector 1910 above was described with reference to a reversible USB plug connector, the invention may apply to other connectors male or female and reversible and otherwise. Further, the contact frames of connector 1810 may be replaced with a PCB, as discussed above with reference to other figures.

An example of another embodiment of the present invention is shown in the following figures.

Figure 12A:
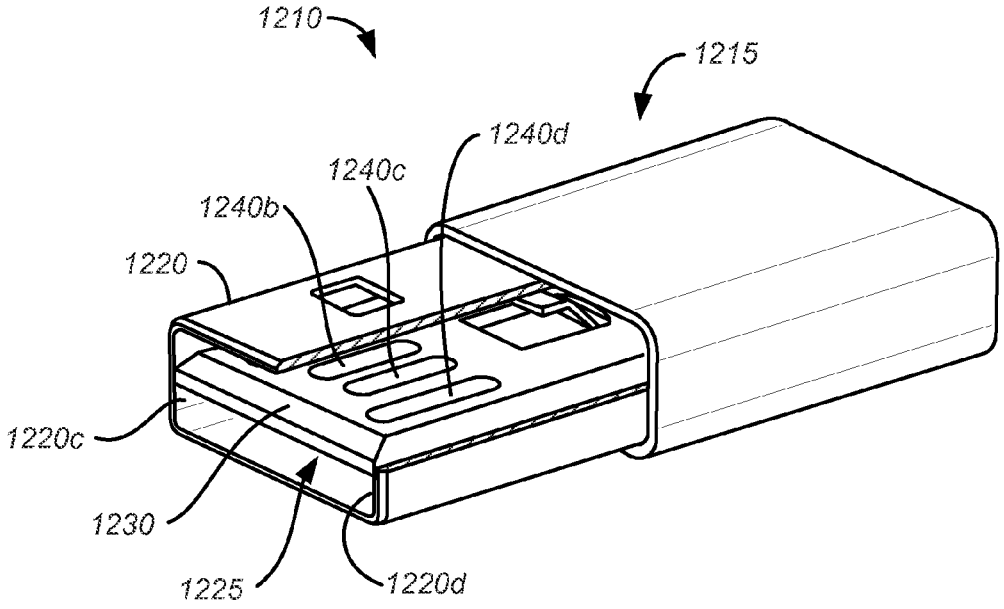
FIGS. 12A and 12B are partial cross sectional perspective and cross sectional views, respectively, of a USB plug connector according to one embodiment of the present invention.
Figure 12B:
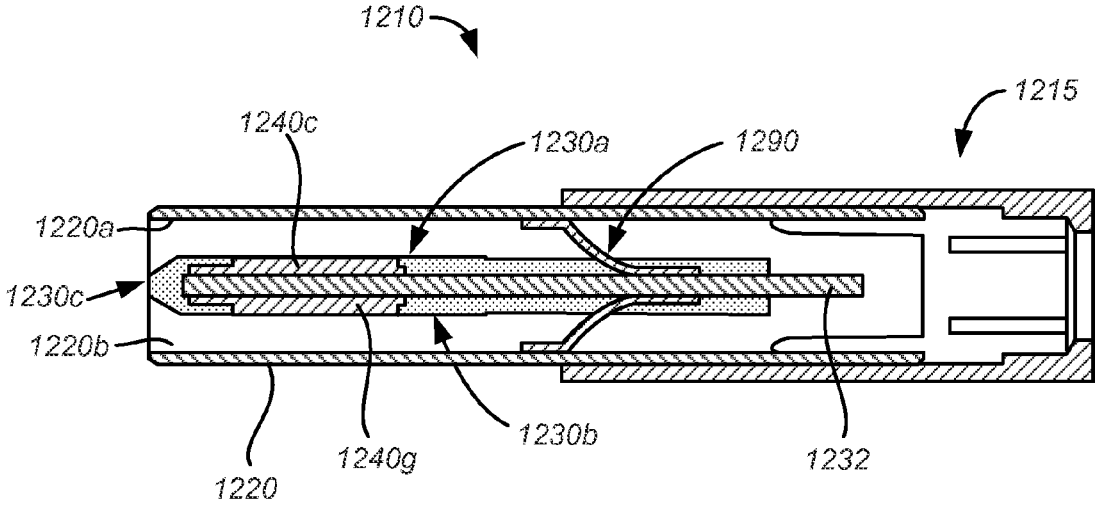

FIGS. 12A and 12B are partial cross sectional perspective and cross sectional views, respectively, of a USB plug connector 1210 according to one embodiment of the present invention. Connector 1210 includes a body 1215 and a shell 1220 extending longitudinally away from body 1215 in a direction parallel to the length of connector 1210. Shell 1220 includes an opening 1225 that communicates with a cavity defined in part by first, second, left and right inner surfaces 1220*a*-1220*d* of shell 1220 and a tongue 1230. As shown in FIGS. 12A and 12B, tongue 1230 may be centrally located within shell 1220 and extend parallel to the length of connector 1210. Contacts 1240*a*-1240*d* are disposed on a first major surface 1230*a* and four additional contacts (only contact 1240*g* is shown in FIG. 1B) are disposed on a second major surface 1230*b*. As also shown in FIGS. 12A and 12B, tongue 1230 may include a bullnose tip 1230*c* for reasons that will be explained again below.

As shown in FIGS. 12A and 12B, connector 1210 can have a 180 degree symmetrical, double orientation design which enables the connector to be inserted into a corresponding receptacle connector in both a first orientation where surface 1230*a* is facing up or a second orientation where surface 1230*a* is rotated 180 degrees and facing down. Specifics of general double or dual orientation design are discussed in greater detail above. Simply stated, contacts disposed on first surface 1230*a* (contacts 1240*a*-1240*d*) mate with contacts of the corresponding receptacle connector in one orientation and contacts disposed on second surface 1230*b* mate with contacts of the corresponding receptacle connector in the other orientation.

Tongue 1230 may be a PCB having contacts, which PCB may be overmolded with one or more of a variety of dielectric materials including flexible, wear resistant materials such as LCP, POM, Nylon and others. Tongue 1230 may vertically translate either toward first or second inner surfaces 1220*a*, 1220*b* of shell 1220 when connector 1210 is inserted into a corresponding receptacle connector. This vertical translation may be facilitated by an elevator mechanism 1290, e.g., a spring or other vertical translation guide, that may not allow tongue 1230 to move horizontally or pivot. Elevator mechanism 1290 may be engaged as bullnose tip 1230*c* comes into contact with internal features of a corresponding receptacle connector during an insertion event and may vertically translate tongue 1230 to the appropriate region within a corresponding receptacle connector, allowing contacts disposed on either surface 1230*a* or 1230*b* of the plug connector 1210 to mate with contacts on the corresponding receptacle connector.

As mentioned earlier, tongue 1230 may be centrally located within opening 1225 of shell 1220. For example, tongue 1230 may be positioned within opening 1225 such that its distance from first and second inner surfaces 1220*a*, 1220*b* causes connector 1210 to always vertically translate, with the assistance of bullnose tip 1230*c* and elevator mechanism 1290, toward the appropriate region within a corresponding receptacle connector regardless of whether plug connector 1210 is in the first or second orientation, as described above.

Body 1215 is generally the portion of connector 1210 that a user will hold onto when inserting or removing connector 1210 from a corresponding receptacle connector. Body 1215 can be made out of a variety of materials and in some embodiments is made from a dielectric material, such as a thermoplastic polymer formed in an injection molding process. While not shown in FIG. 12A or 12B, a cable and a portion of shell 1220 may extend within and be enclosed by body 1215. In addition, electrical contact to the contacts of surfaces 1230*a*, 1230*b* can be made with individual wires in a cable within body 1215. In one embodiment, a cable includes a plurality of individual insulated wires for connecting to contacts of surfaces 1230*a*, 1230*b* that are soldered to bonding pads on a PCB housed within body 1215 or on tongue 1230 when tongue 1230 is a PCB. The bonding pads on the PCB may be electrically coupled to corresponding individual contacts of surfaces 1230*a* and 1230*b*. In some embodiments, contacts of one of surfaces 1230*a* and 1230*b* to be shorted through tongue 1230 to corresponding contacts on the other of surfaces 1230*a* and 1230*b* and then appropriately routed to the individual wires of a cable within body 1215.

The contacts of tongue 1230 can be made from copper, nickel, brass, a metal alloy or any other appropriate conductive material. In some embodiments, contacts can be printed on surfaces PCB 1232. As with standard USB plug connectors, plug connector 1210 may include contacts for power, ground and a pair of differential data signals (e.g., data transmit). For example, contact 1240*a* (not shown in FIG. 12A) may be a ground pin, contact 1240*b* may be a Data+pin, contact 1240*c* may be a Data−pin, and contact 1240*d* may be a power pin (VBUS). As mentioned earlier, the four additional contacts disposed on second major surface 1230*b* can be positioned so that the contacts on first and second major surfaces 1230*a*, 1230*b* are arranged in a symmetric manner and have the same pinout. In this manner, either of two intuitive insertion orientations may result in the same plug connector 1210 pinout being mated with corresponding contacts of a receptacle connector during a mating event.

A sensing circuit as described above may be included with connector 1210 and/or a corresponding receptacle connector.

An example of another embodiment of the present invention is shown in the following figures.

Figure 13A:
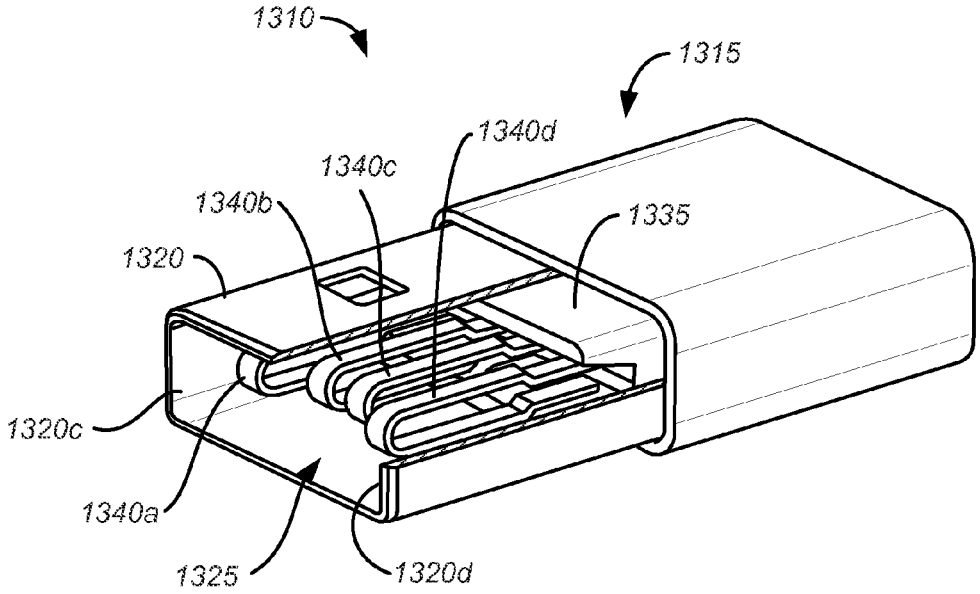
FIGS. 13A and 13B are partial cross sectional perspective and cross sectional views, respectively, of a USB plug connector according to one embodiment of the present invention.
Figure 13B:
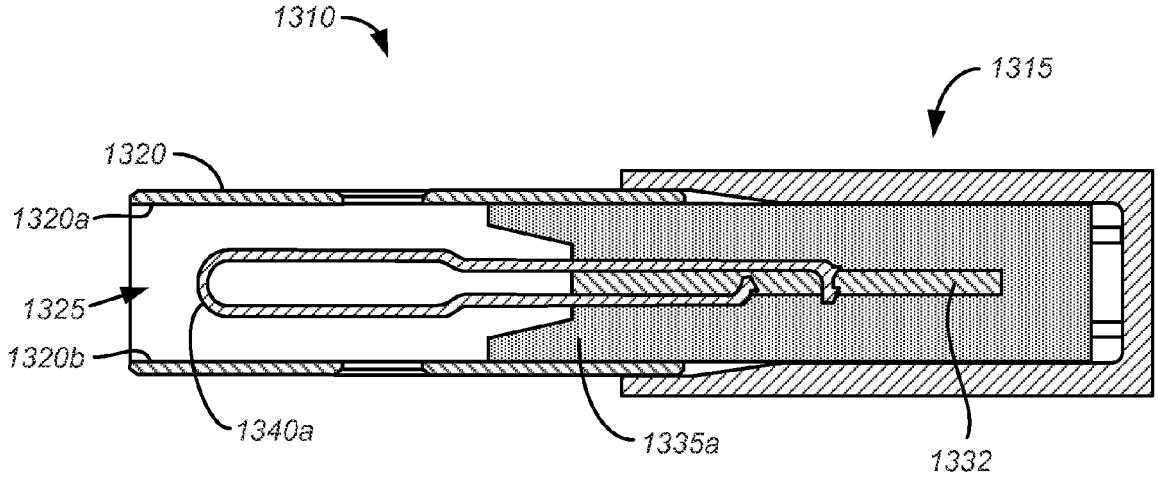

FIGS. 13A and 13B are partial cross sectional perspective and cross sectional views, respectively, of a USB plug connector 1310 according to one embodiment of the present invention. Connector 1310 includes a body 1315 and a shell 1320 extending longitudinally away from body 1315 in a direction parallel to the length of connector 1310. Shell 1320 includes an opening 1325 that communicates with a cavity defined by first, second, left and right inner surfaces 1320*a*-1320*d* of shell 1320, spring contacts 1340*a*-1340*d*, and a support structure 1335. As shown in FIGS. 13A and 13B, spring contacts 1340*a*-1340*d* may be centrally located between first and second inner surfaces 1320*a*, 1320*b* and extend parallel to the length of connector 1310. As also shown in FIGS. 13A and 13B, a bullnose tip may be formed at the distal ends of spring contacts 1340*a*-1340*d*.

As shown in FIGS. 13A and 13B, connector 1310 can have a 180 degree symmetrical, double orientation design which enables the connector to be inserted into a corresponding receptacle connector in both a first orientation where surface 1330*a* is facing up or a second orientation where surface 1330*a* is rotated 180 degrees and facing down. To allow for the orientation agnostic feature of connector 1310, spring contacts 1340*a*-1340*d* are not polarized. Specifics of general double or dual orientation designs are discussed in detail above. Simply stated, one side of spring contacts 1340*a*-1340*d* mate with contacts of a corresponding receptacle connector in one orientation and the other side of spring contacts 1340*a*-1340*d* may mate with contacts of a corresponding receptacle connector in the other orientation.

Structural support 1335 may be made from a variety of dielectric materials, including flexible polymers. The materials used to form structural support 1335 may be chosen such that spring contacts 1340*a*-1340*d* deflects either toward first or second inner surfaces 1320*a*, 1320*b* of shell 1320 when connector 1310 is inserted into a corresponding receptacle connector. This deflection may occur as the distal tip of spring contacts 1340*a*-1340*d*, which may be a bullnose tip, comes into contact with internal features of a corresponding receptacle connector and leads spring contacts 1340*a*-1340*d* to the appropriate region within a corresponding receptacle connector, allowing spring contacts 1340*a*-1340*d* to mate with contacts on the corresponding receptacle connector.

As mentioned earlier, spring contacts 1340*a*-1340*d* may be centrally located within opening 1325 of shell 1320. For example, spring contacts 1340*a*-1340*d* may be positioned within opening 1325 such that its distance from first and second inner surfaces 1320*a*, 1320*b* causes spring contacts 1340*a*-1340*d* to always deflect, possibly with the assistance of bullnose tips, toward the appropriate region within a corresponding receptacle connector regardless of whether plug connector 1310 is in the first or second orientation, as described above.

Body 1315 is generally the portion of connector 10 that a user will hold onto when inserting or removing connector 1310 from a corresponding receptacle connector. Body 1315 can be made out of a variety of materials and in some embodiments is made from a dielectric material, such as a thermoplastic polymer formed in an injection molding process. While not shown in FIG. 13A or 13B, a cable and a portion of shell 1320 may extend within and be enclosed by body 1315. Also, electrical contact to spring contacts 1340*a*-1340*d* can be made with individual wires in a cable within body 1315. In one embodiment, a cable includes a plurality of individual insulated wires for connecting to spring contacts 1340*a*-1340*d* that are soldered to bonding pads on a PCB housed within body 1315. Thus, the bonding pads on the PCB may be electrically coupled to corresponding individual spring contacts 1340*a*-1340*d*.

Spring contacts 1340*a*-1340*d* can be made from copper, nickel, brass, a metal alloy or any other appropriate conductive material. As with standard USB plug connectors, plug connector 1310 may include contacts for power, ground and a pair of differential data signals (e.g., data transmit). For example, contact 1340*a* may be a ground pin, contact 1340*b* may be a Data+pin, contact 1340*c* may be a Data−pin, and contact 1340*d* may be a power pin (VBUS).

A sensing circuit as described above may be included with connector 1310 and/or a corresponding receptacle connector.

An example of another embodiment of the present invention is shown in the following figures.

Figure 14A:
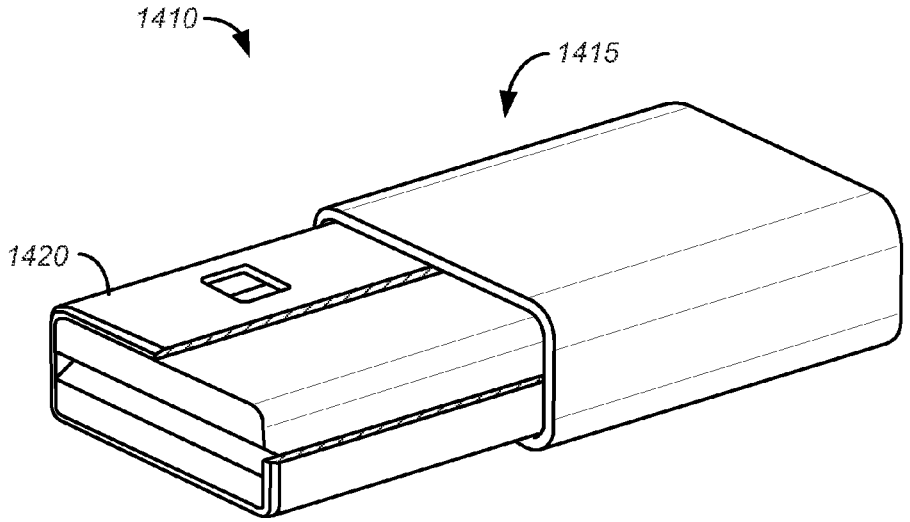
FIGS. 14A and 14B are partial cross sectional perspective and cross sectional views, respectively, of a USB plug connector according to one embodiment of the present invention.
Figure 14B:
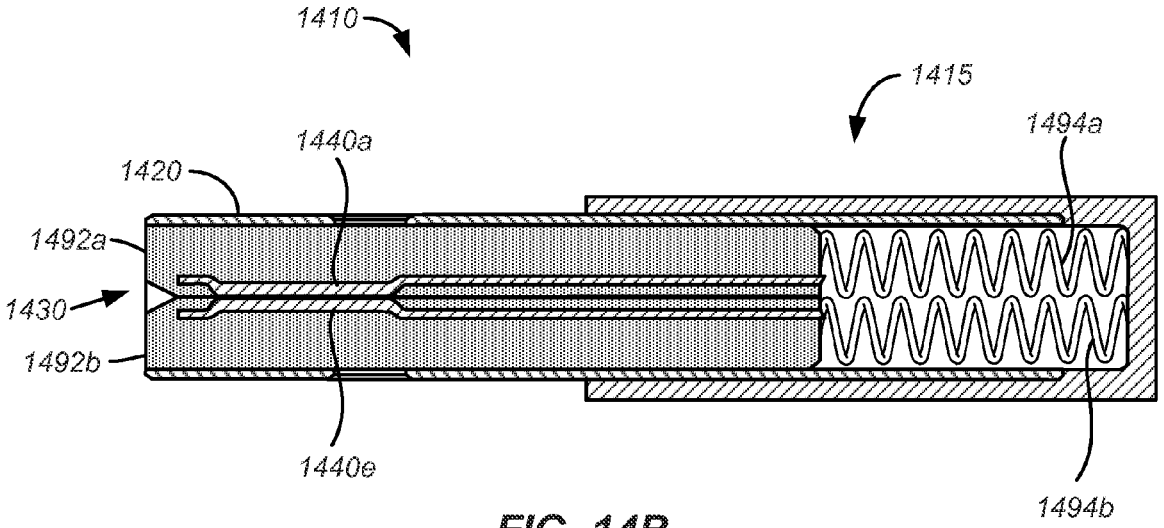

FIGS. 14A and 14B are partial cross sectional perspective and cross sectional views, respectively, of a USB plug connector 1410 according to one embodiment of the present invention. Connector 1410 includes a body 1415 and a shell 1420 extending longitudinally away from body 1415 in a direction parallel to the length of connector 1410. Shell 1420 contains a first and second pistoning contact blocks 1492*a*, 1492*b*. Springs 1494*a* and 1494*b* may bias pistoning blocks 1492*a* and 1492*b*, respectively, in the position shown in FIG. 4B. When a pistoning contact blocks 1492*a* and/or 1492*b* are pressed into shell 1420 (e.g., during a mating event with a receptacle connector corresponding to plug connector 1410), springs 1494*a* and/or 1494*b* may compress in order to allow this movement. And when a pressing force is removed from pistoning contact blocks 1492*a* and/or 1492*b*, springs 1494*a* and/or 1494*b* may cause pistoning contact blocks 1492*a* and/or 1492*b* to return to their positions as shown in FIG. 14B. Additionally, when one of pistoning blocks 1492*a*, 1492*b* is pressed into shell 1420, a tongue 1430 may be revealed. Tongue 1430 may be centrally located within shell 1420 and extend parallel to the length of connector 1410. Four contacts (e.g., contacts 1440*a* and 1440*e* as shown in FIG. 14B) may be disposed on both of first and second major surfaces of tongue 1430.

As shown in FIGS. 14A and 14B, connector 1410 can have a 180 degree symmetrical, double orientation design which enables the connector to be inserted into a corresponding receptacle connector in both a first orientation as shown in FIG. 14A and a second orientation where connector 1410 is rotated 180 degrees about its length axis. Specifics of general double or dual orientation designs are discussed in greater detail above. Simply stated, the dual orientation design of connector 1410 allows one set of four contacts of 1410 to mate with contacts of the corresponding receptacle connector in the first and in the second orientation.

Tongue 1430 may be any of the tongue embodiments previously described herein. However, a rigid embodiment of tongues according to the present invention may be useful for connector 1410. The contacts of tongue 1430 may also be any of the contacts embodiments previously described herein.

Body 1415 is generally the portion of connector 1410 that a user will hold onto when inserting or removing connector 1410 from a corresponding receptacle connector. Body 1415 can be made out of a variety of materials and in some embodiments is made from a dielectric material, such as a thermoplastic polymer formed in an injection molding process. While not shown in FIG. 14A or 14B, a cable and a portion of shell 1420 may extend within and be enclosed by body 1415, as described in relation to other embodiments of the present invention.

A sensing circuit as described above may be included with connector 1410 and/or a corresponding receptacle connector.

Also, while a number of specific embodiments were disclosed with specific features, a person of skill in the art will recognize instances where the features of one embodiment can be combined with the features of another embodiment. For example, some specific embodiments of the invention set forth above were illustrated with specific tongue or tab designs. A person of skill in the art will readily appreciate that any of the tongues or tab described herein, as well as others not specifically mentioned, may be used instead of or in addition to the tongue or tab discussed with respect to specific embodiments of the present invention. As another example, some specific embodiments of the invention set forth above were illustrated with cable assemblies having a cable connected to a USB connector. A person of skill in the art will readily appreciate that any of the cable assemblies herein, as well as others not specifically mentioned, may be modified to be a USB flash drive or another device that includes a USB connector but does not include a cable. Also, those skilled in the art will recognize, or be able to ascertain using no more than routine experimentation, many equivalents to the specific embodiments of the inventions described herein.

What is claimed is:

1. A reversible plug connector comprising:

a body;

a dielectric base;

a shell extending from the body and having an opening at a first end that communicates with a cavity defined by inner surfaces of the shell and the dielectric base;

a deflectable tongue disposed within the cavity and extending from the dielectric base towards the opening, the tongue having a tip proximal the opening and first and second opposing surfaces that extend from the tip towards the base, the tongue including a first plurality of contacts exposed at the first opposing surface of the tongue proximal the tip and a second plurality of contacts exposed at the second opposing surface of the tongue proximal the tip; and a support structure that includes first and second support members disposed adjacent to the base and located on opposite sides of the tongue, the first support member having a first major surface that faces the first opposing surface of the tongue, the second support member having a second major surface that faces the second opposing surface of the tongue, the second support member defining a curved recess.

2. The plug connector set forth in claim 1 wherein the curved recess defined by the second support member faces one of the inner surfaces of the shell.

3. The plug connector set forth in claim 1 wherein the curved recess is defined by the second major surface.

4. The plug connector set forth in claim 1 wherein the first and second support members are symmetric about a length direction of the tongue.

5. The plug connector set forth in claim 1 wherein the first and second support members both define curved recesses.

6. The plug connector set forth in claim 1, wherein the first and second major surfaces are oriented in first and second planes, respectively, the first plane extending parallel to the second plane.

7. The plug connector set forth in claim 1 wherein the tongue includes a plurality of contact frames.

8. A reversible plug connector comprising:

a body;

a dielectric base;

a shell extending from the body and having an opening at a first end that communicates with a cavity defined by inner surfaces of the shell and the dielectric base;

a deflectable tongue disposed within the cavity and extending from the dielectric base towards the opening, the tongue having a tip proximal the opening and first and second opposing surfaces that extend from the tip towards the base, the tongue including a plurality of contacts exposed at the first and second surfaces of the tongue proximal the tip, the tongue including a first insulating material disposed between the plurality of contacts proximate the tip and a second insulating material substantially surrounding the first insulating material, the second insulating material formed of a different material than the first insulating material; and a support structure that includes first and second support members disposed adjacent to the base and located on opposite sides of the tongue, the first support member having a first major surface that faces the first surface of the tongue, the second support member located having a second major surface that faces the second surface of the tongue.

9. The plug connector set forth in claim 8 wherein the first and second support members form a tapered opening through which the tongue extends.

10. The plug connector set forth in claim 8 wherein at least one of the first and second major surfaces includes a series of hills and valleys.

11. The plug connector set forth in claim 8 wherein at least one of the first and second major surfaces defines a curved recess that distributes stress across a bending portion of the tongue when the tongue is deflected.

12. The plug connector set forth in claim 8 wherein the first support member extends farther from the base than that of the second support member.

13. The plug connector set forth in claim 8 wherein the tongue includes a printed circuit board proximate the tip of the tongue.

14. The plug connector set forth in claim 8 wherein the first and second support members are assembled with the base.

15. A reversible Universal Serial Bus plug connector comprising:

a body;

a dielectric base;

a support structure being disposed adjacent to the base;

a shell extending from the body and having an opening at a first end that communicates with a cavity defined by four inner surfaces of the shell and the support structure;

a deflectable tongue disposed within the cavity and extending from a surface of the slot towards the opening, the tongue having a tip proximal the opening and first and second opposing surfaces that extend from the tip towards the surface of the slot, the tongue including a printed circuit board integrally formed with the tongue that includes a first plurality of contacts exposed at the first surface of the tongue proximal the tip and a second plurality of contacts exposed at the second surface of the tongue proximal the tip, wherein a first portion of the support structure faces the first surface of the tongue and a second portion of the support structure faces the second surface of the tongue, wherein the first and second portions of the support structure are configured to distribute stress across the tongue when the tongue is deflected.

16. The plug connector set forth in claim 15 wherein a portion of the printed circuit board is positioned proximate the tip of the deflectable tongue.

17. The plug connector set forth in claim 15 wherein the first and second portions are oriented in first and second planes, respectively, the first plane extending parallel to the second plane.

18. The plug connector set forth in claim 15 wherein the support structure has a varying durometer.

19. The plug connector set forth in claim 15 wherein a cable is coupled to the body and includes a plurality of insulated wires that are electrically coupled to the printed circuit board.

20. The plug connector set forth in claim 15 wherein the plurality of contacts are made from a metal alloy.

* * * * *